US006763209B2

(12) United States Patent
Higeta et al.

(10) Patent No.: US 6,763,209 B2
(45) Date of Patent: Jul. 13, 2004

(54) PROCESS CARTRIDGE REMANUFACTURING METHOD

(75) Inventors: Akira Higeta, Shizuoka-ken (JP); Satoshi Yasuda, Toride (JP); Takayoshi Hoshi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/283,287

(22) Filed: Oct. 30, 2002

(65) Prior Publication Data

US 2003/0123900 A1 Jul. 3, 2003

(30) Foreign Application Priority Data

Oct. 31, 2001 (JP) ..... 2001-334405

(51) Int. Cl.[7] ..... G03G 15/00
(52) U.S. Cl. ..... 399/109; 399/111; 399/113
(58) Field of Search ..... 399/109, 111, 399/113, 103, 105, 106, 114, 119, 274, 284

(56) References Cited

U.S. PATENT DOCUMENTS

| | | | | |
|---|---|---|---|---|
| 5,485,249 A | | 1/1996 | Higeta et al. | |
| 5,740,499 A | | 4/1998 | Higeta et al. | 399/105 |
| 5,809,374 A | | 9/1998 | Tsuda et al. | 399/111 |
| 6,029,031 A | * | 2/2000 | Yokomori et al. | 399/109 |
| 6,101,348 A | | 8/2000 | Nonaka et al. | 399/103 |
| 6,397,025 B1 | | 5/2002 | Higeta et al. | 399/109 |
| 6,400,914 B1 | | 6/2002 | Noda et al. | 399/90 |
| 6,473,577 B1 | | 10/2002 | Higeta et al. | 399/109 |
| 6,519,430 B2 | * | 2/2003 | Higeta et al. | 399/109 |

* cited by examiner

*Primary Examiner*—Hoang Ngo
(74) *Attorney, Agent, or Firm*—Fitzpatrick, Cella, Harper & Scinto

(57) ABSTRACT

A remanufacturing method for a process cartridge detachably mountable to a main assembly of an electrophotographic image forming apparatus, includes (a) a frame separating step of separating the first frame and the second frame from each other; (b) a developing blade dismounting step of dismounting, from the second frame, a developing blade which is mounted on the second frame to regulate an amount of the developer deposited on the developing roller; (c) a thin plate sheet material mounting step of mounting a thin sheet material on such a side of a longitudinal seal for providing a seal extended between the first frame and the second frame in a longitudinal direction of the second frame as is opposite from a side mounted to the second frame; (d) a developer filling step of filling the developer into the developer accommodating portion; (e) a developing blade mounting step of mounting the developing blade in a facing orientation which is opposite from a facing orientation in which the developing blade has been mounted on the second frame; and (f) a frame coupling step of coupling the separated first frame and second frame.

24 Claims, 26 Drawing Sheets

PROCESS CARTRIDGE REMANUFACTURING METHOD

FIELD OF THE INVENTION

The present invention relates to a process cartridge remanufacturing method. Here, a process cartridge is a cartridge in which a charging means, a developing or cleaning means, and an electrophotographic photoconductive member are integrally disposed, and which is removably mountable in the main assembly of an image forming apparatus. A process cartridge also is a cartridge in which at least one means among a charging means, a developing, or a cleaning means, and an image bearing member are integrally disposed, and which is removably mountable in the main assembly of an image forming apparatus, as well as a cartridge in which at least a developing means and an electrophotographic photoconductive member are integrally disposed, and which is removably mountable in the main assembly of an image forming apparatus.

An image forming apparatus means is an apparatus such as an electrophotographic copying machine, an electrophotographic printer (LED printer, laser beam printer, etc.), an electrophotographic facsimile machine, an electrophotographic word processor, etc.

In the field of an image forming apparatus employing an electrophotographic image formation process, a process cartridge system has been widely in use. According to a process cartridge system, a single or plurality of processing means, which act on the aforementioned electrophotographic photoconductive member, are integrally disposed in a cartridge which is removably mountable in the image assembly of an image forming apparatus, making it possible for an ordinary user to maintain an image forming apparatus without calling on a service person. Thus, the employment of a process cartridge system dramatically improves the operational efficiency of an image forming apparatus. Therefore, a process cartridge system is widely used in the field of an image forming apparatus.

A process cartridge uses developer in order to form an image on recording medium; it consumes the developer therein as it forms images. Eventually, the amount of the developer in a process cartridge will be reduced by the consumption to a level, below which the process cartridge fails to form an image satisfactory in quality to the user who bought the process cartridge. At this point, this process cartridge loses its value as a merchandise.

SUMMARY OF THE INVENTION

There has long been a desire for a simple process cartridge remanufacturing method capable of restoring the commercial value of a used process cartridge, more specifically, a process cartridge which has lost its commercial value due to the consumption of the developer therein.

The primary object of the present invention is to provide a simple process cartridge remanufacturing method.

Another object of the present invention is to provide a process cartridge remanufacturing method capable of restoring the market value of a used process cartridge, that is, a process cartridge which has lost its commercial value due to the consumption of the developer therein to a level, below which the process cartridge fails to form an image satisfactory in quality to the user of the cartridge.

According to one of the characteristic aspects of the present invention, the present invention relates to a method for remanufacturing a process cartridge which is removably mountable in the main assembly of an electrophotographic image forming apparatus, and which comprises: a first frame for supporting an electrophotographic photoconductive drum; and a second frame which is for supporting a development roller for developing an electrostatic latent image formed on the electrophotographic photoconductive drum and has a developer storage portion for holding the developer used for the development of the electrostatic latent image, and which is connected to the first frame in such a manner that the two frames are pivotally movable about their joint. The method comprises:

(a) a frame separating process for separating the first frame from the second frame;

(b) a development blade removing process for removing from the second frame, a development blade attached to the second frame to regulate the amount of developer allowed to remain adhered to the development roller;

(c) a thin plate attaching process for attaching a piece of a thin plate to a lengthwise seal attached in advance to the second frame to seal between the development blade and second frame, across the surface opposite to the surface by which the lengthwise seal is attached to the second frame;

(d) a developer filling process for refilling the developer storage portion with developer;

(e) a development blade attaching process for inversely reattaching the removed blade to the second frame in such a manner that the surface of the blade, which was facing the front, will face the rear; and (f) a frame reconnecting process for reconnecting the separated first and second frames to each other.

According to another characteristic aspect of the present invention, the invention relates to a method for remanufacturing a process cartridge which is removably mountable in the main assembly of an electrophotographic image forming apparatus, and which comprises: a first frame for supporting an electrophotographic photoconductive drum; and a second frame which is for supporting a development roller for developing an electrostatic latent image formed on the electrophotographic photoconductive drum and has a developer storage portion for holding the developer used for the development of the electrostatic latent image, and which is connected to the first frame in such a manner that the two frames are pivotally movable about their joint. The method comprises:

(a) a frame separating process for separating the first frame from the second frame;

(b) a development roller removing process for removing the development roller attached to the second frame;

(c) a thin elastic sealing member removing process for removing a thin elastic sealing member attached in advance to the second frame, along one of the lengthwise edges thereof, to seal between the development roller and second frame;

(d) a reinforcing member attaching process for attaching a reinforcing member to the second frame, next to the area to which the thin elastic sealing member was attached, along one of the lengthwise edges of the second frame, in order to reinforce the area to which the thin elastic sealing member was attached;

(e) a second auxiliary development roller end seal attaching process for attaching second auxiliary development roller end seals to the second frame, inward of development roller end seals attached to the lengthwise ends of the second frame to seal between the development roller and second frame, in a manner to partially surround first auxiliary development roller end seals attached in advance to the second frame, across the areas covered by the thin elastic sealing member;

(f) a thin elastic sealing member attaching process for attaching the thin elastic sealing member;

(g) a developer filling process for refilling the developer storage portion with developer;

(h) a development roller attaching process for reattaching the removed development roller to the second frame; and (i) a frame reconnecting process for reconnecting the separated first and second frames.

According to one of the characteristic aspects of the present invention, the invention relates to a method for remanufacturing a process cartridge which is removably mountable in the main assembly of an electrophotographic image forming apparatus, and which comprises: a first frame for supporting an electrophotographic photoconductive drum; and a second frame which is for supporting a development roller for developing an electrostatic latent image formed on the electrophotographic photoconductive drum and has a developer storage portion for holding the developer used for the development of the electrostatic latent image, and which is connected to the first frame in such a manner that the two frames are pivotally movable about their joint. The method comprises:

(a) a frame separating process for separating the first frame from the second frame;

(b) a development roller removing process for removing the development roller attached to the second frame;

(c) a development blade removing process for removing from the second frame, a development blade attached to the second frame to regulate the amount of developer allowed to remain adhered to the development roller;

(d) a thin elastic sealing member removing process for removing a thin elastic sealing member attached in advance to second frame, along one of the lengthwise edges thereof, to seal between the development roller and second frame;

(e) a thin plate attaching process for attaching a piece of a thin plate to a lengthwise seal attached in advance to the second frame to seal between the development blade and second frame, across the surface opposite to the surface by which the lengthwise seal is attached to the second frame;

(f) a reinforcing member attaching process for attaching a reinforcing member to the second frame, next to the area to which the thin elastic sealing member was attached, along one of the lengthwise edges of the second frame, in order to reinforce the area to which the thin elastic sealing member was attached;

(g) a second auxiliary development roller end seal attaching process for attaching second auxiliary development roller end seals to the second frame, inward of development roller end seals attached to the lengthwise ends of the second frame to seal between the development roller and second frame, in a manner to partially surround first auxiliary development roller end seals attached in advance to the second frame, across the areas covered by the thin elastic sealing member;

(h) a thin elastic sealing member attaching process for attaching the thin elastic sealing member;

(i) a developer filling process for refilling the developer storage portion with developer;

(j) a development blade attaching process for inversely reattaching the removed blade to the second frame in such a manner that the surface of the blade, which was facing the front, will face the rear;

(k) a development roller attaching process for reattaching the removed development roller to the second frame; and (l) a frame reconnecting process for reconnecting the separated first and second frames.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, preferable embodiments of the present invention will be described. In the following descriptions of the embodiments, the widthwise direction of a process cartridge B is the direction in which the process cartridge B is mounted into, or removed from, the main assembly 14 of the image forming apparatus, and coincides with the direction in which recording medium is conveyed. The lengthwise direction of the process cartridge B is the direction perpendicular (approximately perpendicular) to the direction in which the process cartridge B is mounted into, or removed from, the apparatus main assembly 14, being parallel to the top surface of the recording medium and perpendicular (approximately perpendicular) to the direction in which recording medium is conveyed. The left or right of the process cartridge B is the left or right of the process cartridge B as seen from diagonally above the downstream end thereof in terms of the direction in which recording medium is conveyed.

Figure 1:
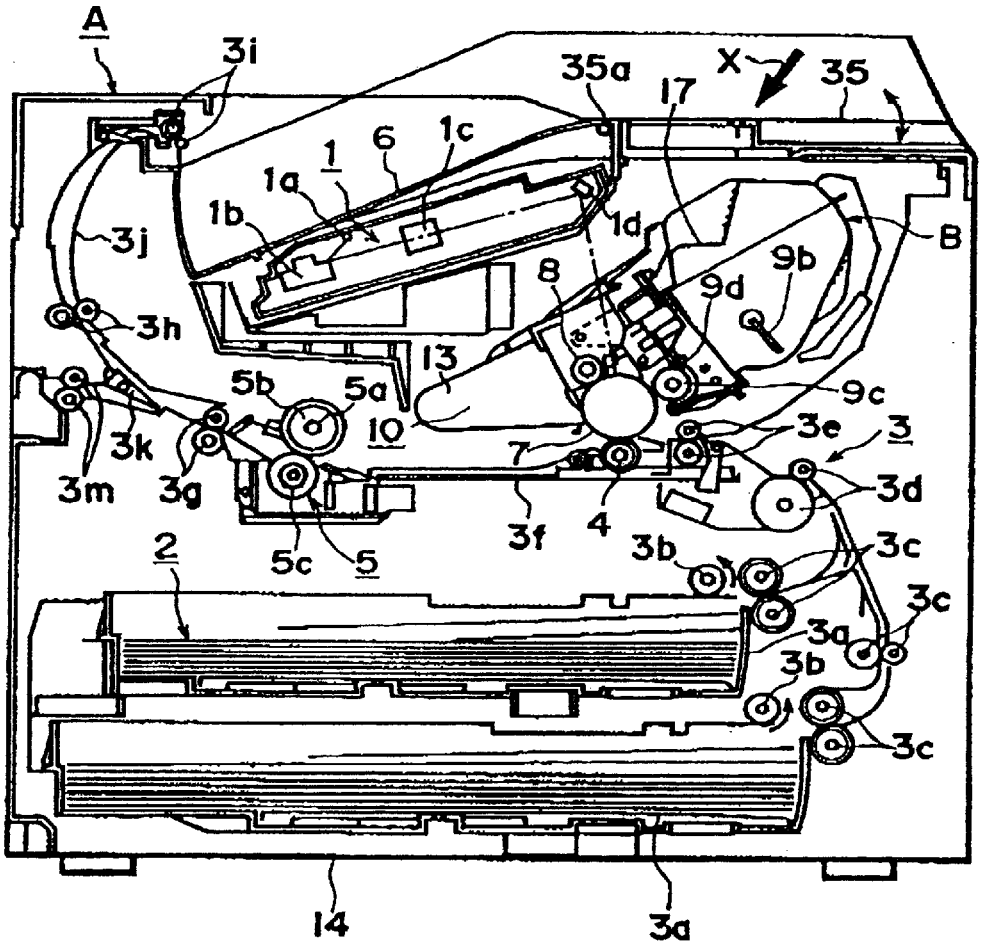
FIG. 1 is a vertical sectional view of an electrophotographic image forming apparatus.
Figure 2:
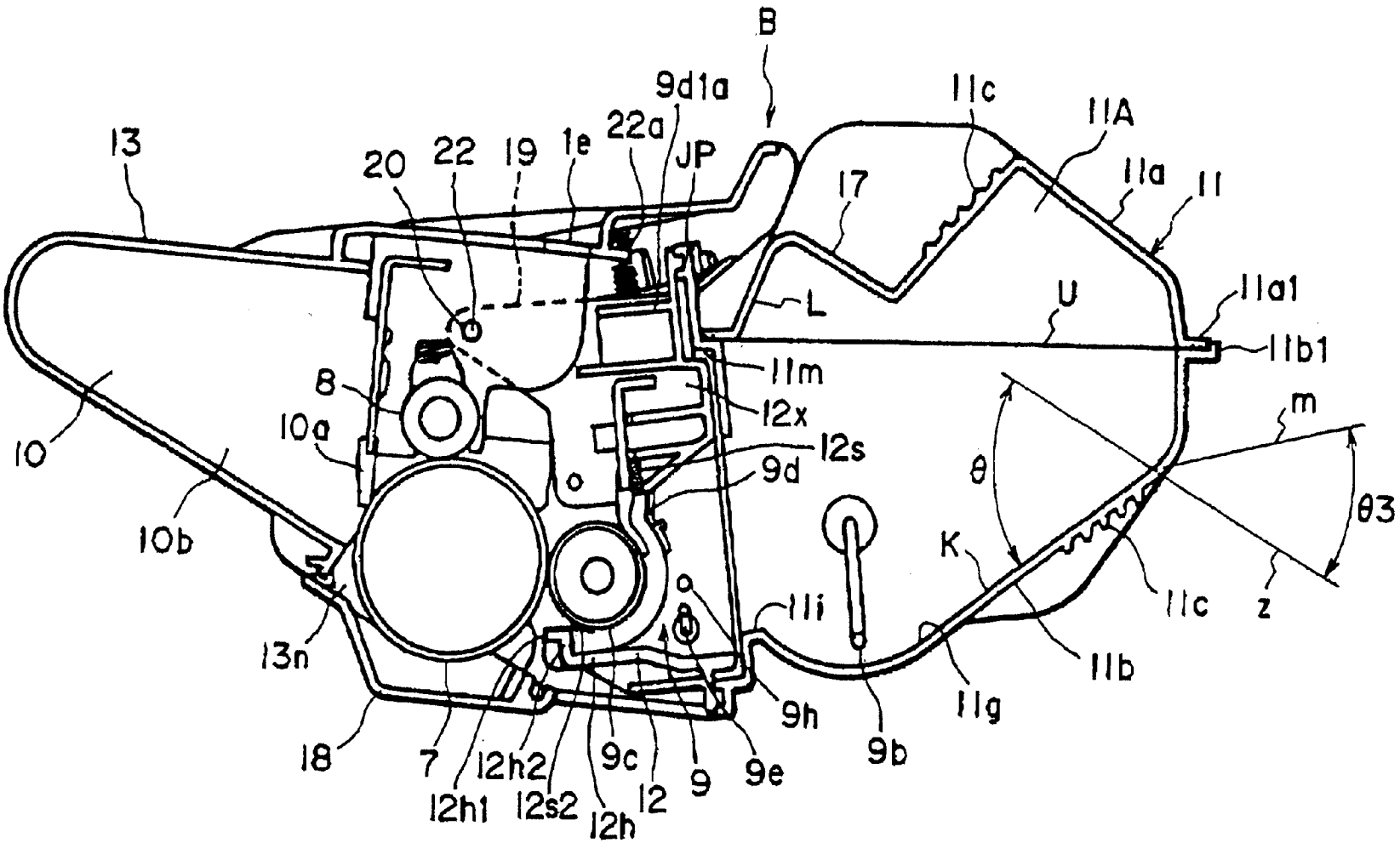
FIG. 2 is a vertical sectional view of a process cartridge.
Figure 3:
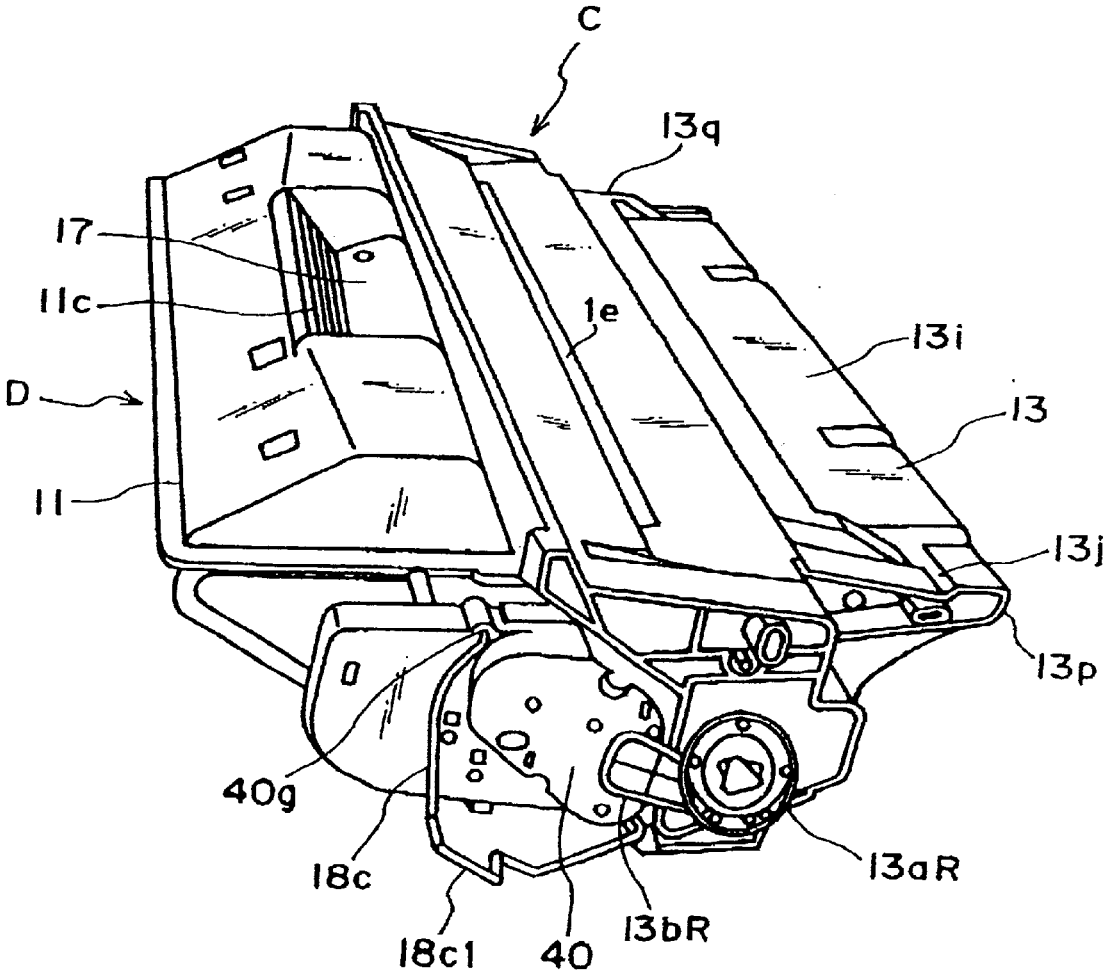
FIG. 3 is an external perspective view of the process cartridge in FIG. 2, as seen from diagonally above the lengthwise right end thereof.
Figure 4:
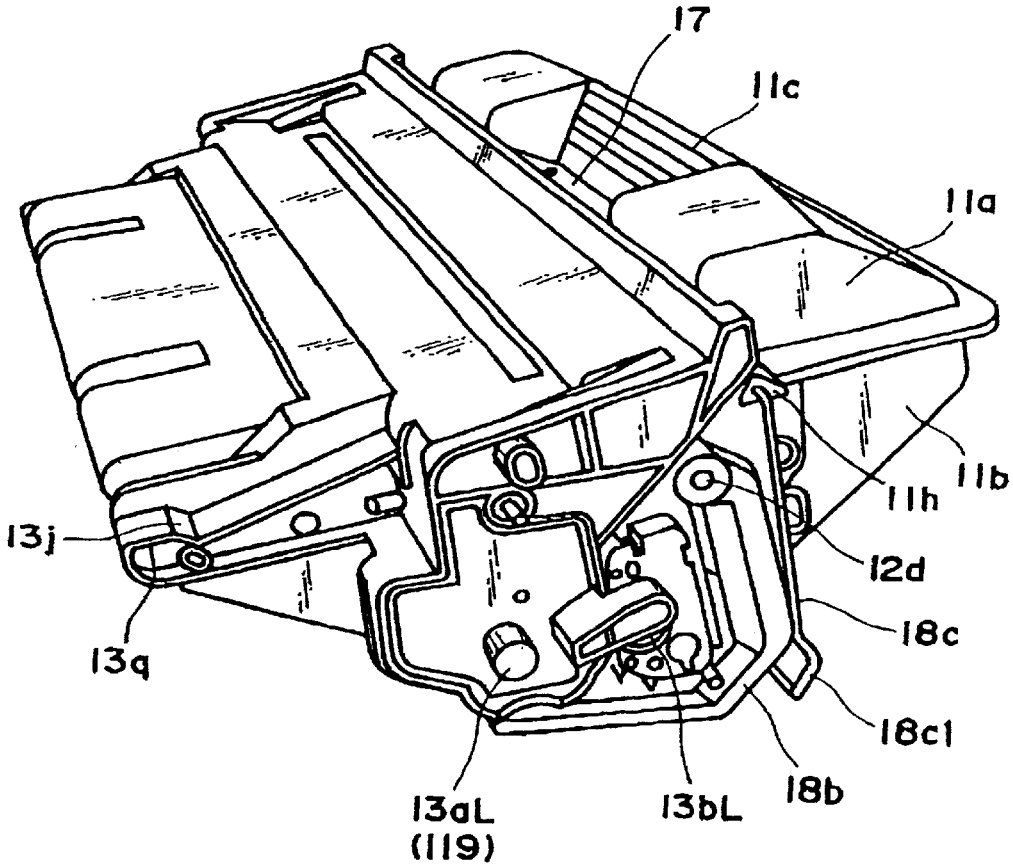
FIG. 4 is an external perspective view of the process cartridge in FIG. 2, as seen from diagonally above the lengthwise left end thereof.
Figure 5:
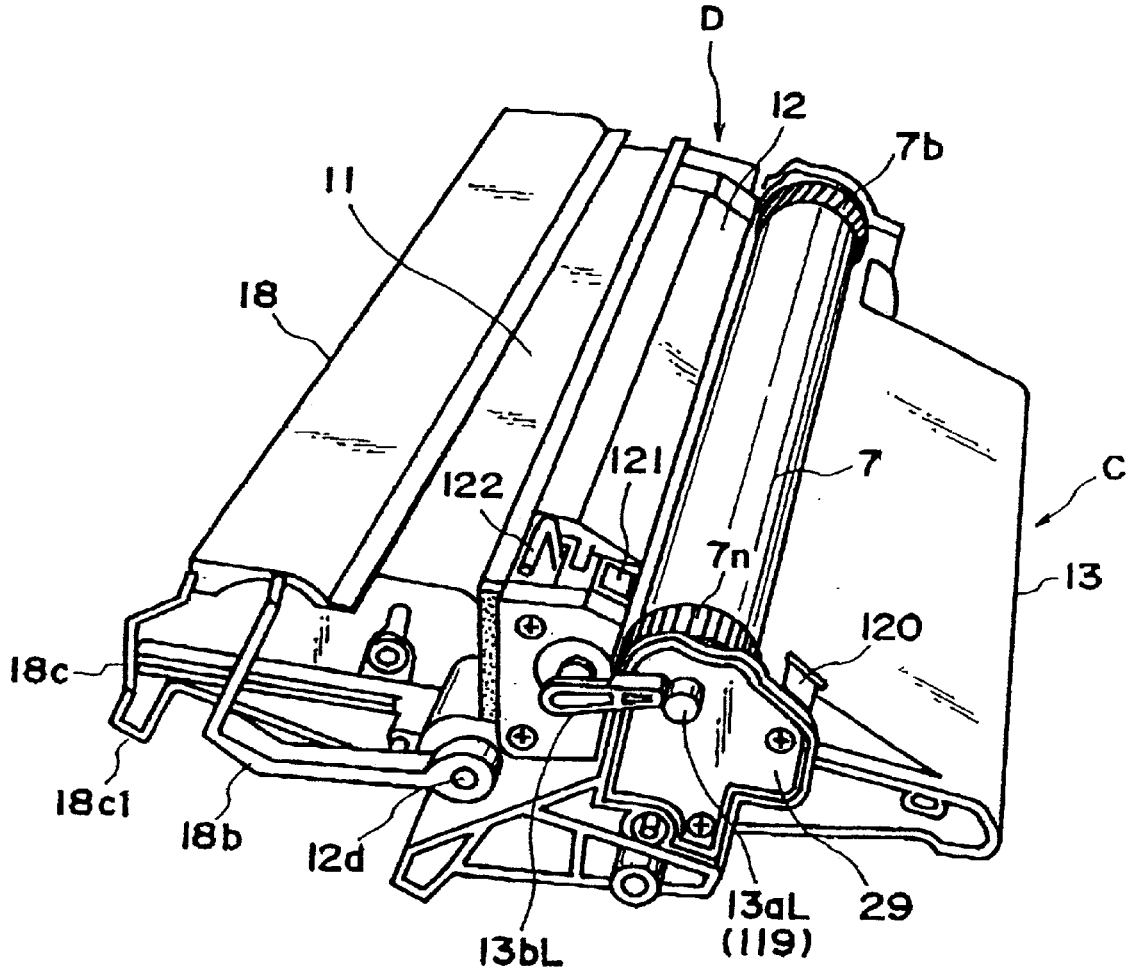
FIG. 5 is an external perspective view of the process cartridge in FIG. 2, as seen from diagonally below the lengthwise left end thereof.

FIG. 1 is a drawing for describing the structure of the electrophotographic image forming apparatus (laser beam printer) in this embodiment of the present invention. FIGS. 2–5 are drawings related to the process cartridge in this embodiment of the present invention. FIG. 2 is a sectional view of the process cartridge, at a plane perpendicular to the lengthwise direction of the process cartridge FIG. 3 is an external perspective view of the process cartridge in FIG. 2, for showing the general appearance thereof. FIG. 4 is a perspective view of the process cartridge in FIG. 2, as seen from diagonally above. FIG. 5 is a perspective view of the inverted process cartridge, as seen from diagonally above. In the following descriptions of the preferred embodiments of the present invention, the top surface of the process cartridge B is the surface which will be positioned at the top of the process cartridge B as the process cartridge B is properly mounted in the apparatus main assembly 14, whereas the bottom surface of the process cartridge B is the surface which will be positioned at the bottom as the process cartridge B is properly mounted in the apparatus main assembly 14.

First, referring to FIG. 1, the laser beam printer A as an electrophotographic image forming apparatus which is compatible with the present invention will be described. This laser beam printer is an apparatus for forming an image on recording medium (for example, recording paper, OHP sheet, fabric, etc.) with the use of an electrophotographic process. An image is formed as follows: First, a toner image, that is, a visible image, is formed on the electrophotographic photoconductive member (which hereinafter will be referred to as a photoconductive drum) in the form of a drum, with the use of developer (which hereinafter will be referred to as toner). More specifically, the photoconductive drum is charged with the use of the charging means. Then, a beam of laser light is projected from an optical means, while being modulated with image formation information, onto the peripheral surface of the charged photoconductive drum. As a result, a latent image in accordance with the image formation information is formed on the peripheral surface of the photoconductive drum. This latent image is developed into a toner image by a developing means. Meanwhile, in synchronism with the formation of this toner image, a recording medium 2 in a sheet feeder cassette 3*a* is conveyed by a pickup roller 3*b*, a pair of conveyer rollers 3*c* and 3*d*, and a pair of registration rollers 3*e*, while being turned over. Then, the toner image formed on the photoconductive drum 7 of the process cartridge B is transferred onto the recording medium 2 by applying electrical voltage to the transfer roller 4 as a transferring means. Then, the recording medium 2, which is bearing the toner image, is guided to the fixing means 5 by the conveyer guide 3*f*. The fixing means 5 comprises a driver roller 5*c*, and a fixing roller 5*b* containing a heater 5*a*. As the recording medium 2 is conveyed through the fixing means 5, the toner image on the recording medium 2 is fixed to the recording medium 2 with the application of heat and pressure. Thereafter, the recording medium 2 is further conveyed through the turnover path 3*j*, and discharged into the delivery tray 6, by a pair of discharge rollers 3*g*, a pair of discharge rollers 3*h*, and a pair of discharge rollers 3*i*. The delivery tray 6 constitutes a part of the top surface of the main assembly 14 of the image forming apparatus A. The pivotable flapper 3*k* may be switched in position in order to discharge the recording medium 2 with the use of a pair of discharge rollers 3*m*, without allowing the recording medium 2 to go through the turnover path 3*j*. In this embodiment, the pair of pickup rollers 3*b*, two pairs of conveyer rollers 3*c* and 3*d*, a pair of registration rollers 3*e*, conveyer guide 3*f*, three pairs of discharge rollers 3*g*, 3*h*, and 3*i*, and a pair of discharge rollers 3*m*, make up the conveying means 3.

Referring to FIGS. 2–5, on the other hand, in the process cartridge B, while the photoconductive drum 7, the peripheral layer 7*e* (FIG. 8) of which is a photoconductive layer, is rotated, the peripheral surface of the photoconductive drum 7 is uniformly charged by the application of electrical voltage to the charge roller 8 as a charging means. Then, a beam of laser light modulated with the image formation information is projected from the optical system 1 onto the photoconductive drum 7 through the exposure opening 1*e*. As a result, a latent image is formed. This latent image is developed by the developing means 9 which uses toner. More specifically, the charge roller 8 is placed in contact with the photoconductive drum 7, and charges the photoconductive drum 7. It is rotated by the rotation of the photoconductive drum 7. The developing means 9 supplies developer to the area of the peripheral surface of the photoconductive drum 7 in the development station, to develop a latent image on the peripheral surface of the photoconductive drum 7. The optical system 1 comprises a laser diode 1*a*, a polygonal mirror 1*b*, a lens 1*c*, and a deflection mirror 1*d*.

In the developing means 9, the toner in the toner container 11A is sent to the rotating development roller 9*c*, by the rotation of the toner sending member 9*b*. The development roller 9*c* contains a stationary magnet. As the development roller 9*c* rotates, the toner is borne on the peripheral surface of the development roller 9*c*, and is made to form a toner layer on the peripheral surface of the development roller 9*c*, by the development blade 9*d*, while being given triboelectric charge by the development blade 9*d*. Then, the toner particles in the toner layer are supplied to the area of the peripheral surface of the photoconductive drum 7 in the development station. In the development station, the toner particles are transferred onto the peripheral surface of the photoconductive drum 7, in a pattern which corresponds to the pattern of the latent image. As a result, a toner image, that is, a visible image, is formed on the peripheral surface of the photoconductive drum 7. The development blade 9*d* is a blade for regulating the amount of the toner on the peripheral surface of the development roller 9*c* while triboelectrically charging the toner. In the adjacencies of the development roller 9*c*, a toner stirring member 9*e* for circulating the toner in the development chamber is rotatably disposed. After the transfer of the toner image on the photoconductive drum 7 onto the recording medium 2 by the application of voltage opposite in polarity to the transfer roller 4, the toner particles remaining of the photoconductive drum 7 are removed by the cleaning means 10. More specifically, the toner particles remaining on the photoconductive drum 7 are scraped down and collected into the removed toner bin 10*b*, by the elastic cleaning blade 10*a* placed in contact with the photoconductive drum 7. The process cartridge B comprises: a toner storage frame 11 having the toner container (toner storage portion) 11A; a developing means holding frame 12 for holding developing means such as the development roller 9*c*; and the cleaning means holding frame 13 to which the photoconductive drum 7, the cleaning means 10 comprising the cleaning blade 10*a*, etc., and the charge roller 8 are attached. Structurally, the toner storage frame 11 and the developing means holding frame 12 are first joined with each other, and then, the cleaning means holding frame 13 is joined with the combination of the toner storage frame 11 and developing means holding frame 12. The process cartridge B is removably mountable in the image forming apparatus main assembly 14 by an operator. The process cartridge B is provided with the exposure opening 1*e* for projecting the beam of light modulated with the image formation information, onto the peripheral surface of the photoconductive drum 7, and a transfer opening 13*n* for enabling the recording medium 2 to be placed in contact with the photoconductive drum 7. Precisely speaking, the exposure opening 1*e* belongs to the cleaning means holding frame 13, and the transfer opening 13*n* is a gap purposely left between the developing means holding frame 12 and cleaning means holding frame 13.

{Structure of Housing of Process Cartridge B}

Next, the structure of the housing of the process cartridge B in this embodiment will be described.

Figure 10:
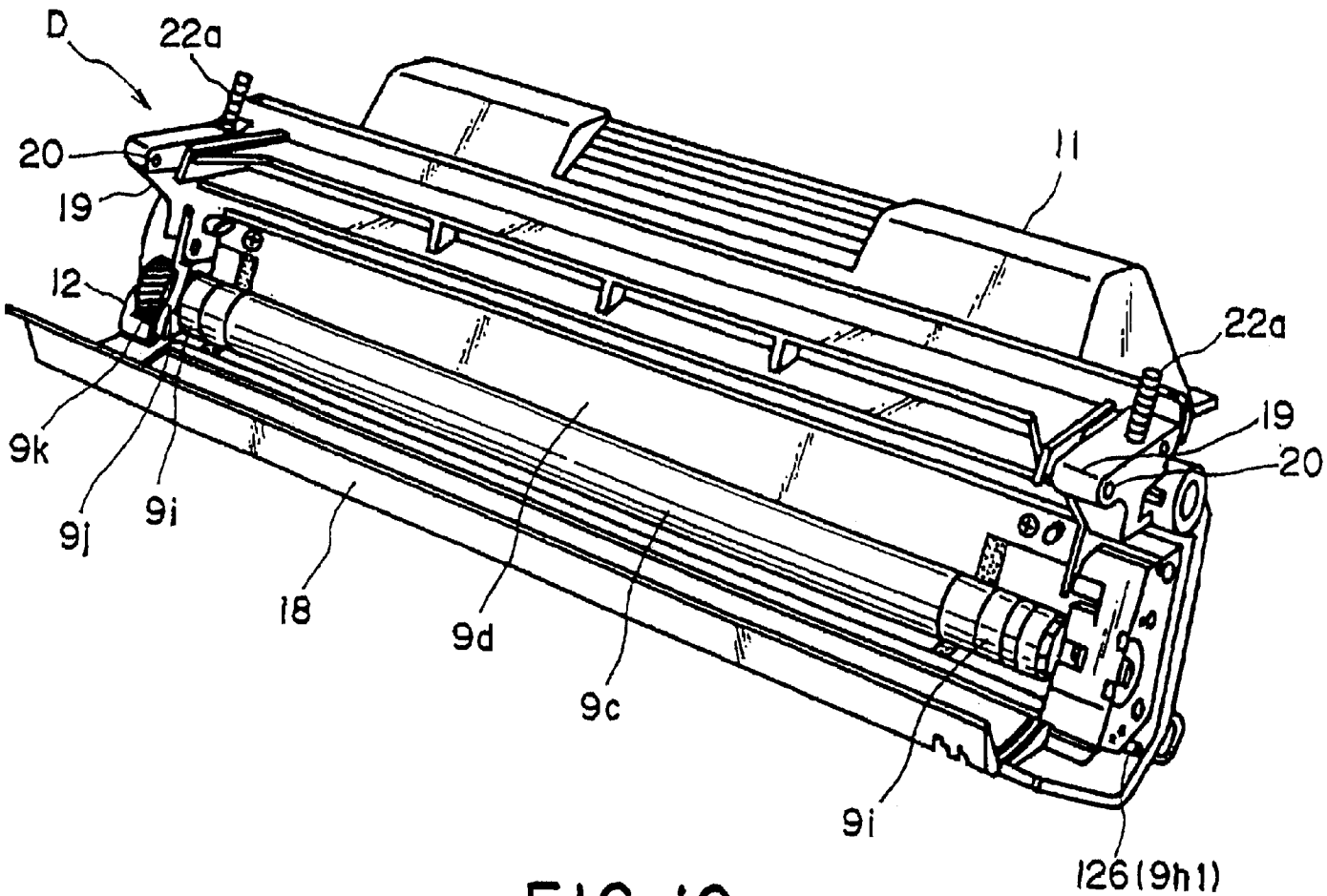
FIG. 10 is a perspective view of the development unit.

The process cartridge B in this embodiment is the combination of the housing, that is, the shell portion, of the process cartridge B, and the set of components, such as the photoconductive drum 7, the charge roller 8, the developing means 9, the cleaning means 10, etc., integrally disposed in the housing. The housing is assembled in the following manner: First, the toner storage frame 11 and developing means holding frame 12 are joined, and then, the cleaning means holding frame 13 is pivotally attached to the combination of the toner storage frame 11 and developing means holding frame 12. The thus assembled process cartridge B is removably mounted in the cartridge mounting means of the image forming apparatus main assembly 14. To describe in detail each of the frames, referring to FIGS. 2 and 16, to the toner storage frame 11, the toner sending member 9*b* is rotationally attached. To the developing means holding frame 12, the development roller 9*c* and development blade 9*d* are attached. Further, the stirring member 9*e* for circulating the toner in the development chamber is attached to the developing means holding frame 12, being disposed close to the development roller 9*c*. Next, referring to FIGS. 2 and 15, to the developing means holding frame 12, a rod antenna 9*h* is attached, being disposed next to the development roller 9*c*, and parallel to the development roller 9*c*. The toner storage frame 11 and developing means holding frame 12 are welded (in this embodiment, ultrasonic welding is used) into a second frame, that is, the frame of the development unit D (FIG. 10). The development unit D is provided with a drum shutter assembly 18 for covering the photoconductive drum 7 to protect the photoconductive drum 7 from such accidents as being exposed to the ambient light for an extended period of time, coming into contact with foreign objects, etc., when the process cartridge B is out of the image forming apparatus main assembly 14. Referring to FIGS. 2 and 4, the drum shutter assembly 18 comprises a shutter, and a pair of linkage members 18*b* and 18*c* for supporting the shutter. Referring to FIG. 3, the linkage member 18*c* is a piece of metallic rod put through the downstream end of the developing means holder 40, in terms of the direction in which the recording medium 2 is conveyed. The right end of the linkage member 18*c* extends from a hole 40*g* of the developing means holder 40 and is fitted in the hole of the shutter located in the upstream end portion, in terms of the direction in which the process cartridge B is mounted, as shown in FIG. 3, whereas the left end of the linkage member 18*c* is extended from a hole 11*h* of the bottom portion 11*b* of the toner storage frame 11, and is fitted in the hole of the shutter located in the upstream end portion, as shown in FIG. 4. The linkage member 18*b* is located at the left end of the shutter. One end of the linkage member 18*b* is fitted in a hole located in the downstream end portion of the shutter, in terms of the recording medium 2 conveyance direction, whereas the other end is fitted around the joggle 12*d* of the developing means holding frame 12. The material of which the linkage member 18*b* is composed is synthetic resin. The linkage members 18*b* and 18*c* are different in length. The shutter, two linking members 18*b* and 18*c*, and the integrated combination of the toner storage frame 11 and developing means holding frame 12 together make up a four-joint linkage. Each of the two end portions of the linking member 18*c* extending from the lengthwise ends of the development unit D, one for one, is provided with a U-shaped portion 18*c*1, which projects outward in the lengthwise direction of the development unit D. Thus, as the process cartridge B is inserted into the cartridge mounting space S of the image forming apparatus main assembly 14, the U-shaped portion 18*c*1 comes into contact with a solid projection (unshown) located in the adjacencies of the cartridge mounting space S, and puts the drum shutter assembly 18 into motion, opening therefore the shutter. The shutter assembly 18 is kept under the pressure generated in the direction to cause the shutter to cover the transfer opening 13*n*, by an unshown torsion coil spring, which is fitted around the joggle 12*d*. One end of the torsion coil spring is anchored to the linking member 18*b* and the other is anchored to the developing means holding frame 12.

Figure 9:
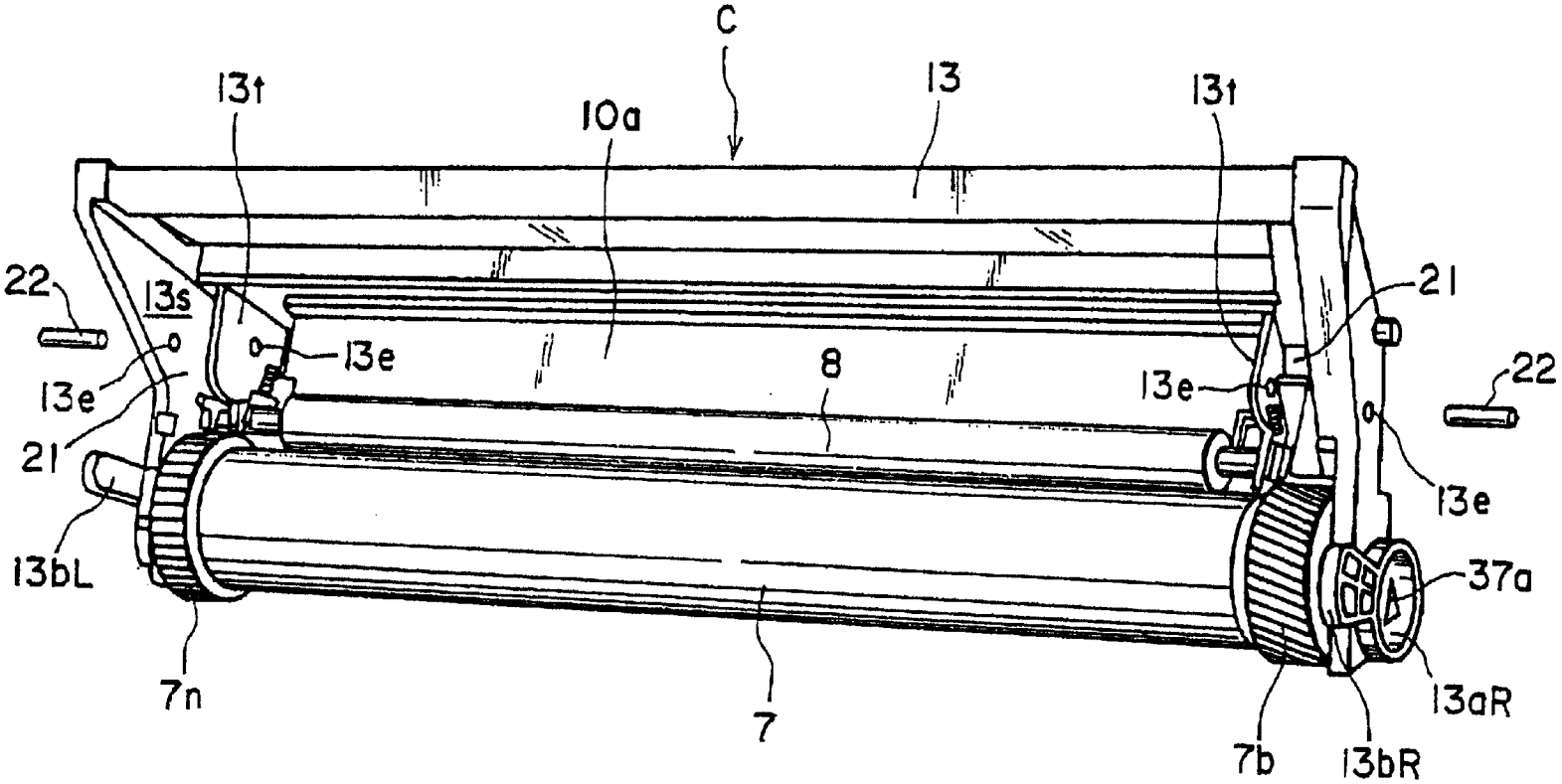
FIG. 9 is a perspective view of the cleaning unit.

Referring to FIGS. 2 and 9, to the cleaning means holding frame 13, the photoconductive drum 7, the charge roller 8, and the cleaning means 10 are attached. The cleaning means holding frame 13, the photoconductive drum 7, the charge roller 8, and the cleaning means 10 together make up the cleaning unit C or the first unit (FIG. 9).

The development unit D and cleaning unit C are joined with the use of a pair of round connective pins 22, being enabled to pivot about the pins 22; and the process cartridge B is completed thereby. More specifically, referring to FIG. 10, the developing means holding frame 12 is provided with a pair of arm portions 19, which are located at the lengthwise (axial direction of development roller 9*c*) ends of the developing means holding frame 12, one for one. The end portion of each arm portion 19 is provided with a round hole, the axial line of which is parallel to the axial line of the development roller 9*c*. On the other hand, the cleaning means holding frame 13 is provided with a pair of recesses 21, which are located in the lengthwise end portions, and in which the arm portions 19 are fitted, one for one, (FIG. 9). Thus, the development unit D and cleaning unit C are connected in the following manner: First, the arm portions 19 are inserted into the recesses 21. Then, the connective members 22 are pressed through the holes 13*e* of the outward wall of the cleaning means holding frame 13, put through the holes 20 of the arm portions 19, and pressed into the hole 13*e* of the inward wall of the cleaning means holding frame 13, one for one. As a result, the development unit D and cleaning unit C are connected, being enabled to pivot about the connective members 22. During the joining of the development unit D and cleaning unit C, a pair of compression coil springs 22*a* fitted around a pair of unshown joggles projecting from the base portions of the arm portions 19, are compressed as they come into contact with the top wall of the recesses 21 of the cleaning means holding frame 13. As a result, the developing means holding frame 12 is kept pressed downward by the resiliency of the compression coil springs 22*a*, assuring that the development roller 9*c* is kept pressed upon the peripheral surface of the photoconductive drum 7. More specifically, referring to FIG. 10, the lengthwise end portions of the development roller 9*c* are fitted with a pair of spacer rings 9*i*, one for one, the diameters of which are greater than that of the development roller 9*c*. Therefore, the spacer rings 9*i* are pressed upon the photoconductive drum 7, assuring that a predetermined distance (approximately 300 $\mu$m) is maintained between the peripheral surfaces of the photoconductive drum 7 and development roller 9*c*. In other words, the development unit D and cleaning unit C are enabled to pivot about the connective members 22, and the resiliency of the compression coil springs 22*a* keeps constant the positional relationship between the peripheral surfaces of the photoconductive drum 7 and development roller 9*c*.

{Structure of Means for Guiding Process Cartridge B}

Figure 6:
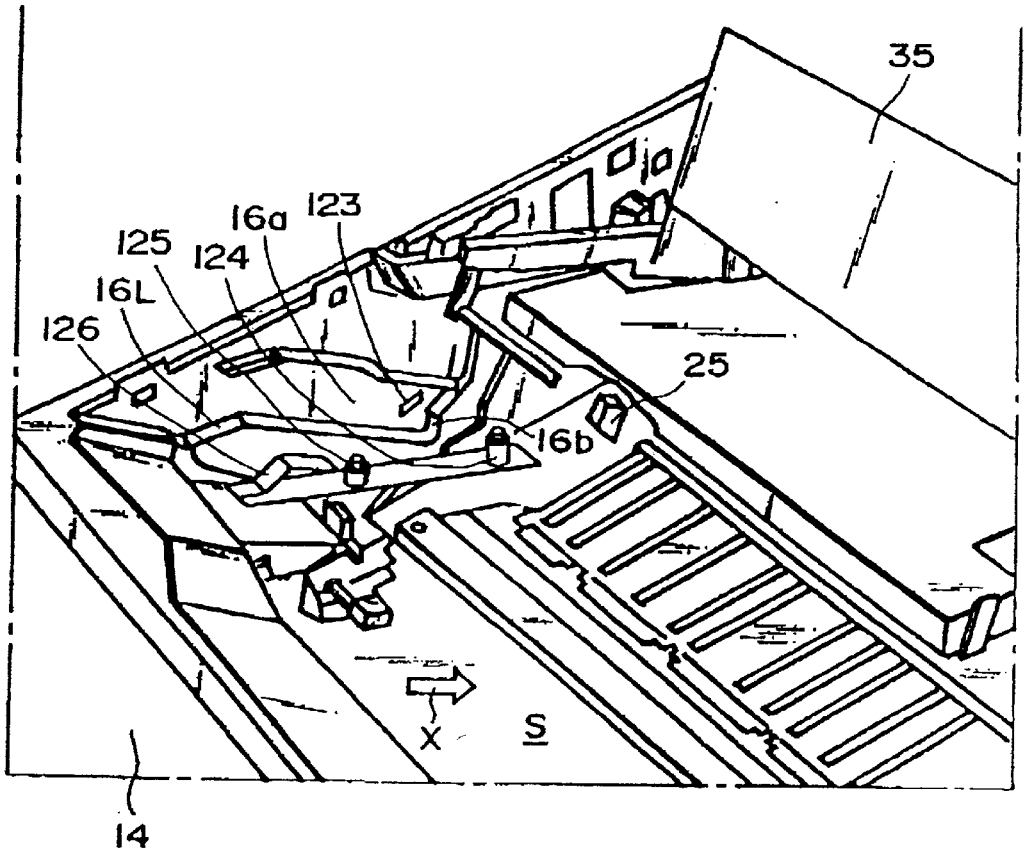
FIG. 6 is an external perspective view of the process cartridge mounting portion of the main assembly of the image forming apparatus in FIG. 1.
Figure 7:
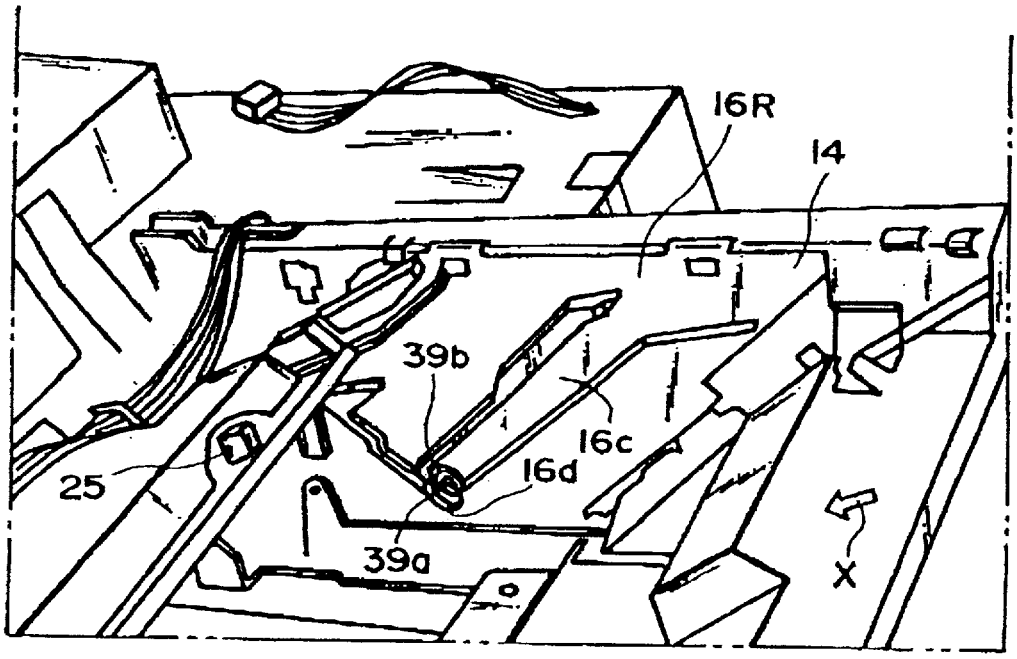
FIG. 7 is another external perspective view of the process cartridge mounting portion of the main assembly of the image forming apparatus in FIG. 1.

Next, the means for guiding the process cartridge B when mounting the process cartridge B into the apparatus main assembly 14 or dismounting the process cartridge B from the apparatus main assembly 14 will be described. The guiding means are shown in FIGS. 6 and 7. FIGS. 6 and 7 are perspective views of the left and right walls, respectively, of the process cartridge mounting space S, as seen from the direction (arrow mark X) in which the process cartridge B is mounted (as seen from the development unit D side).

Referring to FIGS. 3 and 4, the internal surface of each of the end walls of the cleaning means holding frame 13, in terms of the lengthwise direction of the process cartridge B, is provided with a guiding means for guiding the process cartridge B when the process cartridge B is mounted into, or removed from, the apparatus main assembly 14. The right and left guiding means respectively comprise: cylindrical guides 13*a*R and 13*a*L as guiding means for positioning the process cartridge B; and rotation control guides 13*b*R and 13*b*L for controlling the attitude of the process cartridge B during the mounting or dismounting of the process cartridge B. The cylindrical guide 13*a*R is a hollow member, and the rotation control 13*b*R is an integral part of the cylindrical guide 13*a*R, and extends from the circumference of the cylindrical guide 13*a*R approximately in the radius direction of the cylindrical guide 13*a*R. The cylindrical guide 13*a*R, and the rotation control guide 13*b*R integral with the cylindrical guide 13*a*R, are securely fixed to the cleaning means holding frame 13 with the use of screws. The axial line of the cylindrical guide 13*a*L coincides with that of the unshown drum shaft for rotationally supporting the photoconductive drum 7, and the cylindrical guide 13*a*L and unshown drum shaft are formed of a metallic substance such as steel. They are integrally formed, or integrated after their formation. The cleaning means holding frame 13 is also provided with a rotational control guide 13*b*L, which is located a short distance apart from the cylindrical guide 13*a*L. The rotational control guide 13*b*L is an elongated member, which extends approximately in the radius direction of the cylindrical guide 13*a*L and is perpendicular to the end wall of cleaning means holding frame 13. It is an integrally formed part of the cleaning means holding frame 13. In other words, the left guide member comprises two discrete components: the cylindrical guide 13*a*L formed of a metallic substance, and the rotation control guide 13*b*L formed of a synthetic resin.

Next, an attitude regulating contact area 13*j*, which is a part of the top surface 13*i* of the cleaning unit C, will be described. Here, the top surface of the process cartridge B is the surface which will be at the top of the process cartridge B after the proper mounting of the process cartridge B in the image forming apparatus main assembly 14. Referring to FIGS. 3 and 4, in this embodiment, the top surface of the process cartridge B is provided with a pair of attitude regulating contact areas 13*j*, which are parts of the top surface 13*i* of the cleaning unit C, and are at the right and left ends 13*p* and 13*q*, one for one, of the cleaning unit C in terms of the direction perpendicular to the process cartridge mounting direction. The attitude regulating contact area 13*j* is an area which regulates the attitude of the process cartridge B by coming into contact with the process cartridge B when the process cartridge B is mounted into the image forming apparatus main assembly 14. In other words, as the process cartridge B is inserted into the image forming apparatus main assembly 14, the attitude regulating contact area 13*j* comes into contact with the solid projection 25 (FIGS. 6 and 7) of the image forming apparatus main assembly 14, fixing the attitude of the process cartridge B with respect to the rotational range of the process cartridge B about the cylindrical guides 13*a*R and 13*a*L.

Next, the process cartridge guiding means of the image forming apparatus main assembly 14 will be described. As a lid 35 of the image forming apparatus main assembly 14 is rotated about a hinge 35*a* in the counterclockwise direction in FIG. 1, the interior of the top portion, that is, the process cartridge mounting space S, of the image forming apparatus main assembly 14 is exposed as shown in FIGS. 6 and 7. The internal surfaces of the left and right walls of the process cartridge mounting space, as seen from the trailing end in terms of the process cartridge mounting direction, are provided with guiding members 16L and 16R, respectively, as shown in FIGS. 6 and 7. As is evident from the drawings, the guiding members 16L and 16R respectively comprise: guiding portions 16*a* and 16*c* which are tilted downward as seen from the trailing side in terms of the process cartridge insertion direction indicated by an arrow mark X; semicylindrical positioning grooves 16*b* and 16*d* which are directly connected to the guiding portions 16*a* and 16*c*, and into which the cylindrical guides 13*a*L and 13*a*R of the process cartridge B exactly fit. After the proper mounting of the process cartridge B into the image forming apparatus main assembly 14, the axial lines of the positioning grooves 16*b* and 16*d* coincide with those of the cylindrical guides 13*a*L and 13*a*R of the process cartridge B, and hence, the axial line of the photoconductive drum 7. The widths of the guiding portions 16*a* and 16*c* are sufficient for the cylindrical guides 13*a*L and 13*a*R to loosely fit into the guiding portions 16*a* and 16*c*. Therefore, naturally, the rotation control guides 13*b*L and 13*b*R, the widths of which are less than the diameters of the cylindrical guides 13*a*L and 13*a*R loosely fit into the guiding portions 16*a* and 16*c*, respectively. However, the rotation of the cylindrical guides 13*a*L and 13*a*R, and the rotation of the rotation control guides 13*b*L and 13*b*R, are regulated by the guiding portions 16*a* and 16*c*. Therefore, while the process cartridge B is mounted into the image forming apparatus main assembly 14, the attitude of the process cartridge B is kept within a predetermined range. After the mounting of the process cartridge B into the image forming apparatus main assembly 14, the cylindrical guides 13*a*L and 13*a*R of the process cartridge B remain exactly fitted in the positioning grooves 16*b* and 16*d*, and the left and right attitude regulating contact areas 13*j* located at the forward end of the cleaning means holding frame 13 of the process cartridge B remain in contact with the solid projection 25 of the apparatus main assembly 14. The weight of the process cartridge B is distributed so that as the process cartridge B is horizontally and rotationally supported by the cylindrical guides 13*a*L and 13*a*R, the primary moment of the development unit D side becomes greater about the line connecting the centers of the cylindrical guides 13*a*L and 13*a*R than the primary moment of the cleaning unit C side.

The process cartridge B is to be mounted into the image forming apparatus main assembly 14 in the following manner: First, the process cartridge B is to be grasped by one hand, by the recess 17 and ribs 11*c* located on the top and bottom sides, respectively, of the toner storage frame 11. Then, the process cartridge B is to be inserted so that cylindrical guides 13*a*L and 13*a*R are fitted into guiding portions 16*a* and 16*c*, respectively, of the cartridge mounting portion of the image forming apparatus main assembly 14. Then, the process cartridge B is to be tilted, with the forward end of the process cartridge B, in terms of the process cartridge B inserting direction, positioned lower than the rearward end, so that the rotation control guides 13*b*L and 13*b*R enter the guiding portions 16*a* and 16*c* of the image forming apparatus main assembly 14. Then, the process cartridge B is further inserted, with the cylindrical guides 13*a*L and 13*a*R, and the rotational control guides 13*b*L and 13*b*R, being guided by the guiding portions 16*a* and 16*c* of the image forming apparatus main assembly 14, until the cylindrical guides 13*a*L and 13*a*R reach the positioning grooves 16*b* and 16*d* of the image forming apparatus main assembly 14. As the cylindrical guides 13*a*L and 13*a*R reach the positioning grooves 16*b* and 16*d*, they settle into the positioning grooves 16*b* and 16*d* due to the weight of the process cartridge B. As a result, the positions of the cylindrical guides 13*a*L and 13*a*R of the process cartridge B are accurately fixed relative to the positioning grooves 16*b* and 16*d*. Therefore, the position of the photoconductive drum 7 relative to the image forming apparatus main assembly 14 becomes approximately fixed, because the line connecting the centers of the cylindrical guides 13*a*L and 13*a*R coincides with the axial line of the photoconductive drum 7. However, the ultimate positional relationship between the photoconductive drum 7 and apparatus main assembly 14 is not realized until the driving force receiving portion of the process cartridge B couples with the driving force transmitting portion of the image forming apparatus main assembly 14. In other words, immediately after the settling of the cylindrical portions 13*a*L and 13*a*R into the positioning grooves 16*b* and 16*d*, there still remains a small gap between the solid projections 25 of the image forming apparatus main assembly 14 and the attitude regulating contact areas 13*j* of the process cartridge B. At this point, the operator is to release the process cartridge B from his/her hand. As the process cartridge B is released, the process cartridge B rotates about the cylindrical guides 13*a*L and 13*a*R so that the development unit D side goes down (cleaning unit C side goes up). As a result, the attitude regulating contact areas 13*j* come into contact with the solid projections 25 of the image forming apparatus main assembly 14, accurately positioning the process cartridge B relative to the image forming apparatus main assembly 14. Thereafter, the lid 35 is to be closed by rotating it about the hinge 35*a* in the clockwise direction of FIG. 1.

The process for removing the process cartridge B from the apparatus main assembly 14 is opposite to the above described process for mounting the process cartridge B into the apparatus main assembly 14, and is as follows: First, the lid 35 of the apparatus main assembly 14 is to be opened, and the process cartridge B is to be pulled upward by the operator, by the rearward end of the process cartridge B, in terms of the process cartridge B inserting direction, with the hand of the operator placed on the aforementioned ribs 11*c* located on the top and bottom sides, respectively, of the toner storage frame 11. As the process cartridge B is pulled upward by the rearward end of the process cartridge B, the process cartridge B rotates about the axial lines of the cylindrical guides 13*a*L and 13*a*R in the positioning grooves 16*b* and 16*c* of the apparatus main assembly 14. As a result, the attitude regulating contact areas 13*j* of the process cartridge B is moved away from the solid projections 25 of the apparatus main assembly 14. Then, the process cartridge B is to be pulled outward. As the process cartridge B is pulled, the cylindrical guides 13*a*L and 13*a*R come out of the positioning grooves 16*b* and 16*d*, moving onto the guiding portions 16*a* and 16*c* of the guiding members 16L and 16R, respectively, of the apparatus main assembly 14. Then, the process cartridge B is to be pulled further. As the process cartridge B is pulled further, the process cartridge B moves outward, with the cylindrical guides 13*a*L and 13*a*R, and rotation control guides 13*b*L and 13*b*R, of the process cartridge B remaining fitted in the guiding portions 16*a* and 16*c*. As a result, the process cartridge B comes out of the apparatus main assembly 14 while being controlled in attitude, and therefore, being prevented from colliding with the portions of the apparatus main assembly 14 other than the guiding portions.

{Toner Storage Frame}

Figure 16:
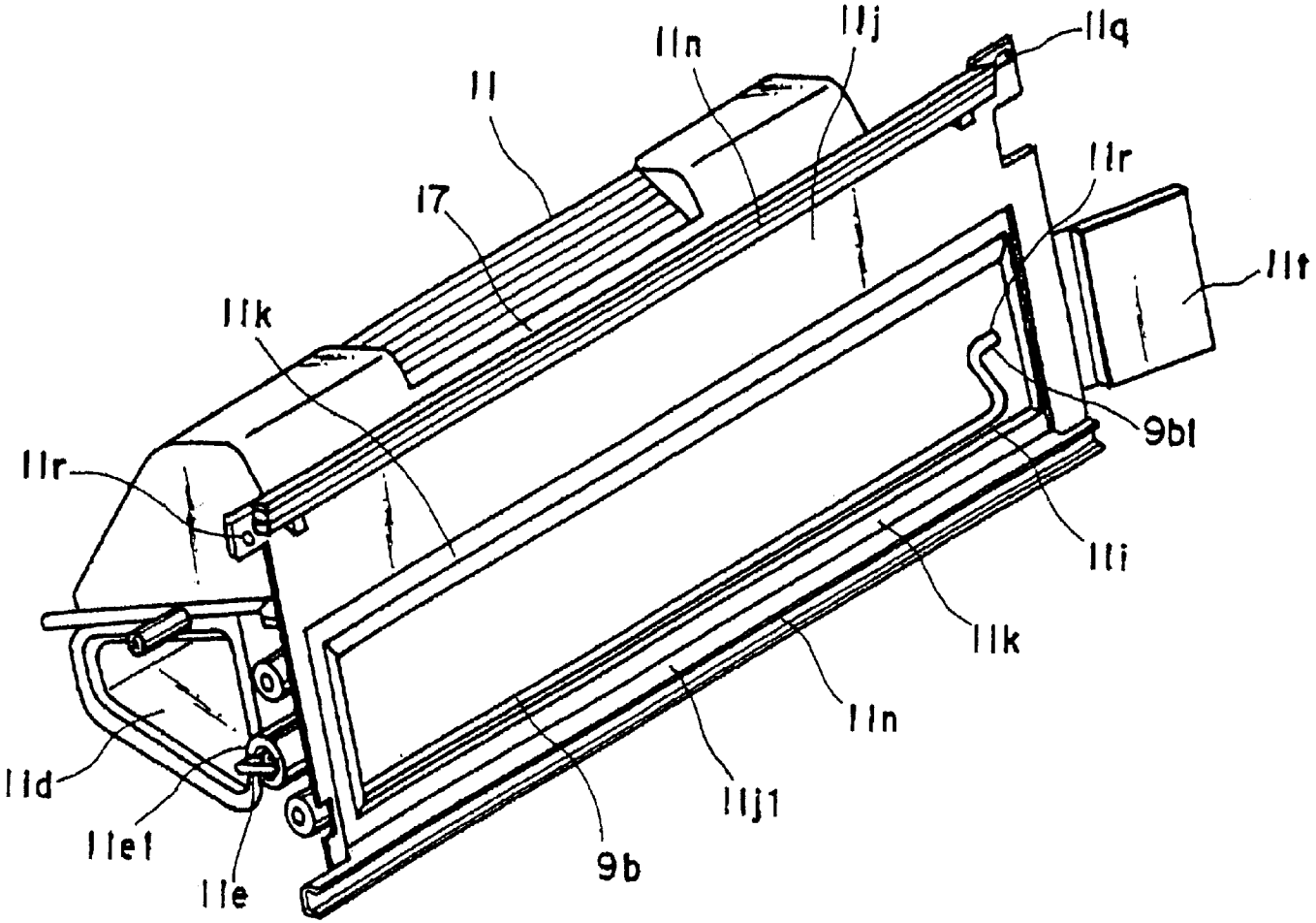
FIG. 16 is a perspective view of the toner storage frame.
Figure 17:
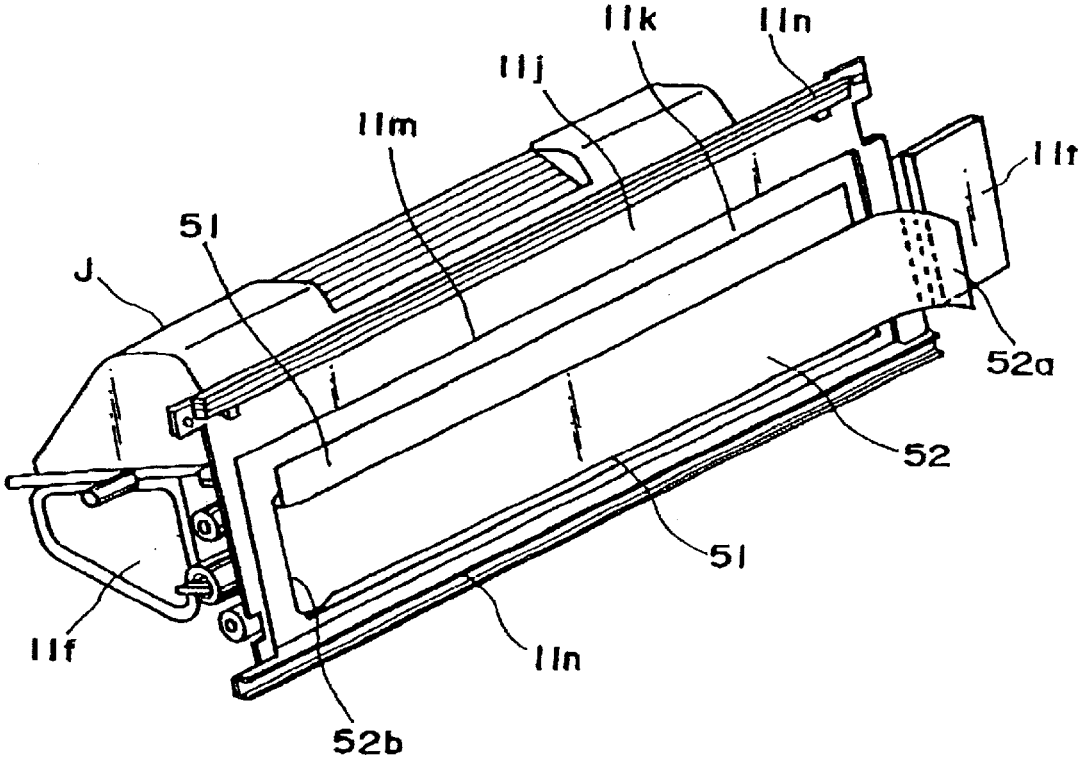
FIG. 17 is another perspective view of the toner storage frame.

Referring to FIGS. 2, 4, 13, 16, and 17, the toner storage frame will be described in detail. FIG. 16 is a perspective view of the toner storage frame 11 before the welding of the toner seal, and FIG. 17 is a perspective view of the toner storage frame 11 after the welding of the toner seal. Referring to FIG. 2, the toner storage frame 11 comprises two essential components: the top frame 11*a* and bottom frame 11*b*. The two frames 11*a* and 11*b* are integrated by ultrasonic welding. More specifically, the bottom surface (welding surface U) of the flange 11*a*1 of the top frame 11*a* is placed in contact with the top surface (welding surface U) of the rimmed flange 11*b*1 of the bottom frame 11*b*, and the welding ribs are melted by ultrasonic waves. In order to securely hold the frames 11*a* and 11*b* when ultrasonically welding two frames 11*a* and 11*b* to each other, the toner storage frame 11 is provided with a stepped portion 11*m*, in addition to the aforementioned rimmed flange 11*b*1. The stepped portion is above the opening 11*i*, and the top surface of the "riser-portion" of the stepped portion 11*m* is rendered virtually level with the top surface of the flange 11*b*1. Prior to the joining of the two frames 11*a* and 11*b*, the toner sending member 9*b* is disposed in the bottom frame 11*b*. Further, referring to FIG. 13, a coupling member 11*e* is partially put through the hole 11*e*1 of the side wall (one of lengthwise end walls) of the toner storage frame 11 from outside so that the coupling member 11*e* engages with the end portion of the toner sending member 9*b*. The side wall with the hole 11*e*1 is also provided with a toner filling hole 11*d*, which is approximately in the form of an equilateral triangle and is used for filling toner into the toner storage frame 11. Referring to FIG. 16, the toner storage frame 11 is provided with the rectangular opening 11*i* through which toner is sent from the toner storage frame 11 to the developing means holding frame 12. The lengthwise direction of the rectangular opening 11*i* coincides with the lengthwise direction of the toner storage frame 11. A seal (which will be described later) is welded to the toner storage frame 11 to close the opening 11*i*. Then, toner is filled into the toner storage frame 11 through the toner filling opening 11*d*. Thereafter, the toner filling opening 11*d* is plugged with a toner cap 11*f*, as shown in FIG. 17, to complete the toner unit J, which is ultrasonically welded to the developing means holding frame 12 to make the development unit D, which will be described later.

Referring again to FIG. 2, the angle of the slanted surface K of the bottom frame 11*b* of the toner storage frame 11 is desired to be steep enough for the toner to naturally slide down on the surface K in response to toner consumption; in other words, the angle θ of the slanted surface K relative to the horizontal line Z is desired to be approximately 65°. Further, regarding the bottom wall of the bottom frame 11*b* of the toner storage frame 11, a recess 11*g* is provided next to the bottom end of the slanted surface K; the portion next to the bottom end of the slanted surface K is rendered arcuate to provide the toner sending member 9*b* with the rotational clearance. This is for the following reason. That is, if the position of the portion next to the bottom end of the slanted surface K is higher than that of slanted surface K, all the toner which slides down on the slanted surface K due to the toner consumption cannot reach the rotational range of the toner sending member 9*b*; in other words, a certain portion of the toner fails to reach the rotational range of the toner sending member 9*b*, and therefore, fails to be sent to the developing means holding frame 12, remaining in the adjacencies of the bottom end of the slanted surface K. Thus, in this embodiment, the above described recess 11*g* is provided to assure that the toner is reliably sent from the toner storage frame 11 to the developing means holding frame 12.

The toner sending member 9*b* is formed of a piece of metallic rod, such as steel rod, which is approximately 2 mm in diameter, and is in the form of a crank. Referring to FIG. 16, one end of the toner sending member 9*b*, that is, one of the journal portions 9*b*1, is fitted in the hole 11*r*, which is in the internal surface of the lengthwise end wall of the toner storage frame 11 and is located near the opening 11*i* of the toner storage frame 11, whereas the other end of the toner sending member 9*b*, or the other journal portion 9*b*1, is fixed to the coupling member 11*e* (joint cannot be seen in FIG. 16). Providing the bottom wall of the toner storage frame 11 with the recessed portion 11*g* to provide the clearance for the toner sending member 9*b* assures, without a cost increase, that the toner is reliably sent from the toner storage frame 11 to the developing means holding frame 12.

Figure 18:
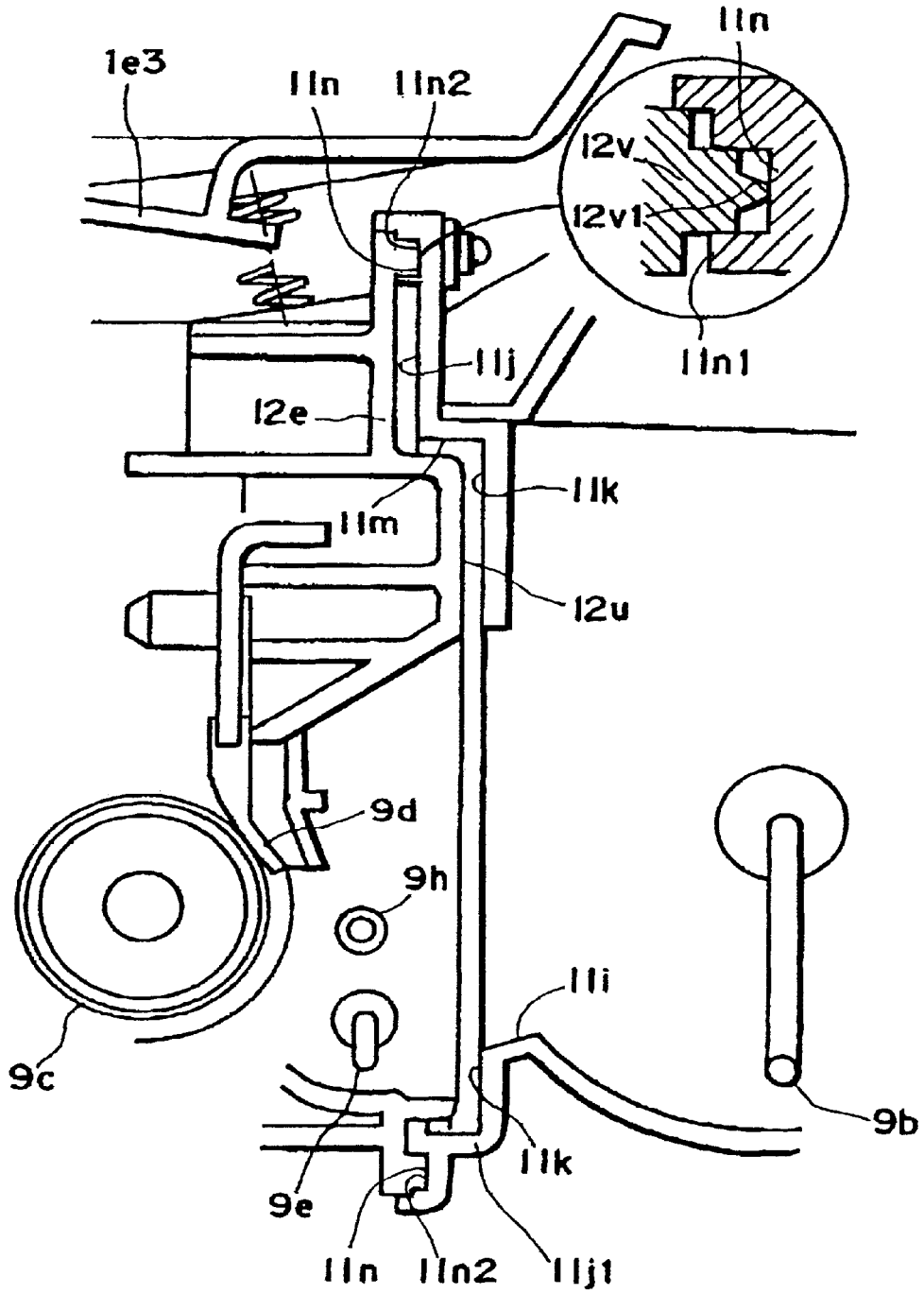
FIG. 18 is a vertical section of the toner seal portion shown in FIG. 17 and its adjacencies.

Referring to FIGS. 2, 16, and 18, the portion of the toner storage frame 11, by which the toner storage frame 11 is joined with the developing means holding frame 12, is provided with the opening 11*i* through which toner is sent from the toner storage frame 11 to the developing means holding frame 12. The opening 11*i* is surrounded by a recessed surface 11*k*, and the recessed surface 11*k* is surrounded by the top and bottom flanges 11*j* and 11*j*1 of the toner storage frame 11. The top edge of the top flange 11*j* is provided with a narrow groove 11*n* extending in the lengthwise direction of the toner storage frame 11, and also, the bottom edge of the bottom flange 11*j*1 is provided with a narrow groove 11*n* also extending in the lengthwise direction of the toner storage frame 11. The top flange 11*j* above the recessed surface 11*k* is in the form of a wide gate with an overhead cross member, whereas the bottom flange 11*j*1 is perpendicular to the recessed surface 11*k*. Referring to FIG. 18, the position of the bottom surface 11*n*2 of the groove 11*n* is on the outward side of the recess surface 11*k* of the toner storage frame 11 (closer to developing means holding frame 12 than recessed surface 11*k*).

Figure 15:
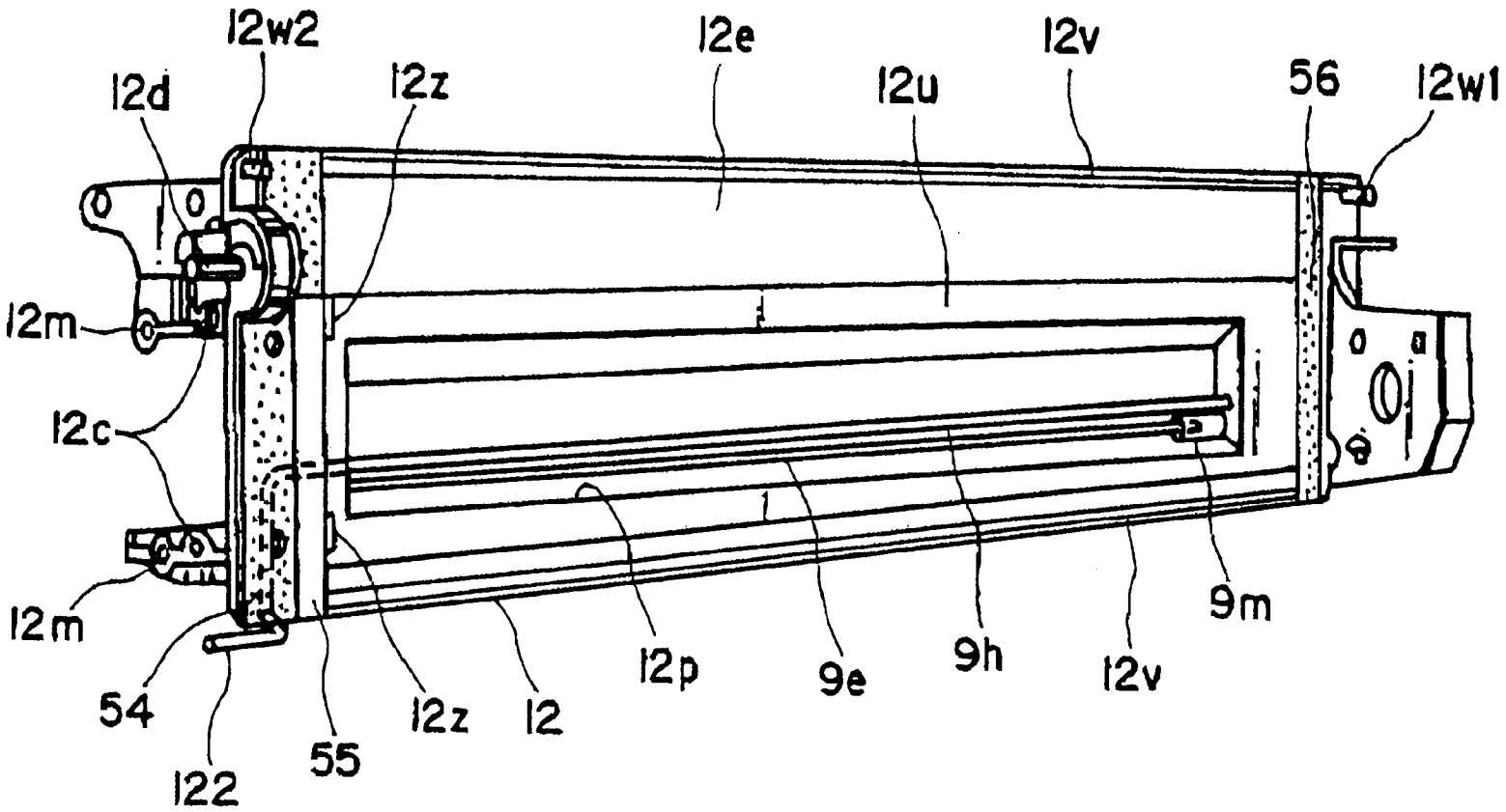
FIG. 15 is a perspective view of the developing means frame.

Referring to FIG. 15, the surface 12*u* of the developing means holding frame 12, which faces the toner storage frame 11, is a single flat surface. The developing means holding frame 12 is provided with a flange 12*e*, which surrounds the flat surface 12*u*, like a picture frame. The flange 12*e* is recessed from the flat surface 12*u* and is parallel to the flat surface 12*u*. The developing means holding frame 12 is provided with a pair of ribs 12*v* which fit into the grooves 11*n* of the toner storage frame 11. The ribs 12*v* are positioned next to the lengthwise edges (top and bottom edges) of the flange 12*e*, and extend parallel to the lengthwise edges of the flange 12*e*. The top surface of each rib 12*v*1 is provided with a triangular rib 12*v*1 for ultrasonic welding (FIG. 18). After the disposal of the various components into the developing means holding frame 12, the toner storage frame 11 and developing means holding frame 12 are put together so that the ribs 12*v* of the developing means holding frame 12 fit into the grooves 11*n* of the toner storage frame 11. Then, the two frames 11 and 12 are ultrasonically welded along their lengthwise edges. Referring to FIG. 17, a cover film 51 easily tearable in the lengthwise direction of the toner storage frame 11 is pasted to the recess surface 11*k* of the toner storage frame 11, covering the opening 11*i* of the toner storage frame 11; the cover film 51 is pasted to the four edges of the opening 11*i*. The cover film 51 has a tear tape 52, which is welded to the cover film 51 to tear the cover film 51 in order to expose the opening 11*i*. The cover film 51 is extended from the edge of one of the lengthwise ends of the opening 11*i* to the opposing edge 52*b*, and there, the tear tape 52 is folded back, and doubled back to the starting edge. Then, the tear tape 52 is further extended, outward of the two frames 11 and 12, between an elastic seal 54 (FIG. 15), such as a piece of felt, pasted to the widthwise edge of the developing means holding frame 12, facing the toner storage frame 11, and the toner storage frame 11. To the end 52*a* of the portion of the tear tape 52 extending outward from between the elastic seal 54 and toner storage frame 11, a handle 11*t* (FIGS. 16 and 17), which can be grasped by hand, is attached. This handle 11*t* is formed as an integral part of the toner storage frame 11, and is enabled to be torn away from the toner storage frame 11. The end 52*a* of the tear tape 52 is pasted to the handle 11*t*. To the inward side of the surface of the elastic tape 54, a piece of tape 55, formed of synthetic resin film smaller in friction coefficient than the elastic tape 54, is pasted. Further, to the flat surface 12*e* located at the opposite end of the toner storage frame 11 in terms of the lengthwise direction of the toner storage frame 11, an elastic seal 56 is pasted (FIG. 15).

The above described elastic seals 54 and 56 are pasted to the lengthwise ends (widthwise edges) of the flange 12*e*, one for one, and they extend across the entire ranges of the widthwise edges. More specifically, the elastic seals 54 and 56 exactly cover the end portions of the top flange 11*j*, that is, the portions of the top flange 11*j* on the outward sides of the recessed surface k, in terms of the lengthwise direction of the toner storage frame 11. Further, the elastic seals 54 and 56 overlap with the ribs 12*v*. In order to make it easier to position the toner storage frame 11 and developing means holding frame 12 relative to each other when joining the two frames 11 and 12, the flange 11*j* of the toner storage frame 11 is provided with a round hole 11*r* and a square hole 11*q*, in which a round joggle 12*w*1 and a square joggle 12*w*2 of the developing means holding frame 12 are fitted.

Prior to the joining of the toner storage frame 11 and developing means holding frame 12, the two frames are separately assembled. Then, the round and square positioning joggles 12*w*1 and 12*w*2 of the developing means holding frame 12 are fitted into the round and square positioning holes 11*r* and 11*q* of the toner storage frame 11 while fitting the ribs 12*v* of the developing means holding frame 12 into the grooves 11*n* of the toner storage frame 11. Then, as the toner storage frame 11 and developing means holding frame 12 are pressed against each other, the seals 54 and 56 come into contact with the lengthwise end portions of the flange 11*j*, and then, are compressed thereby. At the same time, a pair of the ribs 12*z*, as spacers, of the developing means holding frame 12, are placed close to the flange 11*j* of the toner storage frame 11. The pair of ribs 12*z* are located on one of the lengthwise end portions of the flat surface 12*u* of the developing means holding frame 12, and are formed as integral parts of the toner storage frame 11. The pair of ribs 12*z* are positioned outside the path of the tear tape to allow the tear tape to pass between the ribs 12*z*, and extend in the widthwise direction of the toner storage frame 11.

With the toner storage frame 11 and developing means holding frame 12 kept pressed against each other in the above described state, ultrasonic vibrations are applied to the interface between the ribs 12*v* and the bottom surfaces of the grooves 11*n*. As a result, the aforementioned triangular ribs 12*v*1 are welded to the bottom surfaces of the groove 11*n* by the frictional heat, and further, the brims 11*n*1 of the grooves 11*n* of the toner storage frame 11 and the ribs 12*z*, as spacers, of the developing means holding frame 12 are placed in contact with each other, leaving a virtually sealed space between the recessed surface 11*k* of the toner storage frame 11 and the flat surface 12*u* of the developing means holding frame 12. The aforementioned cover film 51 and tear tape 52 fit in this space. In order to send the toner within the toner storage frame 11 into the developing means holding frame 12, the following steps are carried out; First, the handle 11*t* attached to the end portion of the tear tape 52 extending outward from the process cartridge B is to be cut, or torn, off the toner storage frame 11 by an operator, and then, it is to be pulled by the operator. As the handle 11*t* is pulled, the cover film 51 is torn, exposing the opening 11*i* of the toner storage frame 11. As a result, it becomes possible for the toner within the toner storage frame 11 to be sent out from the toner storage frame 11 into the developing means holding frame 12. The elastic seals 54 and 56 located at the lengthwise ends of the flange 11*j* of the toner storage frame 11 remain elastically deformed (compressed flat) only in their thickness direction, remaining therefore in the form of a thin parallelepiped. Therefore, the gap between the toner storage frame 11 and developing means holding frame 12 remains satisfactorily sealed.

The examples of the material for the toner storage frame 11 and developing means holding frame 12 are plastics such as polystyrene, ABS resin (acrylonitril/butadiene/styrene copolymer), polycarbonate, polyethylene, polypropylene, etc.

Referring to FIG. 2 which is a vertical sectional view of the toner storage frame 11. In this embodiment, at a plane perpendicular to the lengthwise direction of the process cartridge B, the process cartridge B is positioned so that the joint plane JP at which the toner storage frame 11 and developing means holding frame 12 are joined becomes approximately vertical.

Next, the toner storage frame 11 in this embodiment will be described in more detail. For the purpose of causing the single-component toner in the toner container 11A to efficiently fall down toward the opening 11*i*, the toner container 11A is provided with two slanted surfaces K and L, which extend from one lengthwise end of the toner container 11A to the other. The slanted surface L is above the opening 11*i*, whereas the slanted surface K is at about the same level as the opening 11*i*, and is located farther inward of the toner container 11A (in terms of the widthwise direction of toner storage frame 11). The slanted surface L is a part of the top frame 11*a*, whereas the slanted surface K is a part of the bottom frame 11*b*. After the process cartridge B is properly mounted in the apparatus main assembly 14, the slanted surface L is approximately vertical or faces downward, whereas the slanted surface K faces upward, and its angle θ3 relative to the line m perpendicular to the plane JP of the joint between the toner storage frame 11 and developing means holding frame 12 is approximately in the range of 20°–40°. In other words, in this embodiment, the shape of the top frame 11*a* is decided so that as the top frame 11*a* is joined with the bottom frame 11*b*, the angle θ3 of the slanted surface K falls within the above range. Therefore, the toner within the toner container 11A in this embodiment is efficiently moved toward the opening 11*i*.

[Developing Means Holding Frame]

Figure 11:
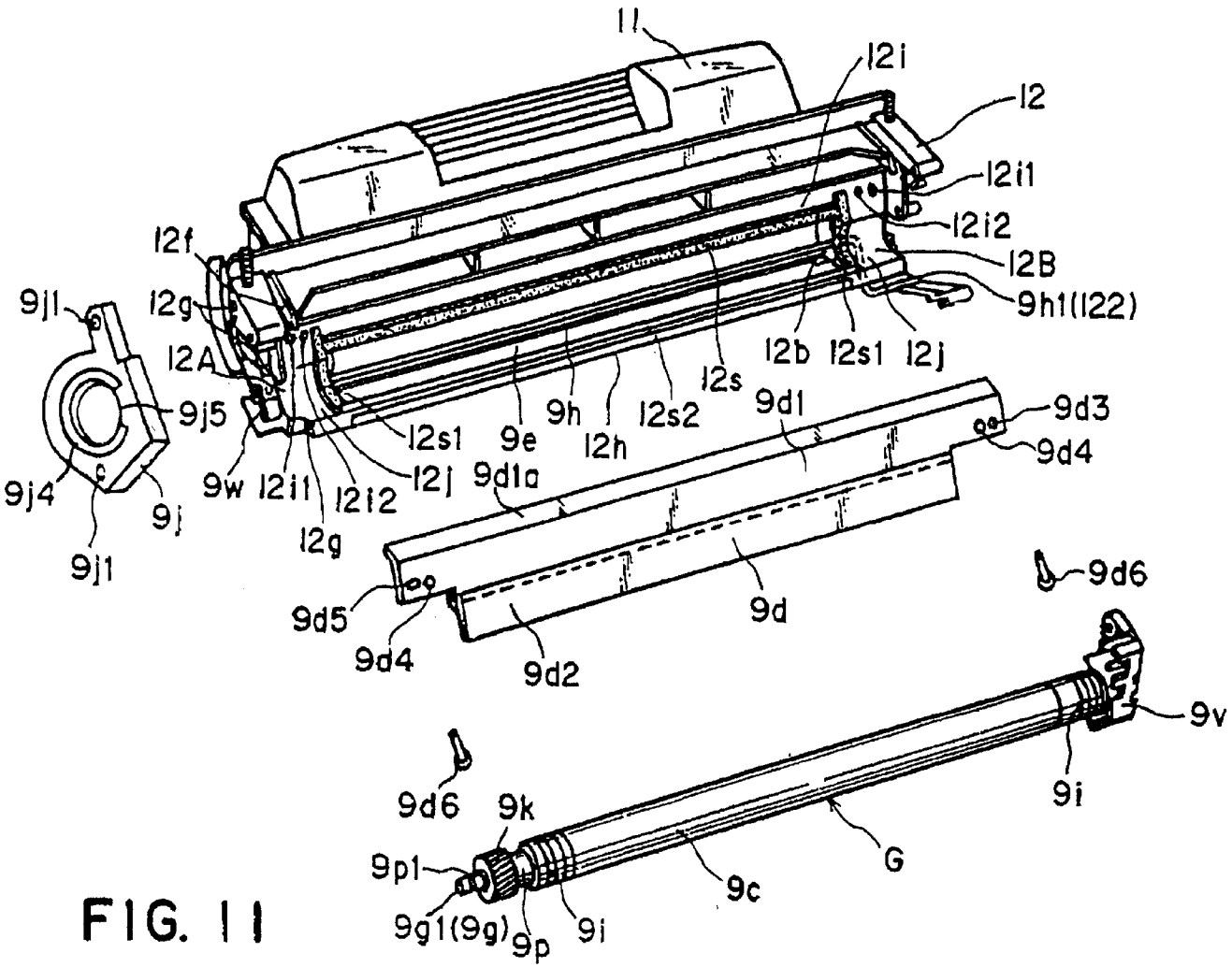
FIG. 11 is a partially broken perspective view of the development unit.
Figure 12:
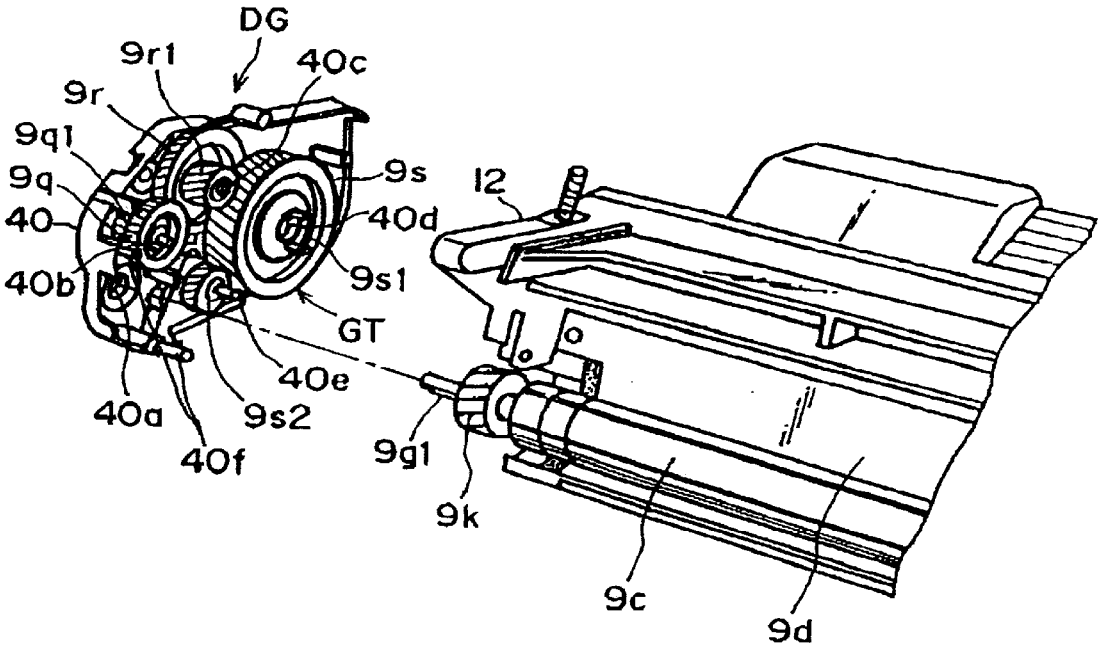
FIG. 12 is a perspective view of the developing means holder, as seen from the rear side thereof.
Figure 13:
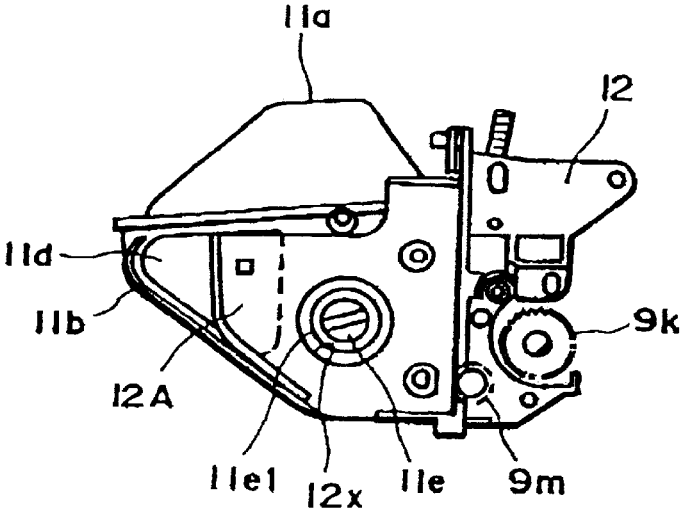
FIG. 13 is a side view of the combination of the side walls of the developing means frame and the toner storage frame.
Figure 14:
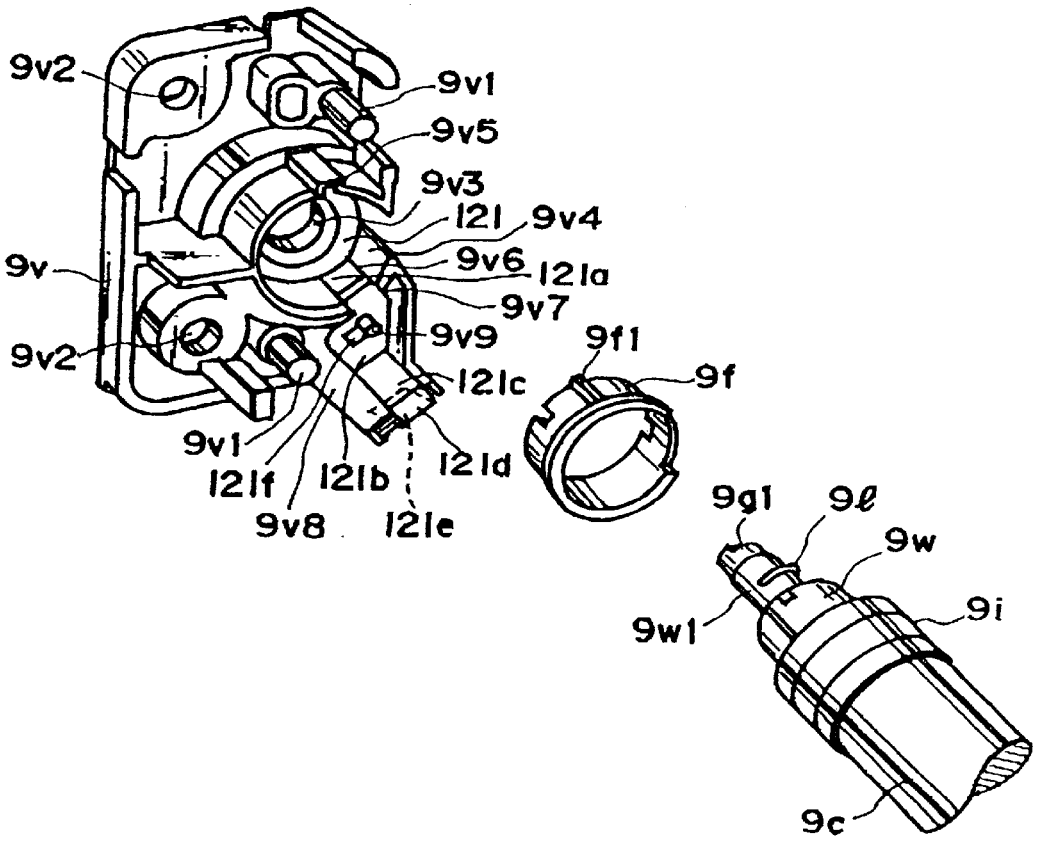
FIG. 14 is a perspective view of the development roller bearing box.

Next, referring to FIGS. 2, 11, 12, 13, and 14, the developing means holding frame 12 will be described in more detail. FIG. 11 is a perspective view of the developing means holding frame 12 and various components of the developing means, prior to the placement of the latter into the former. FIG. 12 is a perspective view of the developing means holding frame 12 and developing means driving force transmission unit DG prior to the attachment of the latter to the former. FIG. 14 is a perspective view of the bearing box, for showing the inward side thereof.

The aforementioned development roller 9*c*, development blade 9*d*, and toner stirring member 9*e*, and also, the rod antenna 9*h* for detecting the amount of the remaining toner, are disposed in the developing means holding frame 12 as described before. Referring to FIG. 11, the development blade 9*d* comprises an approximately 1–2 mm thick metallic plate 9*d*1, and a silicon rubber blade 9*d*2 molded onto the metallic plate 9*d*1. The silicon rubber blade 9*d*2 is placed in contact with the peripheral surface of the development roller 9*c* in a tangential fashion to regulate the amount of the toner on the peripheral surface of the development roller 9*c*. The developing means holding frame 12 is provided with a flat development blade placement surface 12*i* as a development blade mount. The developing means holding frame 12 is also provided with joggle 12*i*1 and screw holes 12*i*2, which are located next to the lengthwise end of the development blade placement surface 12*i*. The right end portion of the metallic plate 9*d*1 is provided with a hole 9*d*3, and the left end portion of the metallic plate 9*d*1 is provided with a hole 9*d*5 elongated in the lengthwise direction of the plate 9*d*1. Into these holes 9*d*3 and 9*d*5, the aforementioned joggles 12*i*1 are placed. The left and right joggles 12*i*1, and the holes 9*d*3 and elongated hole 9*d*5, constitute the means for positioning the development blade 9*d*. More specifically, referring to FIG. 11, the dimensions of the right joggle 12*i*1 and hole 9*d*3 are made to be such that after the fitting of the joggle 12*i*1 into the hole 9*d*3, there will be a gap of only several micrometers to several tens of micrometers between the two. In other words, the right joggle 12*i*1 and hole 9*d*3 fix the position of the development blade 9*d* in terms of both the lengthwise and widthwise directions. On the left side, the left joggle 12*i*1 is the same as that on the right side, but, the left hole 9*d*5 of the metallic plate 9*d*, into which the left joggle 12*i*1 fits, is elongated in the lengthwise direction of the metallic plate 9*d*. Thus, the position of the development blade 9*d* with respect to its lengthwise direction is fixed by the joggle 12*i*1 and hole 9*d*3, whereas the position of the development blade 9*d* with respect to its widthwise direction is fixed by the left and right joggles 12*i*1 and the holes 9*d*3 and 9*d*5. Therefore, it is possible to precisely attach the development blade 9*d*. After the development blade 9*d* is accurately placed on the flat blade placement surface 12*i* by the above described positioning means, a pair of small screws 9*d*6 are put through the screw holes 9*d*4 of the metallic plate 9*d*1, and are screwed into the aforementioned screw holes 12*i*2 to securely fix the metallic plate 9*d*1 to the flat surface 12*i*. Further, the developing means holding frame 12 is provided with an elastic sealing member 12*s*, which is pasted to the area of the developing means holding frame 12, above the flat surface 12*i*. The elastic sealing member 12*s* is for sealing between the developing means holding frame 12 and development blade 9*d* to prevent the toner from leaking out, and is formed of Moltprene or the like. It is extended along the lengthwise edge of the development blade 9*d*. Further, the developing means holding frame 12 is provided with a pair of magnetic seals 12*s*1 as development roller end seals, which are extended downward from both lengthwise ends of the elastic sealing member 12*s*, one for one, following the arcuate surface 12*j* parallel to the peripheral surface of the development roller 9*c*. These magnetic seals 12*s*1 are for sealing the gaps between the lengthwise ends of the development roller 9*c* and the developing means holding frame 12. Further, the developing means holding frame 12 is provided with a thin elastic sealing member 12*s*2, which is pasted to the mandible-like portion 12*h* of the developing means holding frame 12, being positioned so that it tangentially contacts the peripheral surface of the development roller 9*c* to seal between the developing means holding frame 12 and development roller 9*c*. One of the widthwise ends (lengthwise edges) of the metallic plate 9*d*1 of the development blade 9*d* is bent approximately 90°, forming a bent portion 9*d*1*a*.

Next, referring to FIGS. 11 and 14, the development roller unit G will be described. The development roller unit G comprises: (1) development roller 9*c*, (2) a pair of spacer rollers 9*i*, which are for keeping constant the distance between the peripheral surfaces of the development roller 9*c* and photoconductive drum 7, are formed of an electrically insulative substance such as synthetic resin, and double as caps fitted around the lengthwise ends of the development roller 9*c*, one for one, to prevent an electrical leak between the cylindrical aluminum substrate of the photoconductive drum 7 and cylindrical aluminum substrate of the development roller 9*c*; (3) a development roller bearing 9*j* (shown in enlargement in FIG. 11) for rotationally supporting the development roller 9*c* and positioning the development roller 9*c* relative to the developing means holding frame 12; (4) a development roller gear (helical gear) 9*k* for rotating the development roller 9*c* by receiving a driving force from the helical drum gear 7*b* (FIG. 8) of the photoconductive drum 7; (5) a partially shown coil spring 9*l* (FIG. 14), fitted around one end of the development roller 9*c*; and (6) a magnet 9*g* disposed within the development roller 9*c* to adhere toner to the peripheral surface of the development roller 9*c*. Although in FIG. 11, the bearing box 9*v* has been already attached to the development roller unit G, the development roller unit G is joined with the bearing box 9*v* when the bearing box 9*v* is attached to the side wall 12B of the developing means holding frame 12.

Referring to FIG. 11, in the development roller unit G, one end of a metallic flange 9*p* is securely fitted in one end of the development roller 9*c*. The metallic flange 9*p* comprises a development roller attachment shaft portion 9*p*1, at the other end, which projects outward in terms of the lengthwise direction of the development roller 9*c* and is partially double-flatted. The development roller gear 9*k* formed of synthetic resin is fitted around the development roller attachment shaft portion 9*p*1, being locked with the shaft 9*p*1, in terms of their rotational direction, by the double-flatted portion of the shaft 9*p*1. The development roller gear 9*k* is a helical gear, and its teeth are twisted so that as the development roller gear 9*k* is rotated, thrust is generated in the direction to push the development roller 9*c* inward of the developing means holding frame 12 in terms of the lengthwise direction of the developing means holding frame 12. The end portions 9*g*1 of the magnet 9*g*, which are flatted, are put through the flanges 9*p*, one of the end portions 9*g*1 thereof projecting outward from the development roller attachment shaft portion 9*p*1 and the other projecting from the flange 9*p*. One of the flatted end portions 9*g*1 of the magnet 9*g* is fitted in the developing means holder 40 of the driving force transmission unit DG, being nonrotationally supported. The driving force transmission unit DG will be described later. The aforementioned development roller bearing 9*j* is provided with a round hole, the cylindrical wall of which is provided with a rotation prevention projection 9*j*5. In this round hole of the development roller bearing 9*j*, the bearing 9*j*4, the cross section of which is in the form of a letter C, exactly fits, and the flange 9*p* rotationally fits in the bearing 9*j*4. The development roller bearing 9*j* is fitted in the slit 12*f* of the developing means holding frame 12, and the development means holder 40 is securely fixed to the developing means holding frame 12 by putting the projections 40*f* of the developing means holder 40 through the holes 12*g* of the developing means holding frame 12, and the holes 9*j*1 of the development roller bearing 9*j*. As a result, the development roller bearing 9*j* is securely held to the developing means holding frame 12. The bearing 9*j*4 is provided with a flange, and in this embodiment, only the flange portion is C-shaped in cross section. However, the shape of the bearing 9*j*4 may be such that the cross section of the actual bearing portion of the bearing 9*j*4 is also C-shaped in cross section. The hole of the development roller bearing 9*j*, into which the bearing 9*j*4 is fitted, is stepped. The aforementioned rotation prevention projection 9*j*5 is provided on the internal surface of the large diameter portion of the hole, that is, the portion of the hole, in which the flange of the bearing 9*j*4 is fitted. This bearing 9*j*, and a bearing 9*f* which will be described later, are formed of polyacetal, polyamide, or the like.

The lengthwise end portions of the magnet 9*g* disposed within the hollow cylindrical development roller 9*c* are both projecting from the lengthwise ends of the development roller 9*c*. The end portion 9*g*1 with the flatted portion is fitted in the D-shaped magnet supporting hole 9*v*3 of the development roller bearing box 9*v* shown in FIG. 14, in which the hole 9*v*3 is in the top portion of the bearing box 9*v* and is not visible. To one of the lengthwise ends of the development roller 9*c*, a hollow journal 9*w* formed of electrically insulative substance is securely fixed by being inserted into the development roller 9*c*. The cylindrical small diameter portion 9*w*1 of the journal 9*w* insulates the contact point of the coil spring 9*l* electrically connected to the development roller 9*c*, from the magnet 9*g*. The bearing 9*f* with a flange is formed of synthetic resin and is electrically insulative. It fits in the bearing hole 9*v*4 coaxial with the magnet supporting hole 9*v*3. The internal surface of the bearing hole 9*v*4 is provided with a key groove 9*v*5, in which the key portion 9*f*1, which is an integral part of the bearing 9*f*, fits to prevent the bearing 9*f* from rotating. The bearing hole 9*v*4 is a blind hole, and the internal end of a doughnut-shaped development bias contact plate 121 is on the bottom surface of this blind bearing hole 9*v*4. As the development roller bearing box 9*v* and development roller 9*c* are put together, the contact point of the metallic coil spring 9*l* comes into contact with the development bias contact plate 121, with the spring 9*l* compressed between the development roller bearing box 9*v* and development roller 9*c*. The metallic development bias contact plate 121 comprises: a first extension portion 121*a*, which is perpendicularly extended from the periphery of the doughnut-shaped portion, being fitted in a shallow groove 9*v*6 cut, in the axial direction of the bearing hole 9*v*4, in the internal surface of the bearing hole 9*v*4, so that it fits on the outward side of the bearing 9*f*; a second extension portion 121*b* which is extended from the first extension portion 121*a*, perpendicularly outward in terms of the radius direction of the bearing hole 9*v*4, being fitted in the notch 9*v*7 cut in the brim portion of the wall of the bearing hole 9*v*4; a third extension portion 121*c* extended from the second extension portion 121*b* perpendicularly inward of the developing means holding frame 12; a fourth extension portion 121*d* extended from the third extension portion 121*c*, perpendicularly outward in the radius direction of the development roller 9*c*; and an external contact point 121*e* extended from the fourth extension portion 121*d* in a manner of being outwardly folded back. In order to support the development bias contact plate 121 structured as described above, the development roller bearing box 9*v* is provided with a supporting portion 9*v*8, which projects inward in terms of the lengthwise direction of the development roller 9*c*. The supporting portion 9*v*8 is in contact with the third and fourth extension portions 121*c* and 121*d* as well as the external contact point 121*e*. The second extension portion 121*b* is provided with a hole 121*f* into which a joggle 9*v*9 of the development roller bearing box 9*v* is pressed. The joggle 9*v*9 is on the inward surface of the development roller bearing box 9*v* and projects inward in terms of the lengthwise direction of the development roller 9*c*. This external contact point 121*e* of the development bias contact plate 121 is such a contact point that comes into contact with the development bias contact 125 of the apparatus main assembly 14 shown in FIG. 6, making it possible for the development bias to be applied to the development roller 9*c*, as the process cartridge B is mounted into the apparatus main assembly 14.

The development roller bearing box 9*v* is also provided with a pair of cylindrical protections 9*v*1, which are fitted, one for one, into a pair of holes 12*m* located in the lengthwise ends of the developing means holding frame 12, shown in FIG. 15, to position the development roller bearing box 9*v* relative to the developing means holding frame 12. The development roller bearing box 9*v* is also provided with a pair of screw holes 9*v*2, through which a pair of unshown screws are put and screwed into a pair of female-threaded screw holes of the developing means holding frame 12 to solidly fix the development roller bearing box 9*v* to the developing means holding frame 12. As described above, in this embodiment, when attaching the development roller 9*c* to the developing means holding frame 12, first, the development roller unit G is assembled, and then, the assembled development roller unit G is attached to the developing means holding frame 12.

Next, the rod antenna 9*h* for detecting the amount of the remaining toner will be described. Referring to FIGS. 11 and 15, one of the end portions of the rod antenna 9*h* is bent in the form of a crank. The end 9*h*1 of this crank-like portion of the rod antenna 9*h* is placed in contact with the toner detection contact 126 attached to the apparatus main assembly 14 as shown in FIG. 6, establishing an electrical connection to the apparatus main assembly 14 (when end 9*h*1 is referred to as contact point, it will be designated by referential code 122). The rod antenna 9*h* is attached to the developing means holding frame 12 through the following steps: First, virtually the entirety of the rod antenna 9*h* is inserted into the developing means holding frame 12 through a through hole 12*b* of the side wall 12B of the developing means holding frame 12, from the straight end side, and the straight end thereof is fitted into an unshown hole in the opposing side wall of the developing means holding frame 12, so that the rod antenna 9*h* is supported and positioned by the two side walls of the developing means holding frame 12. In order to prevent toner invasion, the through hole 12*b* is fitted with a seal (unshown) (sealing ring formed of synthetic resin, felt, sponge, or the like). The arm portion of the crank-shaped portion with the contact point 9*h*1 is positioned so that as the development roller bearing box 9*v* is attached to the developing means holding frame 12, the development roller bearing box 9*v* prevents the movement of the arm portion, hence, preventing the rod antenna 9*h* from dislodging outward. The side wall 12B of the developing means holding frame 12, that is, the side wall having the through hole 12*b* through which the rod antenna 9*h* is inserted, has a portion extended in the direction perpendicular to the lengthwise direction of the developing means holding frame 12 so that after the joining of the toner storage frame 11 and developing means holding frame 12, this extended portion partially covers the toner inlet cap 11*f* of the bottom frame 11*b* of the toner storage frame 11. Further, the side wall 12A is provided with another unshown hole, through which the coupling portion 9*s*1 (FIG. 12) of the toner sending gear 9*s* for transmitting a driving force to the toner sending member 9*b* is inserted. The toner sending gear 9*s* integrally comprises a coupling portion 9*s*1 for transmitting a driving force to the toner sending member 9*b*. The coupling portion 9*s*1 engages with the coupling portion 11*e* (FIGS. 13 and 16), on the toner storage frame side, which is attached to the end of the toner sending member 9*b* and is rotationally supported by the toner storage frame 11. Referring to FIG. 15, the developing means holding frame 12 rotationally supports the toner stirring member 9*e*, which is disposed in parallel to the rod antenna 9*h*. The toner stirring member 9*e* is in the form of a crankshaft with a single crank. One of its journal portions is fitted in a hole, as a bearing (unshown), of the side wall 12B of the developing means holding frame 12, and the other is fitted in the toner stirring gear 9*m*, shown in FIG. 13, the shaft portion of which is rotationally supported by the side wall 12A of the developing means holding frame 12. Further, on the stirring gear side, the arm portion of the stirring member 9*e* is placed in the notch cut in the shaft portion of the stirring member 9*m* so that the rotation of the stirring gear 9*m* is transmitted to the toner stirring member 9*e*.

Next, the transmission of a driving force to the development unit D will be described. Referring to FIG. 12, the partially D-cut cylindrical shaft 9*g*1 of the magnet 9*g* is fitted in the supporting hole 40*a* of the developing means holder 40, being nonrotationally supported. As the developing means holder 40 is attached to the developing means holding frame 12, the development roller gear 9*k* meshes with the gear 9*q* of the gear train GT, and the toner stirring gear 9*m* meshes with the small gear 9*s*2 of the gear train GT. As a result, it becomes possible for the toner sending gear 9*s* and toner stirring gear 9*m* to receive a driving force from the development roller gear 9*k*. The gears between the gear 9*q* and toner sending gear 9*s* are all idler gears. The gear 9*q* which meshes with the development roller gear 9*k*, and the small gear 9*q*1 integral with the gear 9*q*, are rotationally supported by the joggle 40*b* integral with the developing means holder 40. The large gear 9*r* which meshes with the small gear 9*q*1, and the small gear 9*r*1 integral with the gear 9*r*, are rotationally supported by the joggle 40*c* integral with the developing means holder 40. The small gear 9*r*1 meshes with the toner sending gear 9*s*. The toner sending gear 9*s* is rotationally supported by the joggle 40*d* integral with the developing means holder 40. The toner sending gear 9*s* has the aforementioned coupling portion 9*s*1. The toner sending gear 9*s* meshes with the small gear 9*s*2. The small gear 9*s*2 is rotationally supported by the joggle 40*e* integral with the developing means holder 40. With the provision of the above described structural arrangement, the gears making up the gear train GT can be supported by a single component (in this embodiment, developing means holder 40). Therefore, some of the gears of the gear train GT can be attached to the development roller bearing box 9*v* through an assembly line independent from the main assembly line. In other words, the assembly process can be divided into a plurality of simple sub-assembly processes. More specifically, first, the rod antenna 9*h* and toner stirring member 9*e* are attached to the developing means holding frame 12. Then, as the development roller unit G and gear box 9*v* are attached to the developing means driving force transmission unit DG and the developing means holding frame 12, respectively, the development unit D is completed.

Also referring to FIG. 15, designated by a referential code 12*p* is an opening, which extends in the lengthwise direction of the developing means holding frame 12. After the joining of the toner storage frame 11 and developing means holding frame 12, this opening 12*p* squarely faces the opening 11*i* of the toner storage frame 11, making it possible for the toner in the toner storage frame 11 to be supplied to the development roller 9*c*. The aforementioned toner stirring member 9*e* and rod antenna 9*h* extend from one lengthwise end of this opening 12*p* to the other. The material for the developing means holding frame 12 is the same as that for the toner storage frame 11.

[Structure of Electrical Contact]

Figure 8:
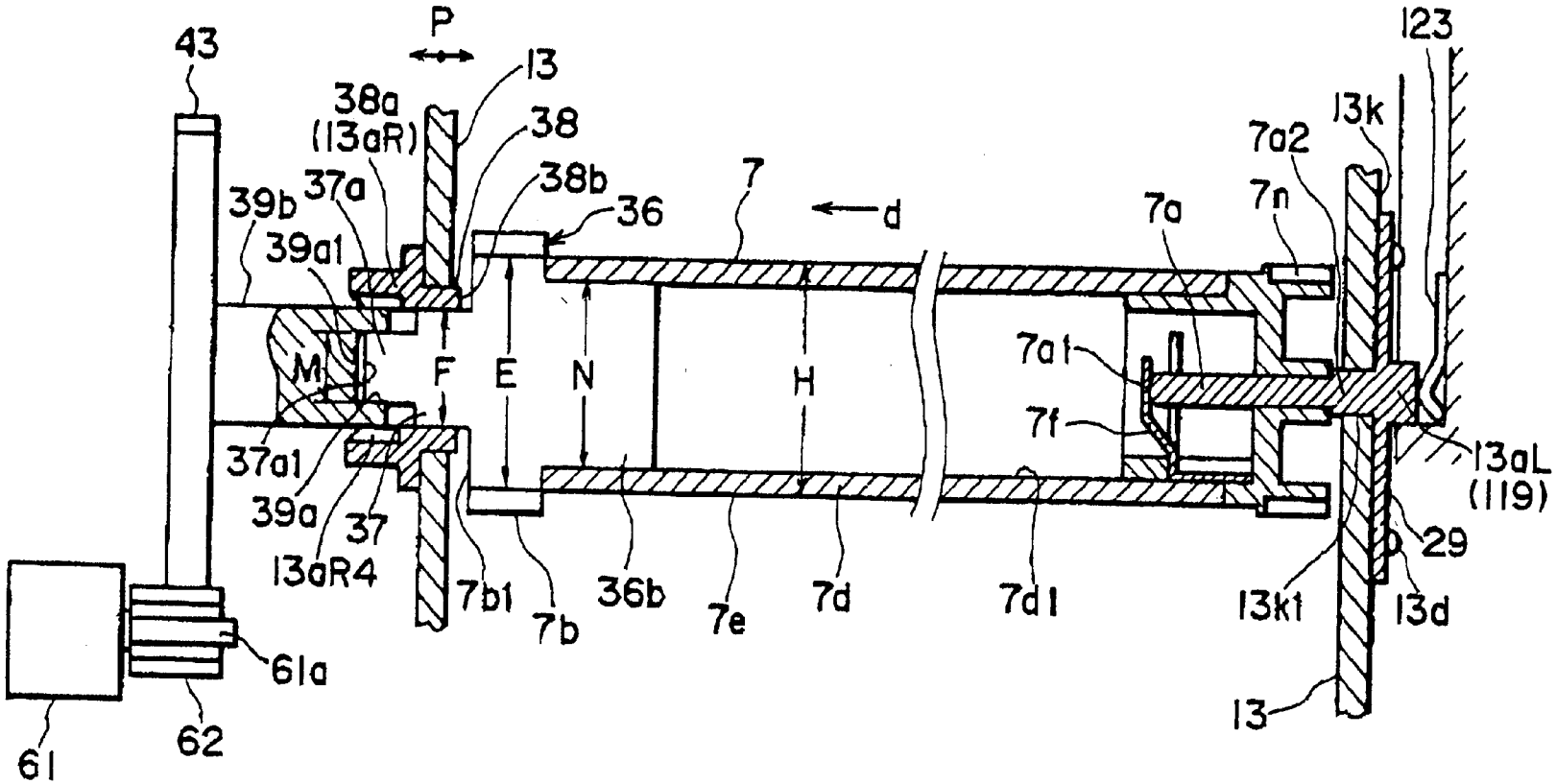
FIG. 8 is a vertical sectional view of the combination of the photoconductive drum and a driving apparatus therefor.

Next, referring to FIGS. 5, 6, and 8, the contacts for establishing an electrical connection between the process cartridge B and image forming apparatus main assembly 14 as the former is mounted into the latter will be described regarding their connections and positions.

Referring to FIG. 5, the process cartridge B is provided with four electrical contacts. More specifically, the process cartridge B has: (1) the cylindrical guide 13*a*L (which will be designated by referential code 119 when referred to as the electrically conductive ground contact), as an electrical conductive grounding contact, electrically connected to the photoconductive drum 7; (2) an electrically conductive charge bias contact 120 electrically connected to the charge roller shaft 8*a* to apply charge bias to the charge roller 8 from the apparatus main assembly 14; (3) an electrically conductive development bias contact 121 electrically connected to the development roller 9*c* to apply development bias to the development roller 9*c* from the apparatus main assembly 14; and (4) an electrically conductive toner remainder amount detection contact 122 electrically connected to the rod antenna 9*h* to detect the amount of the remaining toner. These electrical contacts are exposed from the side or bottom wall of the process cartridge B. More specifically, the four contacts 119–122 are exposed from the left side wall, as seen from the rear end in terms of the process cartridge insertion direction, or from the bottom wall, being separated from the adjacent contacts by intervals large enough to prevent an electrical leak. The grounding contact 119 and charge bias contact 120 are attached to the cleaning unit C, whereas the development bias contact 121 and toner remainder amount detection contact 122 are attached to the developing means holding frame 12. The toner remainder amount detection contact 122 doubles as a process cartridge presence/absence detection contact for enabling the apparatus main assembly 14 to detect that the process cartridge B is in the proper position in the apparatus main assembly 14. Referring to FIG. 8, the grounding contact 119 is electrically in connection with the photoconductive drum 7. The charge bias contact 120 and development bias contact 121 are formed of an electrically conductive metallic plate (stainless steel plate, phosphor bronze plate, or the like), and are routed from inside the process cartridge B to the exterior thereof. The charge bias contact 120 is exposed from the bottom wall of the cleaning unit C, at a location close to the side wall on the non-driven side, that is, the side from which the process cartridge B is not driven. The development bias contact 121 and the toner remainder amount detection contact 122 are exposed from the bottom wall of the development unit D, at locations close to the side wall on the non-driven side.

To describe this embodiment in more detail, the photoconductive drum 7 is provided with the helical drum gear 7*b*, as described before, which is attached to one of the lengthwise ends of the photoconductive drum 7, with its axial line coinciding with that of the photoconductive drum 7. This drum gear 7*b* meshes with the development roller gear 9*k* to rotate the development roller 9*c*. As the drum gear 9*b* is rotated, it generates thrust (in arrow d direction in FIG. 8), moving the photoconductive drum 7, which is supported by the cleaning means holding frame 13, with the presence of play in terms of its lengthwise direction, in the direction of the drum gear 7*b*. Further, the reactive force from the force applied to the drum shaft 7*a* by a grounding plate 7*f* fixed to a spur gear 7*n* applies force to the photoconductive drum 7 in the arrow d direction, adding to the above described thrust. As a result, the lateral surface 7*b*1 of the drum gear 7*b* comes into contact with the inward end surface 38*b* of the bearing 38 solidly fixed to the cleaning means holding frame 13. Consequently, the position of the photoconductive drum 7 in the process cartridge B becomes fixed in terms of its axial direction. The grounding contact 119 is exposed from one of the lengthwise ends 13*k* of the cleaning means holding frame 13. The drum shaft 7*a* is inserted into the drum cylinder 7*d* (in this embodiment, aluminum cylinder) coated with the photoconductive layer 7*e*, in such a manner that the axial line of the drum shaft 7*a* coincides with that of the photoconductive drum 7. The drum cylinder 7*d* and drum shaft 7*a* are electrically connected to each other by the grounding plate 7*f* placed in contact with the internal surface 7*d*1 of the drum cylinder 7*d* and the end surface 7*a*1 of the drum shaft 7*a*.

The charge bias contact 120 is attached to the cleaning means holding frame 13, close to the area supporting the charging roller 8 (FIG. 5), and is electrically connected to the charge roller 8 through a composite spring in contact with the unshown charge roller shaft.

The development bias contact 121 and toner remainder amount detection contact 122 are attached to the bottom wall of the development unit D, close to the side wall thereof on the same side as the lengthwise end 13*k* of the cleaning means holding frame 13. The external contact point of the development bias contact 121 is disposed opposite to the charge bias contact 120 with respect to the spur gear 7*n*. Further, as described before, the development bias contact 121 is electrically connected to the development roller 9*c* through the coil spring 9*l* in contact with the end of the development roller 9*c* (FIG. 14).

The toner remainder amount detection contact 122 shown in FIG. 5 is exposed from the developing means holding frame 12, at a location on the upstream side of the development bias contact 121 in terms of the cartridge mounting direction (arrow X direction in FIG. 6).

Next, the connection between the contacts of the process cartridge B and the contacts of the apparatus main assembly 14 will be described. Referring to FIG. 6, the inward surface of one of the side walls of the cartridge mounting space S of the image forming apparatus A is provided with four contacts (grounding contact 123 to be electrically connected to grounding contact 119; charge bias contact 124 to be electrically connected to charge bias contact 120; development bias contact 125 to be electrically connected to development bias contact 121; and toner detection contact 126 to be electrically connected to toner remainder amount detection contact 122), which are enabled to come into contact with the above described contacts 119–122 of the process cartridge B as the process cartridge B is mounted into the apparatus main assembly 14. As shown in FIG. 6, the grounding contact 123 is attached to the bottom of the positioning groove 16*b*. The development bias contact 125 and toner remainder amount detection contact 126, and charge bias contact 124 are disposed on the bottom surface of the cartridge mounting space S, close to the side wall of the cartridge mounting space S Their positions are below the guiding portion 16*a*, outside the guiding portion 16*a*, and close to the guiding portion 16*a*. They are facing upward. The development bias contact 125 and charge bias contact 124 are spring-loaded, and the toner remainder amount detection contact 126 is bent in such a manner that its resiliency makes it function like a leaf spring.

When the process cartridge B is inserted into the image forming apparatus main assembly 14 while being guided by the guiding portions 16*a* and 16*c*, the contacts 123–126 are kept at their outermost positions in their moving range, by springs or the resiliency thereof, and are not in contact with the contacts 119–122 of the process cartridge B, respectively, until the process cartridge B reaches a predetermined position. As the process cartridge B is further inserted, the contacts 119–122 of the process cartridge B come into contact with the contacts 123–126, respectively. Then, as the process cartridge B is inserted slightly deeper, the cylindrical guide 13*a*L of the process cartridge B fits into the positioning groove 16*b*. As the cylindrical guide 13*a*L fits into the positioning groove 16*b*, the contacts 119–122 force the contacts 123–126 to retract, one for one, against the resiliency of the springs or the resiliency of the contact itself, increasing the contact pressures between the contacts 119–122 and contacts 123–126, respectively.

[Structures of Coupling Means and Driving Mechanism]

Next, the structure of the coupling means, that is, the driving force transmission mechanism for transmitting a driving force from the image forming apparatus main assembly 14 to the process cartridge B, will be described. Referring to FIG. 8, which is a vertical sectional view of the development roller 9*c* and its adjacencies, for showing the coupling portions of the photoconductive drum 7 and process cartridge B after the engagement of the coupling portions, the photoconductive drum 7 disposed in the process cartridge B is provided with a coupling means, which is attached to one of the lengthwise ends of the photoconductive drum 7. Precisely speaking, this coupling means on the process cartridge side is the shaft portion 37 (cylindrical) of the drum flange 36 solidly fixed to the end of the photoconductive drum 7. The end surface of the shaft portion 37 is provided with a male-type coupling portion 37*a*, the end surface of which is parallel to that of the shaft portion 37. This shaft portion 37 with the male-type coupling portion 37*a* fits into the bearing 38, and functions as the rotational axle of the photoconductive drum 7. In this embodiment, the drum flange 36, the shaft portion 37, and the male-type coupling portion 37*a* are integral parts of a single component. The drum flange 36 is provided with the helical drum gear 7*b* for transmitting a driving force to the development roller 9*c* in the process cartridge B. In other words, the drum flange 36 is a molded single-piece component integrally comprising the drum gear 7*b*, the shaft portion 37, and the male-type coupling portion 37*a*, and is a component capable of transmitting a driving force. The male-type coupling portion 37*a* is in the form of a twisted polygonal pillar, more specifically, a pillar having a cross section approximately in the form of an equilateral triangle, which is gradually twisted about its axial line in the rotational direction. On the other hand, the female-type coupling portion 39*a* which engages with the male-type coupling portion 37*a* is a portion with a hole which is gradually twisted about its axial line in the rotational direction, and the cross section of which is polygonal. The male-type coupling portion 37*a* and the hole of the female-type coupling portion 39*a* are approximately the same in helix angle, and are twisted in the same direction. The cross section of the hole of the female-type coupling portion 39*a* is approximately in the form of an equilateral triangle. This female-type coupling portion 39*a* is a part of the shaft 39*b* integral with the gear 43 on the apparatus main assembly side. This shaft 39*b* with the coupling portion 39*a* is rotationally supported by the apparatus main assembly 14, being also allowed to move in its axial direction. Thus, in the case of the above described structure in this embodiment, as the process cartridge B is mounted into the apparatus main assembly 14, the male-type coupling portion 37*a* fits into the female-type coupling portion 39*a* on the apparatus main assembly side, allowing the rotational force of the female-type coupling portion 39*a* to be transmitted to the male-type coupling portion 37*a*. Further, as the rotational force of the female coupling portion 39*a* is transmitted to the male-type coupling portion 37*a*, the three ridges of the male-type coupling portion 37*a* in the form of a triangular pillar, which is approximately equilateral in cross section, simultaneously contact the corresponding internal lateral surfaces of the hole of the female-type coupling portion 39*a*, causing the axial lines of two coupling portions 37*a* and 39*a* to align. Thus, the diameter of the circumcircle of the male-type coupling portion 37*a* is rendered larger than the diameter of the inscribed circle of the hole of the female-type coupling portion 39*a*, and also, is rendered smaller than the diameter of the circumcircle of the female-type coupling portion 39*a*. Further, the twisted shapes of the male- and female-type coupling portions 37*a* and 39*a* generate such force that makes the female-type coupling portion 39*a* pull the male-type coupling portion 37*a* inward toward its hole. As a result, the end surface 37*a*1 of the male-type coupling portion 37*a* comes into contact with the bottom 39*a*1 of the hole of the female-type coupling portion 39*a*. Since the thrust which pulls the male-type coupling portion 37*a* inward of the female-type coupling portion 39*a* acts in the same direction as the arrow d direction, the photoconductive drum 7 which is virtually integral with the male-type coupling portion 37*a* is accurately positioned, and kept accurately positioned, in the image forming apparatus main assembly 14, in terms of its axial and radius directions.

Designated by a referential code 36*b* is a portion of the drum flange 36, which is fitted into the drum cylinder 7*d* in order to attach the drum flange 36 to the photoconductive drum 7 The drum flange 36 is attached to the photoconductive drum 7 by crimping, gluing, or the like. The peripheral surface of the drum cylinder 7*d* is coated with the photoconductive layer 7*e*.

The male-type coupling portion 37*a* of the shaft portion 37 of the drum flange 36 in the process cartridge B is surrounded by a cylindrical portion 38*a* (cylindrical guide 13*a*R), which is an integral part of the bearing 38 solidly fixed to the cleaning means holding frame 13 (FIG. 9). The axial line of the cylindrical portion 38*a* coincides with that of the shaft portion 37. The bearing 38 doubles as the guiding member when mounting the process cartridge B into the image forming apparatus main assembly 14 or dismounting it therefrom. Referring to FIG. 8, there are the following relationships among the photoconductive drum 7, the drum flange 36, and the shaft portion 37 with the male-type coupling portion 37*a*: $H>F\geqq M$, and $E>N$, wherein H stands for the external diameter of the photoconductive drum 7; E stands for the diameter of the root circle of the drum gear 7*b*; F stands for the diameter of the hole of the photoconductive drum shaft bearing 38 (external diameter of the shaft portion 37 with the male-type coupling portion 37*a*: internal diameter of the bearing 38); M stands for the circumcircle of the male-type coupling portion 37*a*; and N stands for the external diameter of the portion 36*b* of the drum flange 36 of the photoconductive drum 7 (internal diameter of the photoconductive drum 7). H being larger than F, the torque necessary to rotate the photoconductive drum 7 against the friction between the peripheral surface of the shaft portion 37 and the internal surface of the bearing 38 is smaller than the torque which would be necessary if the drum cylinder were directly borne by a bearing. F being no less than M, there will be no undercut portion, making it possible to simplify the mold structure, as the mold for the drum flange 36 is divided in the fashion indicated by a double-headed arrow mark P in the drawing, that is, the normal fashion. Further, E being greater than N, it is possible to simplify the right piece of the drum flange mold, as seen from the rearward of the process cartridge B in terms of the process cartridge insertion direction, in order to make it more durable, since the portion of the mold responsible for the formation of the gear portion 7*b* of the drum flange 36 is a part of the left piece of the mold.

The large gear 43 on the apparatus main assembly side is a helical gear, and meshes with the small helical gear 62 solidly fixed to the shaft 61*a* of a motor 61 or formed as an integral part of the shaft 61*a*. The teeth of the large and small gears 43 and 62 are angled so that as the driving force is transmitted from the small gear 62 to the large gear 43, thrust is generated in the direction to move the shaft 39*b* with the female-type coupling portion 39*a* toward the shaft portion 37 with the male-type coupling portion 37*a*. Thus, as the motor 61 is activated to form images, the shaft 39*b* with the female-type coupling portion 39*a* is moved by the thrust toward the shaft portion 37 with the male-type coupling portion 37*a*. As a result, the female-type coupling portion 39*a* couples with the male-type coupling portion 37*a*. The female-type coupling portion 39*a* is the end portion of the shaft 39*b*, and its axial line coincides with that of the shaft 39*b*.

The process cartridge B and apparatus main assembly 14 are structured so that after the mounting of the process cartridge B, the process cartridge B is allowed to move in its lengthwise direction as well as the cartridge mounting direction X (FIG. 6). More specifically, the process cartridge B is allowed to move slightly in its lengthwise direction between the guiding members 16R and 16L on the side walls of the cartridge mounting space S of the apparatus main assembly 14. In other words, as the process cartridge B is inserted into the apparatus main assembly 14, the cylindrical guide 13*a*L (FIGS. 4 and 6) formed as an integral part of the flange 29 attached to one of the lengthwise ends of the cleaning means holding frame 13 exactly fits into the positioning groove 16*b* (FIG. 6) of the apparatus main assembly 14, positioning thereby the process cartridge B, and the spur gear 7*n* solidly fixed to the photoconductive drum 7 meshes with the gear (unshown) for transmitting a driving force to the transfer roller 4. On the other side of the photoconductive drum 7, (the side from which photoconductive drum 7 is driven), the cylindrical guide 13*a*R of the cleaning means holding frame 13 is supported by the positioning groove 16*d* of the apparatus main assembly 14.

Also on the driven side (coupler side), the positioning of the process cartridge B and the transmission of the driving force occur as follows: As the motor 61 on the apparatus main assembly 14 side rotates, first, the shaft 39*b* with the female-type coupling portion 39*a* moves toward the shaft portion 37 with the male-type coupling portion 37*a* (direction opposite to arrow d direction in FIG. 8). As the rotational phases of the two coupling portions 37*a* and 39*a* synchronize (in this embodiment, since cross sections of male- and female-type coupling portions 37*a* and 39*a* are both approximately in form of an equilateral triangle, their rotational phases synchronize every 120 degrees of rotation), they couple. As a result, a rotational driving force is transmitted from the apparatus main assembly 14 to the process cartridge B. There is a difference in the size of the triangular cross section between the two coupling portions 37*a* and 39*a*; the cross section of the hole of the female-type coupling portion 39*a*, approximately in the form of an equilateral triangle, is greater than that of the male-type coupling portion 37*a*. Therefore, the male-type coupling portion 37*a* smoothly enters the female-type coupling portion 39*a*, with the presence of some gap between the former and the latter.

Figure 19:
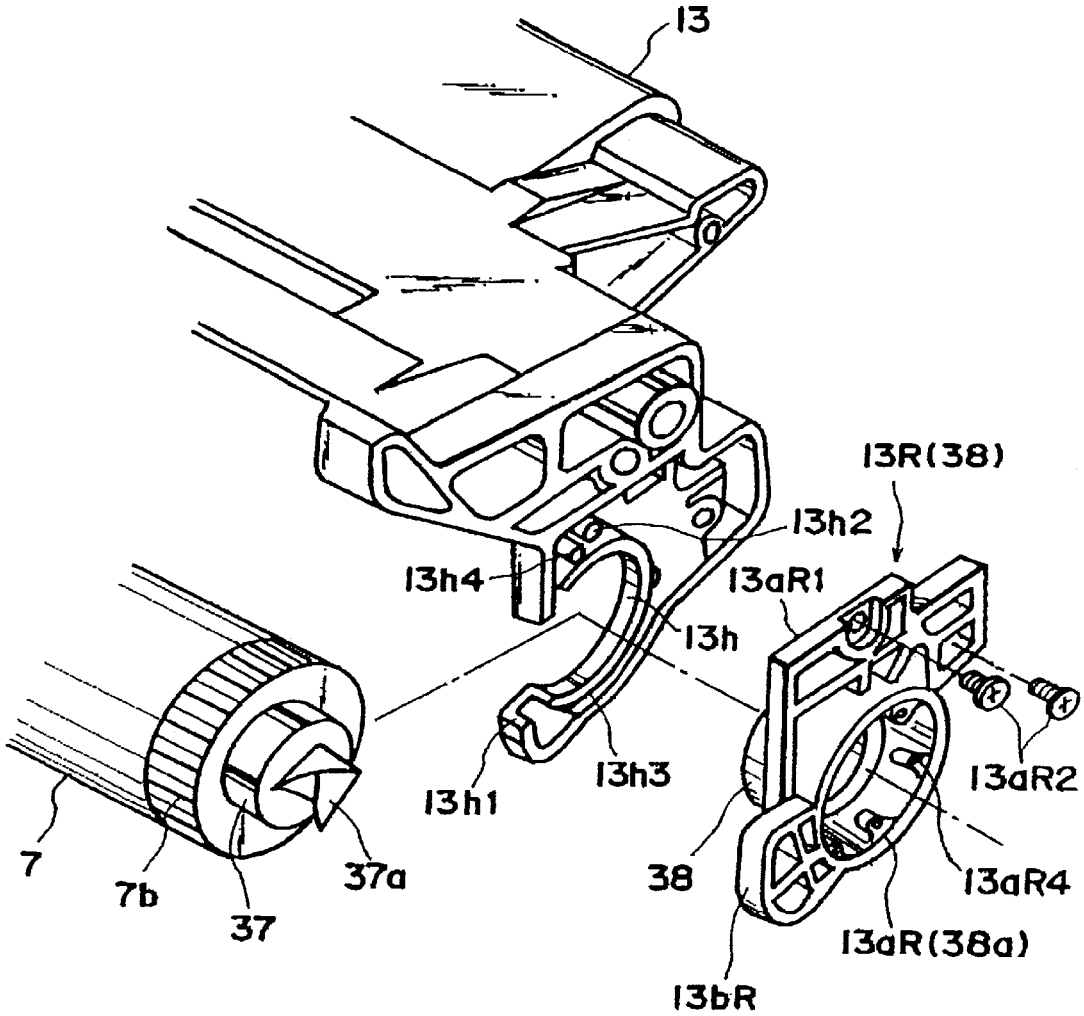
FIG. 19 is a perspective view of the portion of the cleaning means holding frame, to which the photoconductive drum is attached.
Figure 20:
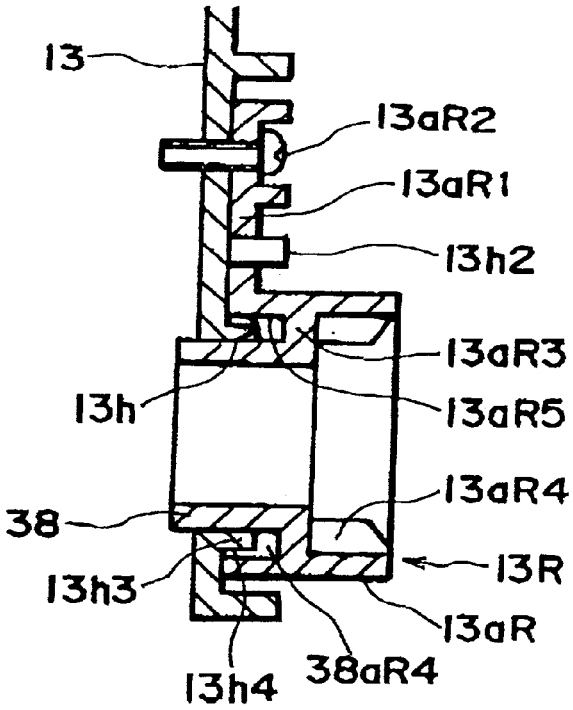
FIG. 20 is a vertical sectional view of the drum shaft bearing and its adjacencies.
Figure 21:
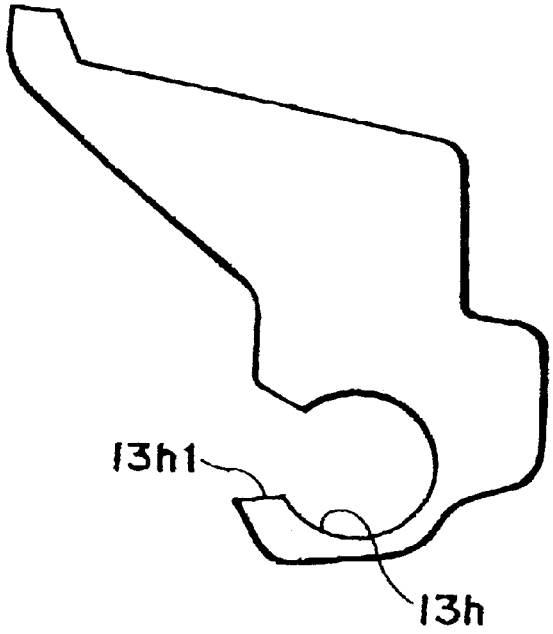
FIG. 21 is an external side view of the drum shaft bearing, for showing the external shape thereof.

FIG. 19 is a perspective view of the right guiding member 13R and cleaning means holding frame 13, which shows in detail how the right guiding member 13R is attached to the cleaning means holding frame 13. FIG. 20 is a vertical sectional view of the right guiding member 13R and its adjacencies after the attachment of the right guiding member 13R to the cleaning means holding frame 13. FIG. 21 is a plan view of the right side wall of the cleaning means holding frame 13, and shows the contour of the portion of the side wall, to which the bearing 38, integral with the right guiding member 13R, is attached. Here, the attachment of the right guiding member 13R (38) integral with the bearing 38 to the cleaning means holding frame 13 schematically shown in FIG. 8, and the attachment of the unitized (preassembled) photoconductive drum 7 to the cleaning means holding frame 13, will be concretely described. Referring to FIGS. 19 and 20, the right guiding member 13R is provided with the small diameter bearing 38, which is on the inward surface thereof. The bearing 38 is an integral part of the right guiding member 13R and its axial line coincides with that of the cylindrical guide 13*a*R. The bearing 38 is connected to the center portion of the cylindrical guide 38*a*R in terms of its axial direction (lengthwise direction) by the doughnut-shaped member 13*a*R3 connected to the inward end of the bearing 38. Thus, a circular groove 38*a*R4, which opens toward the side wall of the cleaning means holding frame 13, is created between the bearing 38 and cylindrical guide 13*a*R Referring to FIGS. 19 and 21, the side wall of the cleaning means holding frame 13 is provided with a bearing attachment hole 13*h*, the cross section of which is the form of a letter C. The size of the gap of the bearing attachment hole 13*h* is smaller than the diameter of the bearing attachment hole 13*h*, and is greater than the diameter of the shaft portion 37 with the male-type coupling portion 37*a*. Since the shaft portion 37 with the male-type coupling portion 37*a* exactly fits in the bearing 38, there is a gap between the peripheral surface of the shaft portion 37 and the internal surface of the bearing attachment hole 13*h*. The side wall of the cleaning means holding frame 13 is provided with a positioning pin 13*h*2 formed as an integral part of the side wall. The positioning pin 13*h*2 exactly fits into a hole of the flange 13*a*R1 of the guiding member 13R. With the provision of the above described structural arrangement, the preassembled photoconductive drum 7 can be attached to the cleaning means holding frame 13 from the direction perpendicular to the axial direction of the photoconductive drum 7 (lengthwise direction), and the positional relationship of the right guiding member 13R to the cleaning means holding frame 13 becomes accurately fixed as the right guiding member 13R is attached to the cleaning means holding frame 13 from the lengthwise direction. Referring to FIG. 19, the preassembled photoconductive drum 7 is attached to the cleaning means holding frame 13 in the following manner: First, the photoconductive drum 7 is moved in the direction perpendicular to its lengthwise direction so that the shaft portion 37 with the male-type coupling portion 37*a* can be inserted into the bearing attachment hole 13*h* through the gap 13*h*1 while keeping the drum gear 7*b* within the cleaning means holding frame 13. After the placement of the photoconductive drum 7 in the cleaning means holding frame 13 in the above described manner, the drum shaft 7*a* integral with the left guide 13*a*L shown in FIG. 8 is put through the side wall 13*k* of the cleaning means holding frame 13 and fitted into the spur gear 7*n*. Then, a small screw 13*d* is put through a hole of the flange 29 of the guide 13*a*L and screwed into the cleaning means holding frame 13 to solidly fix the guide 13*a*L to the cleaning means holding frame 13 to support one end of the photoconductive drum 7. Next, the bearing 38 integral with the right guiding member 13R is fitted into the bearing attachment hole 13*h* while allowing the shaft portion 37 with the male-type coupling portion 37*a* to fit into the bearing 38, and the positioning pin 13*h*2 of the cleaning means holding frame 13 is fitted into the hole of the flange 13*a*R1 of the right guiding member 13R. Then, a small screw 13*a*R2 is put through a hole of the flange 13*a*R1 and screwed into the cleaning means holding frame 13 to solidly fix the right guiding member 13R to the cleaning means holding frame 13. The ribs 13*a*R4 on the internal surface of the right guiding member 13R are guides for guiding the female-type coupling portion 39*a*.

[Process Cartridge Remanufacture]

Next, the process cartridge remanufacturing method to which the present invention relates will be described. Here, process cartridge remanufacture is the combination of a process in which a process cartridge depleted of toner is separated into the development unit and cleaning unit and the two units are partially disassembled, and a process in which the partially disassembled two units are assembled into a process cartridge which is the same in function to a brand-new one, but is partially different in that the development unit is a brand-new one. More concretely, the difference in structure between the development unit in a remanufactured process cartridge from that in a brand-new process cartridge occurs because in process cartridge remanufacture, the cover film 51, shown in FIG. 17, which was sealing the opening 11*i* of the toner storage frame 11, shown in FIG. 16, is not restored, and also, the development roller unit G, and the interface between the development blade 9*d* and developing means holding frame 12, are better sealed to compensate for the absence of the cover film 51. With the restoration of the cover film 51, a remanufactured process cartridge is identical in function as well as structure. In this embodiment, however, the cover film 51 is not restored, because the restoration of the cover film 51 is not essential; all that is necessary is for a reassembled development unit D to be as well sealed as a reassembled development unit D reassembled through a process in which the cover film 51 is restored.

Next, a method for reliably sealing the development unit D, without restoring the cover film 51, to prevent toner from leaking from the development unit D will be described. To state for the sake of precaution, as is evident from the preceding descriptions, "to seal a process cartridge well enough to prevent toner leak" does not means "to seal a process cartridge well enough to prevent toner from leaking from the process cartridge during the ordinary handling of the process cartridge, for example, while hand-carrying it." but means" to seal a process cartridge well enough to prevent toner from leaking from the process cartridge even in a severe situation, for example, during the post-remanufacture transportation thereof by a truck, a ship, an aircraft, or the like." Evidently, when a process cartridge is used for the first time, the cover film 51 is pulled out by a user (unless cover film 51 is removed, image formation is impossible). Therefore, the process cartridge is routinely mounted into, or dismounted from, the image forming apparatus A, by the user after the removal of the cover film 51. Thus, it is an expected feature of a process cartridge as merchandise, and is a known fact, that toner does not leak from the process cartridge during the routine handling of the process cartridge by a user. However, during the shipment of a process cartridge by a truck, a ship, an aircraft, etc., from a factory to an end user, a process cartridge is subjected to vibrations and shocks far more severe than those occurring during the routine handling of a process cartridge by a user. Therefore, a measure aimed specifically at the toner leak which occurs during process cartridge shipment is necessary. The cover film 51 is a means for preventing toner from leaking during process cartridge shipment. Thus, when the cover film 51 is not restored, a sealing means capable of compensating for the lack of the cover film 51 is necessary.

To describe this process more concretely, with the presence of the cover film 51, the opening 11*i* is sealed. Therefore, the back side of the development blade 9*d* (side opposite to development roller 9*c* with respect to development blade 9*d*), and the adjacencies of the toner stirring member 9*e* and rod antenna 9*h*, shown in FIGS. 2 and 18, are not filled with toner. Thus, the development roller unit G, and the gap between the development blade 9*d* and developing means holding frame 12, have only to be sealed well enough to prevent toner from leaking during the aforementioned routine handling of a process cartridge by a user. However, when the cover film 51 is not restored in the remanufacture, the back side of the development blade 9*d* (side opposite to development roller 9*c* with respect to development blade 9*d*), and the adjacencies of the toner stirring member 9*e* and rod antenna 9*h*, are filled with toner, making it necessary for the development roller unit G, and the gap between the development blade 9*d* and developing means holding frame 12, to be sealed well enough to prevent toner from leaking even during process cartridge shipment.

In the process cartridge remanufacture in this embodiment, instead of restoring the cover film 51, the development roller unit G, and the gap between the development blade 9*d* and developing means holding frame 12, are better sealed; they are sealed so that even without the presence of the cover film 51, toner is prevented from leaking during process cartridge shipment.

[Process for Separating Development Unit from Cleaning Unit]

Next, the process for separating the development unit D from the cleaning unit C will be described. As described before, the developing means holding frame 12 and drum holding frame 13 are held together by the connective members 22 put through the holes 20 of the left and right arm portion 19 of the developing means holding frame 12, and the left and right holes 13*e* of the drum holding frame 13. Therefore, all that is necessary to separate the developing means holding frame 12 from the drum holding frame 13 is to pull out the connective members 22; it is very simple to separate the two frames 12 and 13 from each other. As for the tool for pulling out the connective members 22, a special pulling tool designed in accordance with the shape of the process cartridge B, or an all-purpose tool such as a nipper, a radio plier, etc., is used. After the separation, the development unit D and cleaning unit C appear as shown in FIGS. 9 and 10, respectively.

[Process for Removing Development Roller]

The development roller unit G is supported by the bearing box 9*v* and the driving force transmission unit DG attached to the side walls 12B and 12A, respectively, of the developing means holding frame 12, as described in Sub-section [Developing Means Holding Frame] with reference to FIGS. 11, 12, and 14. Therefore, all that is necessary to remove the development roller unit G from the developing means holding frame 12 is to remove the unshown small screws solidly holding the bearing box 9*v* and the driving force transmission unit DG to the side walls 12B and 12A, respectively, of the developing means holding frame 12 and remove the bearing box 9*v* and driving force transmission unit DG from the developing means holding frame 12, so that the development roller unit G can be pulled up.

[Process for Removing Development Blade]

Also described in Sub-section [Developing Means Holding Frame], the development blade 9*d* is held to the flat surface 12*i*, as a blade mount, shown in FIG. 11, of the developing means holding frame 12, by its metallic plate 9*d*1, with the small screws 9*d*6 put through the holes 9*d*4 of the metallic plate 9*d*1 and screwed into the female-threaded holes 12*i*2 in the flat surface 12*i*. Thus, all that is necessary to remove the development blade 9*d* from the developing means holding frame 12 is to remove the small screws 9*d*6 with the use of a screwdriver or the like, and lift the development blade 9*d* from the flat surface 12*i* as a blade mount.

[Process for Removing Thin Elastic Sealing Member]

Figure 22:
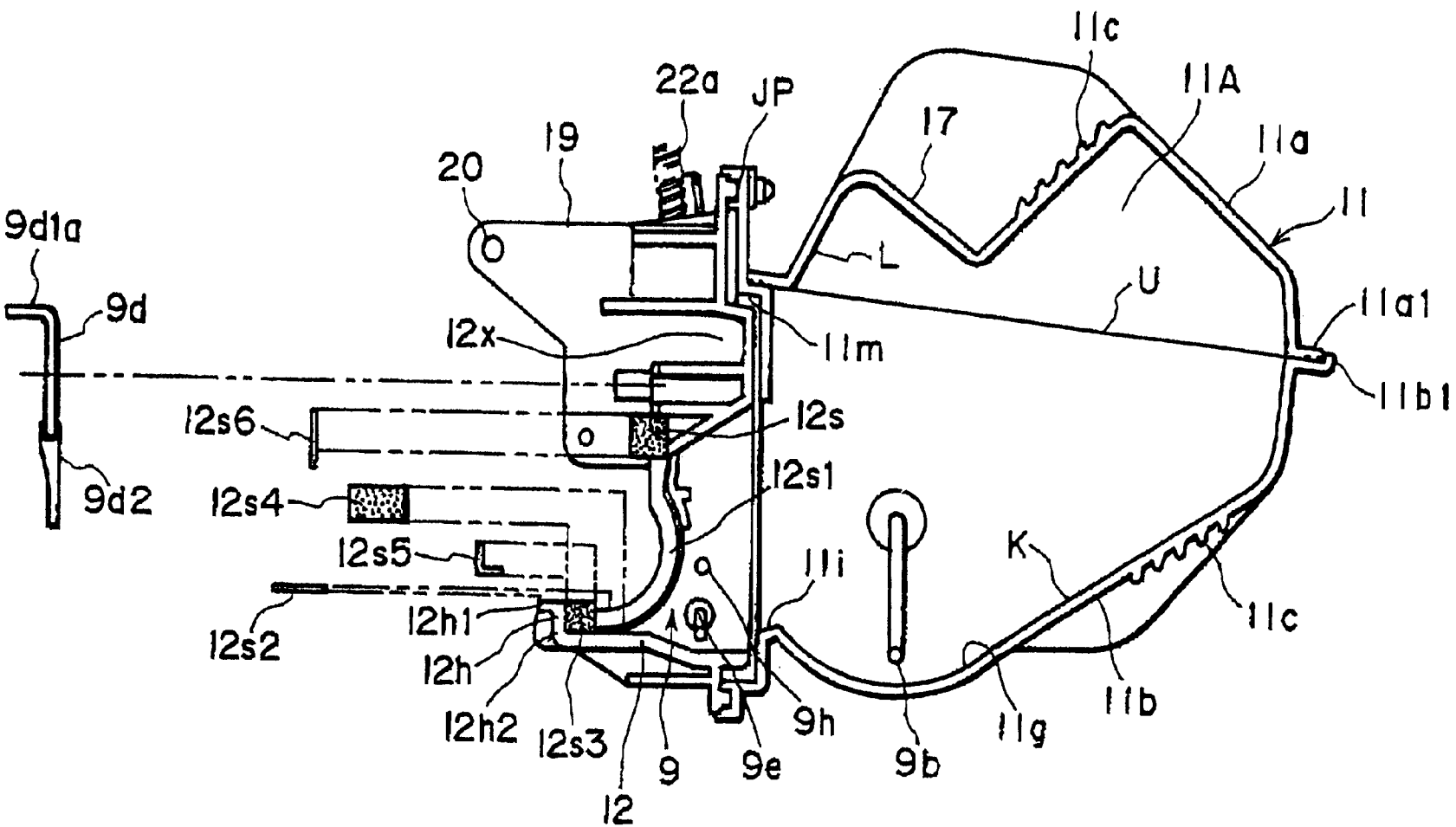
FIG. 22 is a sectional view of the partially disassembled process cartridge, for describing the process for attaching the components which must be attached in this process cartridge remanufacturing method in accordance with the present invention.

Referring to FIGS. 2 and 11, in order to seal the gap extending in the lengthwise direction between the developing means holding frame 12 and development roller 9*c*, the thin elastic sealing member 12*s*2 is pasted to the mandible-like portion 12*h* (precisely speaking, elastic seal pasting surface 12*h*1 of riser-portion 12*h*2 in FIG. 22), being tangentially placed on the peripheral surface of the development roller 9*c*. This thin elastic sealing member 12*s*2 is pasted to the mandible-like portion 12*h*, by one surface, with the use of pasting means such as a piece of two-sided adhesive tape, etc., and is placed in contact with the peripheral surface of the development roller 9*c*, by the opposite surface, in terms of its widthwise direction (being compressed in its widthwise direction) to seal the gap.

When remanufacturing the process cartridge B, it is necessary to replace the original thin elastic sealing member 12*s*2 with an elastic sealing member (12*s*2) which is thicker, in terms of the direction in which it is compressed, than the original sealing member 12*s*2. Thus, all that is necessary to peel the original thin elastic sealing member 12*s*2 is to pull the sealing member 12*s*2 by pinching the sealing member 12*s*2, by the side in contact with the development roller 9*c*, with the use of a pair of tweezers or the like, after the separation of the development roller unit G. When the adhesive from the two-sided adhesive tape is found adhering to the mandible-like portion 12*h* after the peeling of the sealing member 12*s*2, it should be wiped away with the use of a wiping means soaked with alcohol or the like.

The reason why the thin sealing member 12s2 should be replaced with a sealing member (12s2) thicker in terms of the direction in which it is compressed will be described later.

[Process for Attaching Thin Plate]

Figure 23:
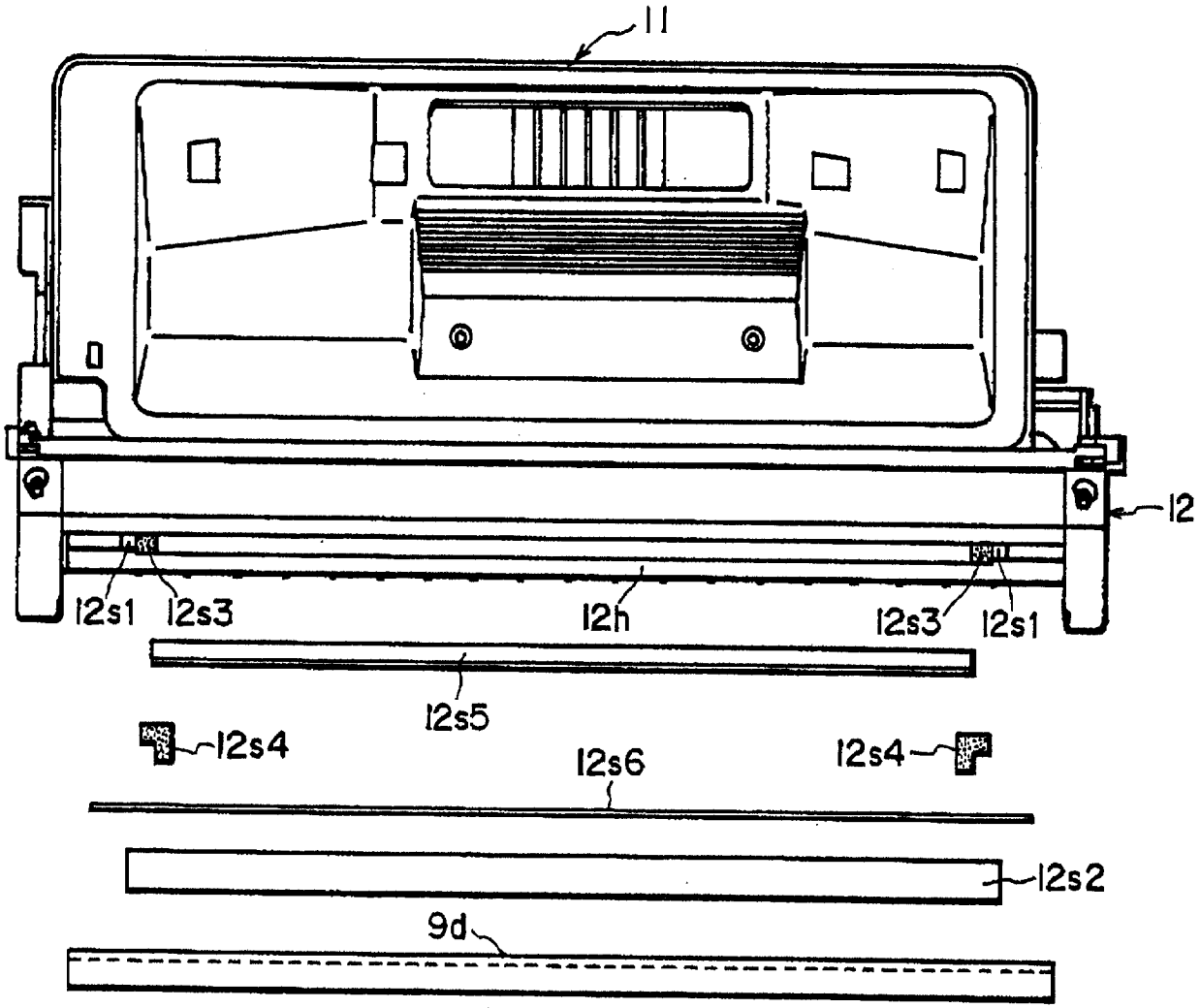
FIG. 23 is a top plan view of the partially disassembled process cartridge, for describing the process for attaching the components which must be attached in this process cartridge remanufacturing method in accordance with the present invention.

As described before, in the process cartridge remanufacture in this embodiment, the cover film 51 is not restored. Therefore, a new measure must be adopted for preventing toner from leaking through the gap between the development roller unit G and developing means holding frame 12. One of such measures is to paste a piece of a thin plate on the lengthwise development blade seal which is providing sealing between the developing means holding frame 12 and development blade 9*d*. FIG. 22 is a sectional view of the combination of the developing means holding frame 12 and toner storage frame 11, for describing the process in which various new components, as means for preventing toner from leaking during process cartridge remanufacture, are attached to the developing means holding frame 12. FIG. 23 is a plan view of the combination of the developing means holding frame 12 and the new components in FIG. 22, prior to the attachment of the new component to the developing means holding frame 12. In FIGS. 22 and 23, a referential code 12s6 designates the thin plate for enhancing the effectiveness of the elastic sealing member 12*s* as a lengthwise development blade seal. The thin plate 12s6 is formed of polyethylene terephthalate or the like, and is pasted to the top surface of the elastic sealing member 12*s* with the use of adhering means such as two-sided adhesive tape, adhesive, etc. The thin plate 12s6 is equal in dimension, in terms of the lengthwise direction, to that of the elastic sealing member 12*s*, and is greater in dimension, in terms of the widthwise direction, than the elastic sealing member 12*s*. Thus, it is pasted to the elastic sealing member 12*s* in such a fashion that it overhangs toward the development roller 9*c* from the elastic sealing member 12*s* by the length equal to the difference in the widthwise dimension between thin plate 12s6 and elastic sealing member 12*s*. The thin plate 12s6 plays the role of increasing the amount by which the elastic sealing member 12*s* formed of Moltprene or the like is compressed, to better seal between the development blade 9*d* and developing means holding frame 12, and also, to block the toner particles which come through the elastic sealing member 12*s*.

[Process for Attaching Reinforcing Member]

Figure 24:
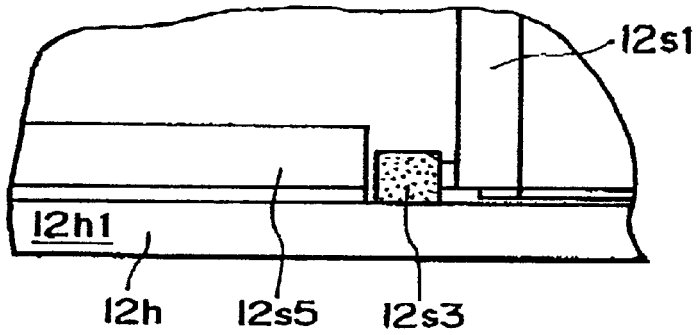
FIG. 24 is an enlarged top view of a reinforcement member which is not present in a brand-new process cartridge and is attached during this process cartridge remanufacturing method in accordance with the present invention, and its adjacencies, for describing the process for attaching the reinforcement member.
Figure 25:
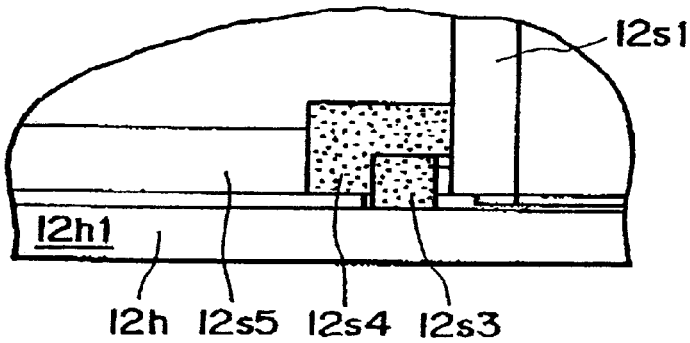
FIG. 25 is an enlarged top view of a second auxiliary development roller end seal which is not present in a brand-new process cartridge and is attached during this process cartridge remanufacturing method in accordance with the present invention, and its adjacencies, for describing the process for attaching the second auxiliary development roller end seal.
Figure 26:
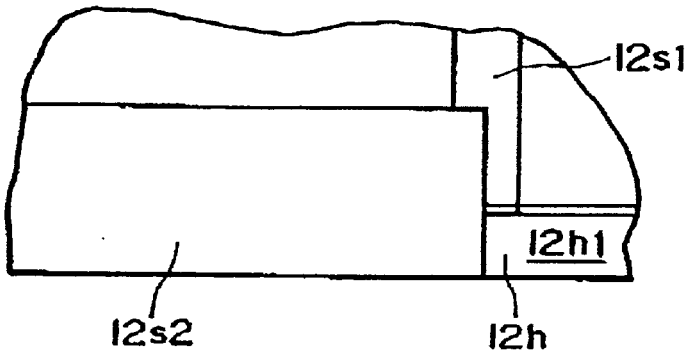
FIG. 26 is an enlarged top view of one of the end portions of the thin elastic sealing member, and its adjacencies, for describing the process for reattaching the thin elastic sealing member.
Figure 29:
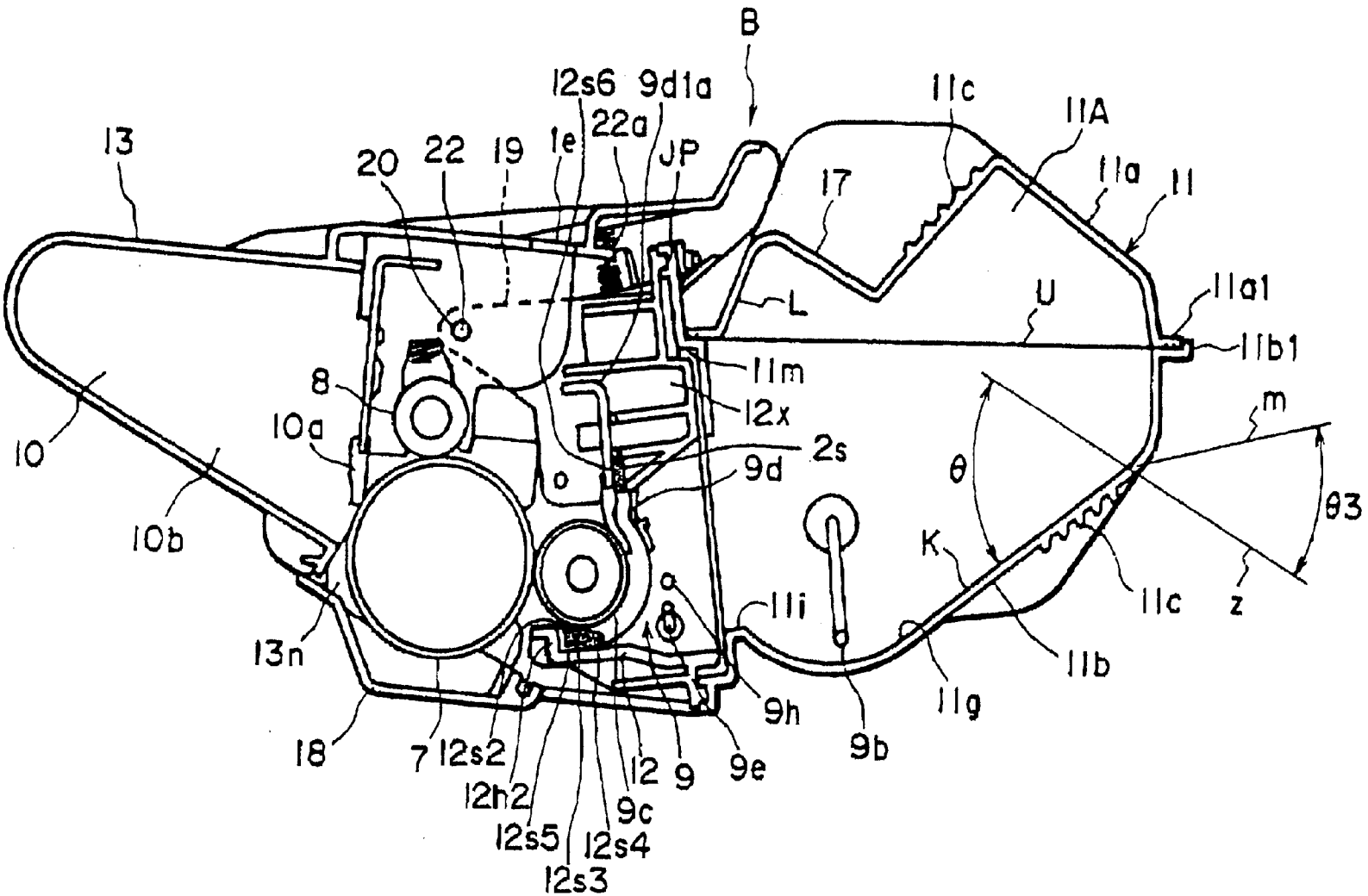
FIG. 29 is a vertical sectional view of the process cartridge remanufactured using one of the process cartridge remanufacturing methods in accordance with the present invention.

FIGS. 24–26 are enlarged views of the end portions of the magnetic sealing member 12s1 and its adjacencies in FIG. 23, as seen from above. In FIGS. 22, 23, and 24, a referential code 12s5 designates a reinforcing member for reducing the deformation of the mandible-like portion 12*h*. There are times when the mandible-like portion 12*h* elastically bends due to the vibrations or shocks during process cartridge shipment. As the mandible-like portion 12*h* elastically bends, the gap between the mandible-like portion 12*h* and developing means holding frame 12 temporarily widens, making it impossible for the thin elastic sealing member 12s2 to keep the gap satisfactorily sealed, allowing therefore toner to blow out. Thus, the reinforcing member 12s5 is attached to the mandible-like portion 12*h* to prevent the mandible-like portion 12s5 from bending. The reinforcing member 12s5 is formed of a 0.4–1.0 mm thick metallic plate. Its rigidity is increased by bending it so that its cross section becomes L-shaped. It is pasted, with the use of adhering means such as two-sided adhesive tape, adhesive, glue, etc., to the inward corner between the riser- and base-portions of the stepped portion 12*h*2 of the mandible-like portion 12*h*, by the outward surfaces of the two portions of the reinforcing member 12s5, perpendicular to each other, resulting from the bending of the reinforcing member 12s5 in the form of a letter L (FIG. 29). FIG. 24 is an enlarged plan view of the end portion of the reinforcing member 12s5 and its adjacencies, as seen from above. As is evident from the drawing, the reinforcing member 12s5 is attached to the mandible-like portion 12*h* with the provision of a 0–1 mm gap between the reinforcing member 12s5 and a first auxiliary development roller end seal, which will be described later. In other words, the length of the reinforcing member 12s5 is rendered slightly less than the distance between the left and right first auxiliary development end seals. The height of the reinforcing member 12s5 from the base portion of the stepped portion of the mandible-like portion 12*h* is approximately the same as the height of the riser portion, and never exceeds it.

[Process for Attaching Second Auxiliary Development Roller End Seal]

Referring to FIGS. 22–25, designated by a referential code 12s3 is the first auxiliary development roller end seal pasted in advance to the developing means holding frame 12 to prevent toner from leaking from between the magnetic sealing member 12s1 and the thin elastic sealing member 12s2. The first auxiliary development roller end seal 12s3 is in the form of a parallelepiped or cube, and is formed of Moltprene. It is pasted to the inward side of the developing means holding frame 12, to the area to be covered by the thin elastic sealing member 12s2, or to the area immediately next to the opposite end of the magnetic sealing member 12s1 with respect to the elastic sealing member 12*s*, with the use of two-sided adhesive tape (two seals 12s3 are pasted at left and right lengthwise ends, one for one). In order to add to the effectiveness of this first auxiliary development roller end seal 12s3, a second auxiliary development roller end seal 12s4 is pasted to the developing means holding frame 12. The second auxiliary development roller end seal 12s4 is L-shaped as shown in FIG. 23. Referring to FIG. 24 which is an enlarged plan view of the second auxiliary development roller end seal 12s4 as seen from above after its attachment, the inward side, in terms of its L-shape, of the second auxiliary development roller end seal 12s4 is placed exactly in contact with the first auxiliary development roller end seal 12s3, in a manner to surround the first auxiliary development roller end seal 12s3, and is pasted, with the use of pasting means such as two-sided adhesive tape, adhesive, etc., to the developing means holding frame 12, to the area which will be described next. In other words, the second auxiliary development roller end seal 12s4 is pasted in a fashion to straddle the first auxiliary development roller end seal 12s3, with one end on the reinforcing member 12s5 and the other on developing means holding frame 12.

[Process for Attaching Thin Elastic Sealing Member]

Next, the thin elastic sealing member 12s2 having been peeled in [Process for Removing Thin Elastic Sealing Member] is reattached. The reason why the thin elastic sealing member 12s2 was peeled was for improving the efficiency for [Process for Attaching Reinforcing Member] and [Process for Attaching Second Auxiliary Development Roller End Seal], and for preventing the thin elastic sealing member 12s2 from being rolled up. To describe the phenomenon that the thin elastic sealing member 12s2 is rolled up, as described before, the thin elastic sealing member 12s2 is pasted, by one side, to the mandible-like portion 12*h* with the use of pasting means such as two-sided adhesive tape, etc., and is elastically placed in contact with the peripheral surface of the development roller 9*c*, by the other side (being compressed in its thickness direction) to seal between the development roller 9*c* and mandible-like portion 12*h*. To describe this in more detail, referring to FIG. 2, the development roller 9*c* is rotated in the clockwise direction, and the thin elastic sealing member 12*s*2 is pasted, by its upstream side, in terms of the moving direction of the peripheral surface of the development roller 9*c*, to the thin elastic sealing member pasting surface 12*h*1. In other words, the thin elastic sealing member 12*s*2 is pasted in compliance with the rotation direction of the development roller 9*c*. As the body of the toner under the development roller 9*c* moves toward the interface between the development roller 9*c* and thin elastic sealing member 12*s*2 (mandible-like portion 12*h*), that is, in the direction to leak from between the development roller 9*c* and the mandible-like portion 12*h*, the free end (other end) of the thin elastic sealing member 12*s*2 is pressed upon the peripheral surface of the development roller 9*c* by the pressure generated by the movement of the body of the toner under the development roller 9*c* (which sometimes is called toner pressure), sealing between the thin elastic sealing member 12*s*2 and peripheral surface of the development roller 9*c*. Thus, it is possible that if an excessive amount of toner pressure is applied to the thin elastic sealing member 12*s*2 due to the vibrations or shocks during shipment, the free end portion of the thin elastic sealing member 12*s*2 will be bent inward of the riser-portion 12*h*2 of the stepped portion of the mandible-like portion 12*h*. This inward bending of the thin elastic sealing member 12*s*2 is the phenomenon referred to as "being rolled up". The thin elastic sealing member 12*s*2 in the "rolled-up" condition does not function as a seal, allowing the toner to blow out from between the development roller 9*c* and mandible-like portion 12*h*. In order to prevent the thin elastic sealing member 12*s*2 from being rolled up, the dimension of the replacement elastic sealing member 12*s*2, in terms of the widthwise direction, is rendered greater than that of the original thin elastic sealing member 12*s*2. In this embodiment, the original thin elastic sealing member 12*s*2 is 8 mm in width and the replacement elastic sealing member 12*s*2 pasted during the process cartridge remanufacture is 15 mm in width. FIGS. 22 and 23 are drawings for showing the process for pasting the replacement elastic sealing member 12*s*2. FIG. 26 is an enlarged plan view of one of the lengthwise ends of the replacement elastic sealing member 12*s*2 and its adjacencies, as seen from above. The replacement elastic sealing member 12*s*2 is pasted to the elastic sealing member pasting surface 12*h*1 of the mandible-like portion 12*h*, with the use of adhering means such as two-sided adhesive tape, adhesive, etc., in such a manner that the replacement elastic sealing member 12*s*2 covers reinforcing member 12*s*5, first auxiliary development roller end seal 12*s*3, and second auxiliary development roller end seal 12*s*4, as well as a part of the magnetic sealing member 12*s*1, as shown in FIG. 26.

[Process for Refilling Toner Container with Toner]

Figure 27:
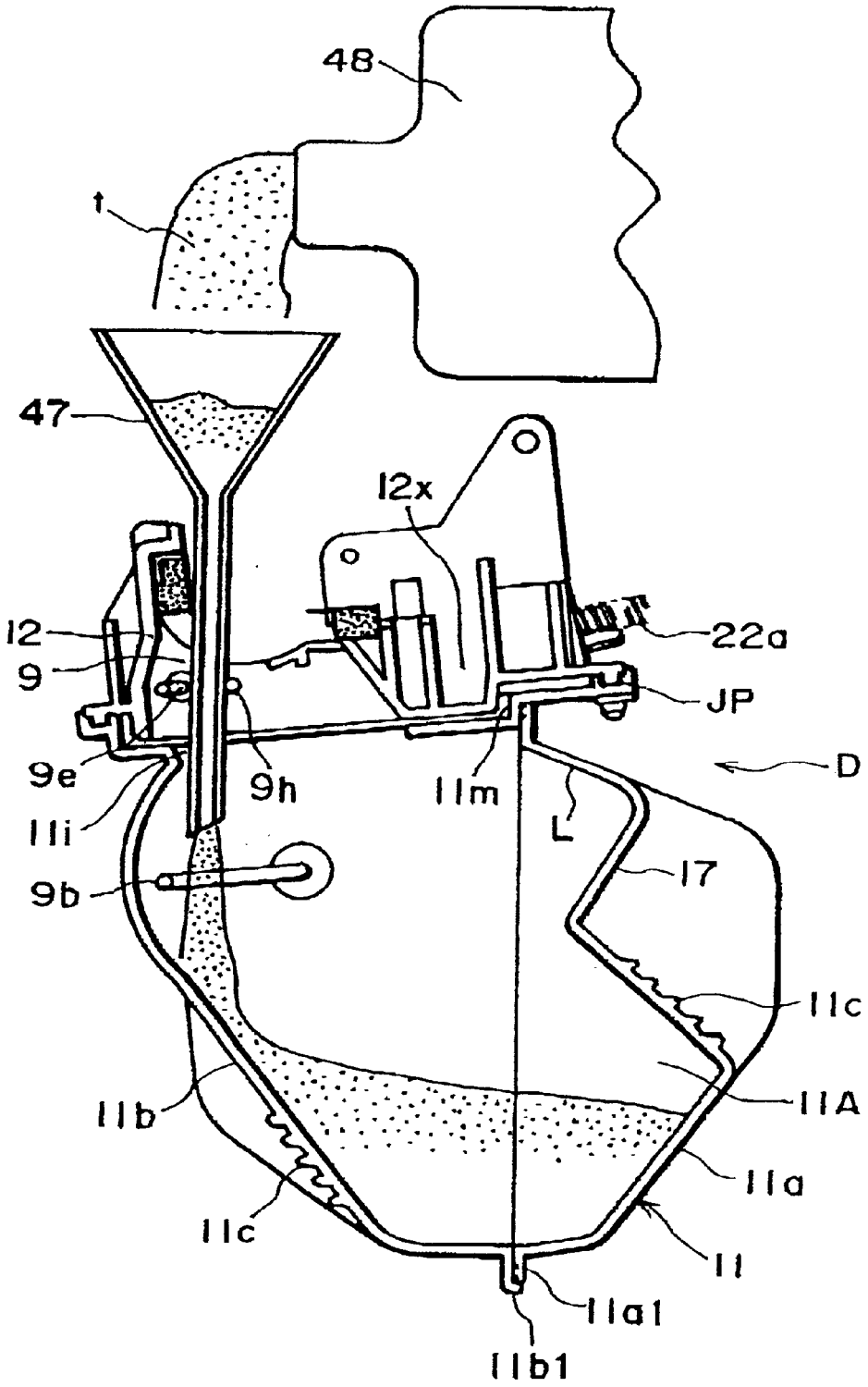
FIG. 27 is a vertical sectional view of the process cartridge for showing the process for refilling the cartridge with toner.

Next, the toner container 11A is refilled with toner. Referring to FIG. 27, toner is filled into the toner container 11A, with the development unit D held so that the opening 11*i* faces upward and the toner container 11A is positioned under of the developing means holding frame 12. The end portion of a funnel 47 is inserted into the toner container 11A through the opening 11*i*, and toner t is poured into the funnel 47 from a toner bottle 48. A measuring feeder having an auger in its funnel-shaped main structure may be employed to improve the toner filling efficiency.

[Process for Reattaching Development Blade]

Next, the development blade 9*d* is reattached in the following manner. First, the toner particles adhering to the development blade 9*d* are blown off by pressurized air or the like. Then, the development blade 9*d* is inversely attached. Inversely attaching the development blade 9*d* means that the development blade 9*d*, which was attached to the developing means holding frame 12 so that the bent portion 9*d*1*a* of the metallic plate 9*d*1 of the development blade 9*d* faced the toner container 11A as shown in FIGS. 2 and 11, is attached so that the bent portion 9*d*1*a* faces the photoconductive drum 7 as shown in FIGS. 22 and 29. The reason for inversely attaching the development blade 9*d* is as follows: As the development roller 9*c* is rotated by the rotation of the photoconductive drum 7, the silicon rubber blade 9*d*2 of the development blade 9*d* regulates the amount of the toner on the peripheral surface of the development roller 9*c* to a predetermined value while giving the toner a predetermined amount of triboelectric charge, as described before. Thus, when the development roller 9*c* is rotating, the silicon rubber blade 9*d*2 is rubbing against the toner, being therefore gradually shaved off by the toner particles. Thus, as the cumulative usage of the process cartridge B increases, the silicon rubber blade 9*d*2 sustains a large number of scars extending in the rotational direction of the development roller 9*c*, on the surface facing the development roller 9*c*. Eventually, these scars develop deep enough to effect image defects such as unwanted lines, nonuniformity in density, etc. It is inevitable that these scars gradually develop as the cumulative usage of the process cartridge B increases. In other words, it is expected that a certain amount of scars will develop. Thus, in consideration of this inevitable development of the scars, the silicon rubber blade 9*d*2 is provided with a substantial amount of margin to prevent such scars from developing deep enough to effect image defects before the toner in the process cartridge B is depleted, that is, before the process cartridge B reaches the end of the so-called service life of the process cartridge B. The normal life of the process cartridge B in terms of the number of A4 size copies printable at a print ratio of, for example, 4% is approximately 10,000 copies. However, there is no guarantee that all users always print at an average print ratio of 4%. Therefore, there is provided a margin large enough to prevent the image defects, even if the average printing ratio remains less than 4%, allowing the process cartridge B to produce more than 10,000 copies. However, when it comes to a situation that a process cartridge used beyond its normal life is remanufactured for another full life of usage, the scars of the silicon rubber blade 9*d*2 sometimes develop beyond the permissible level, effecting the image defects. It is possible to examine all the used silicon rubber blade 9*d*2 for their scars to select those suitable for the remanufacture of the process cartridge B. However, it is not an easy task to count a large number of random scars and/or measure the depths thereof. Further, it requires expensive measuring devices such as a microscope, a surface roughness gauge, etc., and also, a substantial amount of time, which is easy to imagine. Further, even if the examinations are possible, the failed development blades must be replaced with brand-new development blades, adding to the remanufacture cost. This is why we, the inventors of the present invention, decided to inversely reattach the used development blade 9*d*, based on the fact the back surface of the silicon rubber blade 9*d*2 is not rubbed against the toner particles, and therefore, is not scarred by the toner particles. With the inverse attachment, the original silicon rubber blade 9*d*2 can offer a regulating surface as free of scars as that of a brand-new silicon rubber blade 9*d*2.

Figure 30:
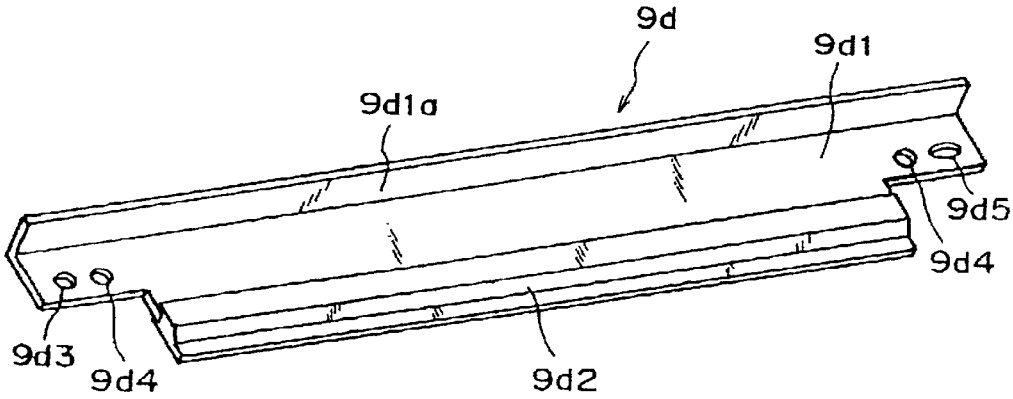
FIG. 30 is an external perspective view of the development blade employed by a process cartridge which can be remanufactured with the use of one of the process cartridge remanufacturing methods in accordance with the present invention.

Referring to FIGS. 27 and 11, the developing means-holding frame 12 of the process cartridge in this embodiment, which is designed to be remanufactured, is provided with a recess 12*x* for accommodating the bent portion 9*d*1*a* of the metallic plate 9*d*1 when the development blade 9*d* is attached to the developing means holding frame 12 for the first time, that is, when the development blade 9*d* is attached to the developing means holding frame 12 so that the bent portion 9*d*1*a* of the metallic plate 9*d*1 extends toward the toner container 11A. Referring to FIG. 30, the development blade 9*d* is rendered symmetrical, except for the positions of the positioning holes 9*d*3 and elongated hole 9*d*5, with respect to its center line perpendicular to the lengthwise direction. Thus, in order to make it possible for the development blade 9*d* to be inversely reattached, the metallic plate 9*d*1 is provided with the hole 9*d*3, screw hole 9*d*4 and elongated hole 9*d*5, which correspond to the joggles 12*i*1 on the lengthwise end portions, one for one, of the flat surface 12*i*, as a blade mount, of the developing means holding frame 12, and the screw holes 12*i*2 in the lengthwise end portions of the developing means holding frame 12. Therefore, as the development blade 9*d* is inversely reattached, it appears as if the positioning holes 9*d*3, on the right, and elongated hole 9*d*5, on the left, simply trade their positions. In other words, even if the development blade 9*d* is inversely placed, it can be reattached as precisely as was originally. The process for inversely reattaching the development blade 9*d* is similar to the above described process for attaching it for the first time. That is, the metallic plate 9*d*1 is solidly fixed to the flat surface 12*i* by screwing the small screws 9*d*6 into the female-threaded holes 12*i*2 after putting the screws 9*d*6 through the screw holes 9*d*4 of the metallic plate 9*d*1. As described before, in this embodiment, when a brand-new process cartridge B is assembled, the development blade 9*d* is attached to the developing means holding frame 12 in such a manner that the bent portion 9*d*1*a* of the metallic plate 9*d*1 of the development blade 9*d* extends toward the toner container 11A, whereas when the same process cartridge B is remanufactured, the same development blade 9*d* is reattached to the developing means holding frame 12 in such a manner that the bent portion 9*d*1*a* extends toward the photoconductive drum 7. However, this embodiment is not intended to limit the scope of the present invention. In other words, when the process cartridge B is assembled as a brand-new one, the development blade 9*d* may be attached to the developing means holding frame 12, with the bent portion 9*d*1*a* extending toward the photoconductive drum 7, so that when the same process cartridge B is remanufactured, the same development blade 9*d* can be reattached, with the bent portion 9*da*1 extending toward the toner container 11A. Such a procedural change does not create any problem when carrying out the process cartridge remanufacture process in accordance with the present invention. Further, in this embodiment, the positioning hole 9*d*3, and the elongated hole 9*d*5, of the development blade 9*d* are located on the right and left sides in FIG. 11. It is obvious, however, that switching their positions, that is, placing the hole 9*d*3 and elongated hole 9*d*5 on the left and right side, respectively, does not create any problem when carrying out the process cartridge remanufacture process in accordance with the present invention. Also in this embodiment, the metallic plate 9*d*1 of the development blade 9*d* is provided with the bent portion 9*d*1*a*. However, the provision of the bent portion 9*d*1*a* is not mandatory; even if a flat metallic plate, that is, a metallic plate without the bent portion 9*d*1, is employed as the metallic plate 9*d*1, it does not create any problem when carrying out the process cartridge remanufacture process in accordance with the present invention. When the metallic plate 9*d*1 is flat, the developing means holding frame 12 does not need to have the recess 12*x*. Also in this embodiment, the portion of the development blade 9*d*, which actually contacts the development roller 9*c*, is formed of silicon rubber. However, the selection of the material for this portion does not need to be limited to silicon rubber. For examples synthetic rubber such as urethane rubber, natural rubber, etc., may be used. In other words, any material may be used as long as it is elastic enough to reliably provide a predetermined amount of contact pressure between the development blade 9*d* and development roller 9*c*.

[Process for Reattaching Development Roller]

Next, the development roller unit G is attached. After the development roller 9*c*, spacer rings 9*i*, development roller gear 9*k*, etc., which make up the development roller unit G, are separated from each other, the toner particles adhering thereto are removed with compressed air or the like. Then, each component is examined to determine whether or not it is reusable. Those which do not meet their performance standards are replaced with brand-new ones. However, if it has been discovered during the development process or test period that a given component is high in statistical probability that it will have to be replaced in the process cartridge remanufacture, this component may be automatically replaced with a brand-new one, without examination, provided that the replacement improves remanufacture efficiency. The flange 9*p*, magnet 9*g* put through the development roller 9*c*, journal 9*w*, and coil spring 9*l* as the development bias contact are not separated from the base member of the development roller unit G. After being reassembled through the above described cleaning and examination, the development roller unit G is reattached to the developing means holding frame 12 by reattaching the bearing box 9*v* and driving force transmission unit DG to the side walls 12B and 12A, respectively, of the developing means holding frame 12 by screwing the unshown small screws into the side walls, as they were when the process cartridge B was assembled as a brand-new one.

[Process for Remanufacturing Cleaning Unit]

Next, the cleaning unit is remanufactured. Referring to FIGS. 8 and 9, the photoconductive drum 7 is provided with the drum flange 36 and spur gear 7*n*, which are attached to the lengthwise ends of the photoconductive drum 7, one for one, by crimping, gluing, or the like. The drum flange 36 and spur gear 7*n* are rotationally supported by the bearing 38 and the flange 29, respectively, attached to the cleaning means holding frame 13. The flange 29 integrally comprises the drum shaft 7*a*, the large diameter portion 7*a*2, and the cylindrical guide 13*a*L. The bearing 38 is attached to the cleaning means holding frame 13 with the use of the small screws 13*a*R2 as shown in FIG. 19, and the flange 29 is attached to the cleaning means holding frame 13 with the use of the small screws 13*d* as shown in FIG. 8. Thus, the photoconductive drum 7 can be removed by removing the bearing 38 and flange 29.

Figure 28:
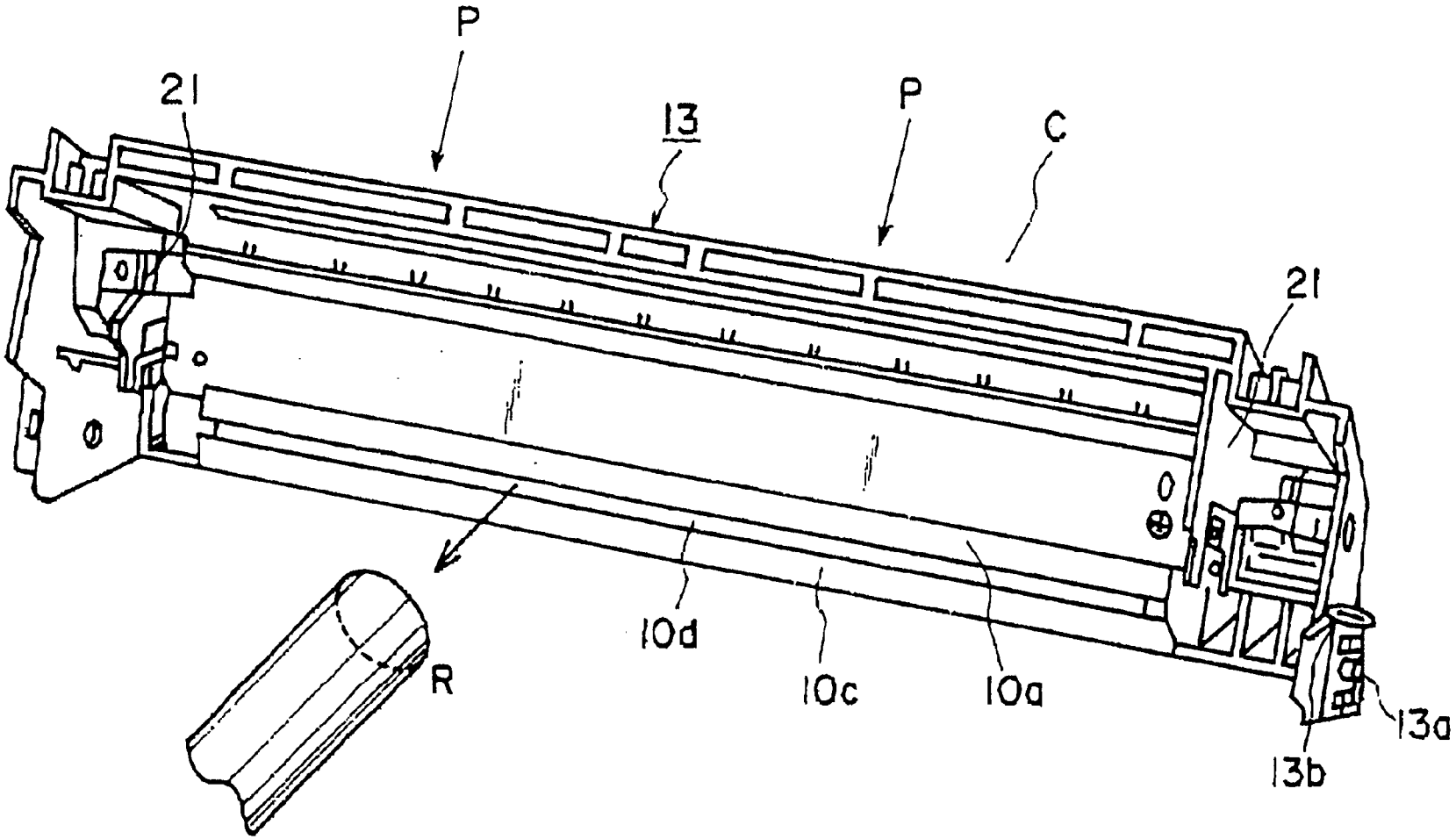
FIG. 28 is a perspective view of the cleaning means holding frame for describing the process for cleaning the cleaning means holding frame.

Next, referring to FIG. 28, the cleaning unit C, from which the photoconductive drum 7 has been removed, is securely held to the top surface of an appropriate table. Then, the opening of the nozzle R of a vacuuming apparatus (unshown) is manually held pressed against the gap 10*d* between the cleaning blade 10*a* and toner catching sheet 10*c* of the cleaning unit C. Then, the nozzle R is horizontally moved along the gap 10*d*, while tapping the top surface of the cleaning unit C, on the portion indicated by an arrow mark P, to remove the residual toner in the cleaning unit C by suction. After the suctioning of the residual toner out of the cleaning unit C, the cleaning blade 10*a* and toner catching sheet 10*c* are removed from the cleaning unit C, and the interiors of the cleaning means holding frame 13 and residual toner bin 10*b* are cleaned with compressed pressure air or the like. The toner particles adhering to the removed photoconductive drum 7 and cleaning blade 10*a* are removed by blowing air or the like on them. Then, the photoconductive drum 7 and cleaning blade 10*a* are examined to determine whether or not they can be reused. Those which do not meet their performance standards are replaced with brand-new ones. However, if it has been proven through the development process or test period that a given component is high in statistical probability that it will have to be replaced in the process cartridge remanufacture, this component may be automatically replaced with a brand-new one, without examination, since such automatic replacement sometimes improves the process cartridge remanufacture efficiency. After the attachment of a brand-new or cleaned original cleaning blade 10*a*, and a brand-new toner catching sheet 10*c*, to the cleaning means holding frame 13, a brand-new or cleaned original photoconductive drum 7 is rotationally attached to the cleaning means holding frame 13 by attaching the bearing 38 and flange 29 to the cleaning means holding frame 13 with the use of the small screws 13*a*R2 (FIG. 19) and 13*d* (FIG. 8).

[Process for Reconnecting Development Unit and Cleaning Unit]

Next, the development unit D remanufactured through the [Process for Removing Development Roller Unit], [Process for Removing Development Blade], [Process for Removing Thin Elastic Sealing Member], [process for Attaching Thin Plate], [Process for Attaching Reinforcing Member], [Process for Attaching Second Auxiliary Development Roller End Seal], [Process for Attaching Thin Elastic Sealing Member], [Process for Refilling Toner Container], [Process for Reattaching Development Blade], and [Process for Reattaching Development Roller Unit] after the separation of the development unit D from the cleaning unit C, and the cleaning unit C remanufactured through [Process for Remanufacturing Cleaning Unit] after the separation of the development unit D from the cleaning unit C, are reconnected following in reverse the steps in [Process for Separating Development Unit from Cleaning Unit]. In other words, as was described in Section {Structure of Housing of Process Cartridge B}, the end portion of each of the two arm portions 19 of the lengthwise (axial direction of development roller 9*c*) end portions of the developing means holding frame 12 shown in FIG. 10 is inserted into the corresponding recess 21, shown in FIG. 9, provided in each of the lengthwise end portions of the cleaning means holding frame 13 to accommodate the arm portions 19, and the connective members 22 are pressed through the holes 13*e* of the outward side walls of the cleaning means holding frame 13, are put through the holes 20 of the arm portions 19, and then, are pressed into the holes 13*e* of the inward side walls of the cleaning means holding frame 13, so that the development unit D and cleaning unit C are connected to each other, being allowed to pivot about the connective members 22.

Described above are the essential processes in the process cartridge remanufacturing method in accordance with the present invention. However, the above described embodiment of the present invention is only one example of the process cartridge remanufacturing method in accordance with the present invention, comprising the various processes also described above, and is not intended to limit the scope of the present invention. In other words, the present invention is also applicable to various procedures and methods for process cartridge remanufacture other than those described above. Hereinafter, the preceding description of the embodiment of the present invention will be supplemented for the correct understanding of the process cartridge remanufacturing method in accordance with the present invention.

First, in the preceding description of the embodiment of the present invention, [Process for Remanufacturing Cleaning Unit] was described after the [Process for Reattaching Development Roller Unit]. This, however, does not mean that [Process for Remanufacturing Cleaning Unit] must always be carried out after [Process for Reattaching Development Roller Unit]. Since the development unit and cleaning unit are separated in [Process for Separating Development Unit from Cleaning Unit], [Process for Reattaching Development Roller Unit] and [Process for Remanufacturing Cleaning Unit] can be independently carried out. Obviously, the two processes may be simultaneously carried out, or one of them may be carried out before the other. Similarly, [Process for Attaching Thin Plate] may be carried out after [Process for Reattaching Development Blade], and the ordinal reversal creates no problem.

Secondly, in [Process for Refilling Toner Container with Toner], toner is filled into the toner container 11A through the opening 11*i*, as shown in FIG. 27, between the [Process for Attaching Thin Elastic Sealing Member] and [Process for Reattaching Development Blade]. This, however, does not mean that the opening through which toner is filled into the toner container 11A must be limited to the opening 11*i*. For example, the toner may filled through the toner filling opening 11*d* of the toner storage frame 11. In such a case, if the opening 11*i* is left exposed, toner will leak as it is filled into the toner container 11A. Therefore, from the standpoint of operational efficiency, it is preferable that the toner container 11A is refilled with toner after [Process for Reattaching Development Roller Unit].

Thirdly, the development blade and development roller unit removed from the development unit, and the photoconductive drum and cleaning blade removed from the cleaning unit, are not always reattached to the very development unit and cleaning unit, respectively, from which they were removed. In other words, when a process cartridge is remanufactured using the so-called flow production method, that is, using a production line or the like, several development blades removed from the development unit are placed together in a tote box or the like, are cleaned with compressed pressure air, and are delivered to the development blade reattachment point. Therefore, they are not always reattached to the very development unit from which they were removed. As long as all the development blades belong to the same model type, it is unnecessary that each development blade is reattached to the very development unit from which it was removed, because they are identical in configuration except for the presence of the dimensional tolerance. The same logic also applies to the development roller unit, the photoconductive drum, as well as the cleaning blade. Further, because of the same reason, the development units are not always reconnected to the very cleaning units from which they were separated, and it is also unnecessary that the development units are reconnected to the very cleaning units from which they were separated.

Further, it is obvious that the above described various processes may be automated with the use of robots as necessary. Not only is the present invention applicable to a process cartridge such as the above described process cartridge B for forming monochromatic images, but also a process cartridge which comprises a plurality of developing means 9 and is capable of forming multicolor images (for example, two-color images, three-color images, full-color images, etc.) in addition to monochromatic images. Further, in the first embodiment, the so-called contact charging method was employed. It is obvious, however, that a non-contact charging method may be employed in place of the so-called contact charging method. As for the noncontact charging method, there is a method, for example, in which a piece of tungsten wire is surrounded from three sides by a metallic shield formed of aluminum or the like, and positive or negative ions generated by the application of high voltage to the tungsten wire are transferred onto the peripheral surface of the photoconductive drum 7 to uniformly charge it. As for the charging means, a blade type charging means (charge blade), a pad type charging means, a block type charging means, a rod type charging means, a wire type charging means, or the like may be employed in place of the above described roller type charging means. As for the method for removing the toner particles remaining on the photoconductive drum 7, a fur brush type cleaning means, a magnetic brush type cleaning means, or the like, may be employed in place of the cleaning blade. Further, in the preceding description of the embodiment of the present invention, a process cartridge is a cartridge in which an image bearing member and a single or plurality of developing means are integrally disposed, and which is removably mountable in the main assembly of an image forming apparatus. In other words, the above described process cartridge B may be a process cartridge in which a charging means, a developing or cleaning means, and an electrophotographic photoconductive member are integrally disposed, and which is removably mountable in the main assembly of an image forming apparatus, or a process cartridge in which at least a developing means and an electrophotographic photoconductive member are integrally disposed, and which is removably mountable in the main assembly of an image forming apparatus. Moreover, in the above described embodiment of the present invention, a laser beam printer was referred to as an example of an image forming apparatus. However, the application of the present invention does not need to be limited to a laser beam printer. Obviously, the present invention is also applicable to image forming apparatuses other than a laser beam printer; for example, an LED printer, an electrophotographic copying machine, a facsimileing apparatus, a wordprocessor, etc.

The above described embodiment of the present invention includes a process cartridge remanufacturing method, in which a plurality of process cartridges, the service lives of which have expired, are recovered and disassembled; the various components removed from the process cartridges by the disassembly are sorted; and a plurality of process cartridge are remanufactured using the components removed from the recovered used process cartridges, or new components (replacements for components which cannot be reused) if necessary, and by using the above described process cartridge remanufacturing method. It also includes a process cartridge remanufacturing method, in which a plurality of process cartridges, the service lives of which have expired, are recovered; each used process cartridge is discretely disassembled; and the process cartridge is remanufactured using only the very components removed from the process cartridge, combination of the components from the very process cartridge and brand-new components, or combination of the components from the very process cartridge and the components from other recovered process cartridges, and by using the above described process cartridge remanufacturing method.

As described above, the present invention is the realization of a simple process cartridge remanufacturing method.

While the invention has been described with reference to the structures disclosed herein, it is not confined to the details set forth, and this application is intended to cover such modifications or changes as may come within the purposes of the improvements or the scope of the following claims.

What is claimed is:

1. A remanufacturing method for a process cartridge detachably mountable to a main assembly of an electrophotographic image forming apparatus, the process cartridge including a first frame supporting an electrophotographic photosensitive drum and a second frame supporting a developing roller for developing an electrostatic latent image formed on the electrophotographic photosensitive drum and accommodating developer to be used by the developing roller to develop the electrostatic latent image, the first frame and the second frame being rotatably coupled, the method comprising:

(a) a frame separating step of separating the first frame and the second frame, from each other;

(b) a developing blade dismounting step of dismounting, from the second frame, a developing blade which is mounted on the second frame to regulate an amount of the developer deposited on the developing roller;

(c) a thin plate sheet material mounting step of mounting a thin sheet material on such a side of a longitudinal seal, for providing a seal extending between the first frame and the second frame in a longitudinal direction of the second frame, that is opposite from a side mounted to the second frame;

(d) a developer filling step of filling the developer into a developer accommodating portion of the process cartridge;

(e) a developing blade mounting step of mounting the developing blade in a facing orientation which is opposite from a facing orientation in which the developing blade has been mounted on the second frame; and (f) a frame coupling step of coupling the separated first frame and second frame.

2. A method according to claim 1, further comprising a developing roller dismounting step of dismounting the developing roller from the second frame prior to said developing blade dismounting step, and a developing roller mounting step of mounting the developing roller to the second frame prior to said frame coupling step and after said developing blade mounting step.

3. A remanufacturing method for a process cartridge detachably mountable to a main assembly of an electrophotographic image forming apparatus, the process cartridge including a first frame supporting an electrophotographic photosensitive drum and a second frame supporting a developing roller for developing an electrostatic latent image formed on the electrophotographic photosensitive drum and accommodating developer to be used by the developing roller to develop the electrostatic latent image, the first frame and second frame being rotatably coupled, said method comprising:

(a) a frame separating step of separating the first frame and the second frame from each other;

(b) a developing roller dismounting step of dismounting the developing roller mounted on the second frame;

(c) an elastic sealing member dismounting step of dismounting a thin elastic sealing member providing a seal extending between the second frame and the developing roller in a longitudinal direction of the second frame;

(d) a reinforcing member mounting step of mounting a reinforcing member adjacent a portion of the second frame on which the elastic sealing member is mounted so as to extend in a longitudinal direction of the second frame, the reinforcing member being effective to reinforce the portion;

(e) an end assistance seal mounting step of mounting a second auxiliary end seal for the developing roller so as to enclose a part of a first auxiliary end seal for the developing roller which is mounted to be covered by the thin elastic sealing member inside a developing roller end seal provided at each of the end portions of the developing roller mounted to the second frame;

(f) an elastic sealing member mounting step of mounting the thin elastic sealing member;

(g) a developer filling step of filling the developer into a developer accommodating portion of the process cartridge;

(h) a developing roller mounting step of mounting the developing roller to the second frame; and (I) a frame coupling step of coupling the separated first frame and second frame.

4. A method according to claim 3, further comprising:

a developing blade dismounting step of dismounting a developing blade from the second frame immediately after said developing roller dismounting step; and a developing blade mounting step of mounting the developing blade on the second frame prior to said developing roller mounting step.

5. A remanufacturing method for a process cartridge detachably mountable to a main assembly of an electrophotographic image forming apparatus, the process cartridge including a first frame supporting an electrophotographic photosensitive drum and a second frame supporting a developing roller for developing an electrostatic latent image formed on the electrophotographic photosensitive drum and accommodating developer to be used by the developing roller to develop the electrostatic latent image, the first frame and the second frame being rotatably coupled, said method comprising:

(a) a frame separating step of separating the first frame and the second frame from each other;

(b) a developing roller dismounting step of dismounting the developing roller mounted on the second frame;

(c) a developing blade dismounting step of dismounting, from the second frame, a developing blade which is mounted on the second frame to regulate an amount of the developer deposited on the developing roller;

(d) an elastic sealing member dismounting step of dismounting a thin elastic sealing member providing a seal extending between the second frame and the developing roller in a longitudinal direction of the second frame;

(e) a thin plate sheet material mounting step of mounting a thin sheet material on such a side of a longitudinal seal, for providing a seal extending between the first frame and the second frame in a longitudinal direction of the second frame, that is opposite from a side mounted to the second frame;

(f) a reinforcing member mounting step of mounting a reinforcing member adjacent a portion of the second frame on which the elastic sealing member is mounted so as to extend in a longitudinal direction of the second frame, the reinforcing member being effective to reinforce the portion;

(g) an end assistance seal mounting step of mounting a second auxiliary end seal for the developing roller so as to enclose a part of a first auxiliary end seal for the developing roller which is mounted to be covered by the thin elastic sealing member inside a developing roller end seal provided at each of the end portions of the developing roller mounted to the second frame;

(h) an elastic sealing member mounting step of mounting the thin elastic sealing member;

(i) a developer filling step of filling a developer into a developer accommodating portion of the process cartridge;

(j) a developing blade mounting step of mounting the developing blade in a facing orientation which is opposite from a facing orientation in which the developing blade has been mounted on the second frame;

(k) a developing roller mounting step of mounting the developing roller on the second frame; and (l) a frame coupling step of coupling the separated first frame and second frame.

6. A method according to claim 1, 2 or 5, wherein a width of the thin sheet material is larger than a width of the longitudinal seal of the developing blade and protrudes toward the developing roller.

7. A method according to any one of claims 3–5, wherein the reinforcing member has an L-shaped cross-section.

8. A method according to any one of claims 3–5, wherein the second auxiliary end seal is made of an elastic material and has an L-shaped cross-section.

9. A method according to any one of claims 3–5, wherein the elastic sealing member mounted in said elastic sealing member mounting step has a width larger than a width of the elastic sealing member that was mounted to the process cartridge.

10. A method according to any one of claims 3–5, wherein the second auxiliary end seal extends between the second frame and the reinforcing member.

11. A method according to claim 1, 2, or 5, wherein the thin sheet material is mounted by means of a double coated adhesive tape.

12. A method according to any one of claims 3–5, wherein at least one of the reinforcing member, the second auxiliary end seal, and the thin elastic sealing member is mounted by means of a double coated adhesive tape.

13. A method according to claim 1, 2, 4 or 5, wherein the developing blade mounted on the second frame in said developing blade mounting step is that removed from the second frame of the process cartridge or a developing blade dismounted from another process cartridge.

14. A method according to any one of claims 2–5, wherein the developing roller mounted to the second frame in said developing roller mounting step is that dismounted from the second frame of the process cartridge or a developing roller dismounted from another process cartridge.

15. A method according to claim 1, 2, 4, or 5, wherein the developing blade includes a silicone rubber plate and a metal plate member integral therewith and extends in the longitudinal direction thereof at one lateral end thereof, and the developing blade is mounted on the second frame by screws.

16. A method according to claim 1, 2, 4, or 5, wherein a positioning reference in a longitudinal direction of the developing blade relative to the second frame before said developing blade dismounting step is provided at one longitudinal end portion of the process cartridge and a positioning reference in the longitudinal direction of the developing blade relative to the second frame in said developing blade dismounting step is provided at the other longitudinal end portion of the process cartridge.

17. A method according to any one of claims 1–5, wherein a combination of the first frame and the second frame coupled in said frame coupling step is a combination of the first frame and the second frame of the process cartridge or one of random combinations of first frames and second frames separated out of a plurality of process cartridges.

18. A method according to any one of claims 1–5, further comprising a step of dismounting, prior to said frame coupling step, the electrophotographic photosensitive drum and a cleaning blade for removing the developer remaining on the electrophotographic photosensitive drum, from the first frame, and a step of removing from the first frame a developer removed by the cleaning blade from the electrophotographic photosensitive drum.

19. A method according to any one of claims 1–5, wherein the electrophotographic photosensitive drum is replaced with a new electrophotographic photosensitive drum, or the electrophotographic photosensitive drum is reused, wherein the developing roller is replaced with a new developing roller, or the developing roller is reused, wherein a cleaning blade for removing the developer remaining on the electrophotographic photosensitive drum is replaced with a new cleaning blade, or the cleaning blade is reused.

20. A method according to claim 19, wherein the reused electrophotographic photosensitive drum is that dismounted from the first frame of the process cartridge, or an electrophotographic photosensitive drum dismounted from a first frame of another process cartridge.

21. A method according to claim 19, wherein the reused developing roller is that dismounted from the second frame of the process cartridge, or a developing roller dismounted from a second frame of another process cartridge.

22. A method according to claim 19, wherein the reused cleaning blade is that dismounted from the first frame of the process cartridge, or a cleaning blade dismounted from a first frame of another process cartridge.

23. A method according to any one of claims 1–5, wherein in said developer filling step, the developer is filled through a developer supply opening for supplying the developer to the developing roller from the developer accommodating portion.

24. A method according to any one of claims 1–5, wherein said method is carried out with a sealing member for sealing a developer supply opening being in a pulled out position to supply the developer from the developer accommodating portion to the developing roller.

* * * * *

UNITED STATES PATENT AND TRADEMARK OFFICE

CERTIFICATE OF CORRECTION

PATENT NO. : 6,763,209 B2
DATED : July 13, 2004
INVENTOR(S) : Akira Higeta et al.

It is certified that error appears in the above-identified patent and that said Letters Patent is hereby corrected as shown below:

Column 1,
Line 4, please insert -- BACKGROUND OF THE INVENTION --.

Column 6,
Line 2, “cartridge” should read -- cartridge. --.

Column 16,
Line 15, “out;” should read -- out: --.
Line 37, “frame 11. In” should read -- frame 11 in --.

Column 18,
Line 19, “roller 9c,” should read -- roller 9c; --.

Column 20,
Line 27, “protections” should read -- projections --.

Column 21,
Line 22, “Referring” should read -- ¶ Referring --.

Column 23,
Line 60, “Referring” should read ¶ Referring --.

Column 24,
Line 11, “space S” should read -- space S. --.

Column 25,
Line 54, “drum 7” should read -- drum 7. --.

Column 27,
Line 51, “guide 13aR” should read -- guide 13aR. --.

Column 29,
Line 4, “means” should read -- mean --.
Line 8, “means” to” should read -- means “to --.

Column 36,
Line 6, “examples” should read -- example, --.

UNITED STATES PATENT AND TRADEMARK OFFICE

CERTIFICATE OF CORRECTION

PATENT NO. : 6,763,209 B2
DATED : July 13, 2004
INVENTOR(S) : Akira Higeta et al.

It is certified that error appears in the above-identified patent and that said Letters Patent is hereby corrected as shown below:

Column 37,
Line 30, "[process" should read -- [Process --.

Column 38,
Line 29, "may" should read -- may be --.

Column 39,
Line 43, "leing" should read -- le --.
Line 50, "tridge" should read -- tridges --.

Signed and Sealed this

Second Day of November, 2004

JON W. DUDAS
*Director of the United States Patent and Trademark Office*